US011498118B2

(12) United States Patent
Funagane et al.

(10) Patent No.: US 11,498,118 B2
(45) Date of Patent: Nov. 15, 2022

(54) METHOD FOR PRODUCING METAL INGOT

(71) Applicant: NIPPON STEEL CORPORATION, Tokyo (JP)

(72) Inventors: Hitoshi Funagane, Tokyo (JP); Kenji Hamaogi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/604,916

(22) PCT Filed: Apr. 13, 2018

(86) PCT No.: PCT/JP2018/015536

§ 371 (c)(1),
(2) Date: Oct. 11, 2019

(87) PCT Pub. No.: WO2018/190419

PCT Pub. Date: Oct. 18, 2018

(65) Prior Publication Data

US 2020/0122226 A1 Apr. 23, 2020

(30) Foreign Application Priority Data

Apr. 13, 2017 (JP) ..... JP2017-079732
Apr. 13, 2017 (JP) ..... JP2017-079733
(Continued)

(51) Int. Cl.
*C22B 9/22* (2006.01)
*C22B 34/12* (2006.01)
(Continued)

(52) U.S. Cl.
CPC ..... *B22D 7/005* (2013.01); *B22D 11/116* (2013.01); *B22D 21/06* (2013.01); *B22D 27/02* (2013.01);
(Continued)

(58) Field of Classification Search
CPC ..... B22D 11/11; B22D 11/116; B22D 11/103; B22D 21/005; B22D 21/06; B22D 27/02; C22B 9/22; C22B 9/228; F27B 3/02–045
See application file for complete search history.

(56) References Cited

U.S. PATENT DOCUMENTS 4,838,340 A * 6/1989 Entrekin ..... B22D 11/11 164/154.5

FOREIGN PATENT DOCUMENTS

JP 04124229 A * 4/1992
JP 2004-232066 A 8/2004
(Continued)

OTHER PUBLICATIONS

English machine translation for JP-2004-276039-A dated Oct. 7, 2004.
(Continued)

*Primary Examiner* — Kevin E Yoon
*Assistant Examiner* — Jacky Yuen
(74) *Attorney, Agent, or Firm* — Birch, Stewart, Kolasch & Birch, LLP

(57) ABSTRACT

A method for producing a metal ingot by using an electron-beam melting furnace having an electron gun and a hearth that accumulates a molten metal of a metal raw material, wherein the metal raw material is supplied to the position on a supply line disposed along a second side wall of the hearth that accumulates the molten metal of the metal raw material. A first electron beam is radiated along a first irradiation line that is disposed along the supply line and is closer to a central part of the hearth relative to the supply line on the surface of the molten metal, wherein a surface temperature (T2) of the molten metal at the first irradiation line is made higher than an average surface temperature (T0) of the entire surface of the molten metal in the hearth.

9 Claims, 25 Drawing Sheets

(30) Foreign Application Priority Data

Apr. 13, 2017 (JP) ..... JP2017-079734
Apr. 13, 2017 (JP) ..... JP2017-079735

(51) Int. Cl.

| | |
|---|---|
| ***B22D 21/06*** | (2006.01) |
| ***B22D 27/02*** | (2006.01) |
| ***B22D 35/04*** | (2006.01) |
| ***B22D 11/116*** | (2006.01) |
| ***F27B 3/08*** | (2006.01) |
| ***B22D 7/00*** | (2006.01) |
| ***C22C 14/00*** | (2006.01) |
| ***C21D 9/70*** | (2006.01) |

(52) U.S. Cl.
CPC ..... *B22D 35/04* (2013.01); *C21D 9/70* (2013.01); *C22B 9/22* (2013.01); *C22B 34/1295* (2013.01); *C22C 14/00* (2013.01); *F27B 3/08* (2013.01)

(56) References Cited

FOREIGN PATENT DOCUMENTS

| | | | |
|---|---|---|---|
| JP | 2004-276039 | A | 10/2004 |
| JP | 2011-127148 | A | 6/2011 |
| JP | 2013-1975 | A | 1/2013 |
| JP | 2013-245398 | A | 12/2013 |
| WO | WO 90/00627 | A1 | 1/1990 |
| WO | WO 2008/078402 | A1 | 7/2008 |
| WO | WO 2008/0784702 | A1 | 7/2008 |

OTHER PUBLICATIONS

English machine translation for JP-2013-1975-A dated Jan. 7, 2013.
International Preliminary Report on Patentability, dated Oct. 24, 2019 and Written Opinion of the International Searching Authority(Forms PCT/IB/326, PCT/IB/373 and PCT/ISA/237), dated May 22, 2018, for International Application No. PCT/JP2018/01555, with an English Translation.
International Preliminary Report on Patentability, dated Oct. 24, 2019, and Written Opinion of the International Searching Authority(Forms PCT/IB/326, PCT/IB/373 and PCT/ISA/237), dated May 22, 2018, for International Application No. PCT/JP2018/015536, with an English Translation.
International Search Report (Form PCT/ISA/210), dated May 22, 2018, for International Application No. PCT/JP2018/015536, with an English translation.
International Search Report (Form PCT/ISA/210), dated May 22, 2018, for International Application No. PCT/JP2018/015555, with an English translation.
Meng, Tao, "Factors Influencing The Fluid Flow and Heat Transfer In Electron Beam Melting of TI-6AL-4V", B.Eng., Huazhong University of Science and Technology, Nov. 2009, 114 pages.
English machine translation for JP-2004-232066-A, dated Aug. 19, 2004.

* cited by examiner

| No. | TEMPERATURE OF MOLTEN METAL | MOVEMENT OF LDI |
|---|---|---|
| 2-1 |   |  |
| 2-2 |  |  |
| 2-3 |  |  |
| 2-4 |  |  |
| 2-5 |  |  |
| 2-6 |  |  |

| No. | TEMPERATURE OF MOLTEN METAL | MOVEMENT OF LDI |
|---|---|---|
| 7-1 |   |  |
| 7-2 |  |  |
| 7-3 |  |  |
| 7-4 |  |  |
| 7-5 |  |  |
| 7-6 |  |  |

METHOD FOR PRODUCING METAL INGOT

TECHNICAL FIELD

The present invention relates to a method for producing a metal ingot that melts a metal raw material by an electron beam melting process.

BACKGROUND ART

An ingot of commercially pure titanium or a titanium alloy or the like is produced by melting a titanium raw material such as titanium sponge or scrap. Examples of techniques for melting a metal raw material (hereunder, may be referred to simply as "raw material") such as a titanium raw material include a vacuum arc remelting process, a plasma arc melting process, and an electron beam melting process. Among these, in the electron beam melting process, the raw material is melted by radiating an electron beam onto a solid raw material in an electron-beam melting furnace (hereunder, also referred to as "EB furnace"). To prevent dissipation of the energy of the electron beam, melting of the raw material by radiation of the electron beam in the EB furnace is performed inside a vacuum chamber. Molten titanium (hereunder, may also be referred to as "molten metal") that is the melted raw material is refined in a hearth, and thereafter is solidified in a mold to form a titanium ingot. According to the electron beam melting process, because the radiation position of the electron beam that is the heat source can be accurately controlled by an electromagnetic force, heat can also be sufficiently supplied to molten metal in the vicinity of the mold. Therefore, it is possible to produce an ingot without deteriorating the surface quality thereof.

An EB furnace generally includes a raw material supplying portion that supplies a raw material such as titanium sponge, one or a plurality of electron guns for melting the supplied raw material, a hearth (for example, a water-cooled copper hearth) for accumulating the melted raw material, and a mold for forming an ingot by cooling molten titanium that was poured therein from the hearth. EB furnaces are broadly classified into two types according to differences between the configurations of the hearths. Specifically, for example, an EB furnace 1A that includes a melting hearth 31 and a refining hearth 33 as illustrated in FIG. 1, and an EB furnace 1B that includes only a refining hearth 30 as illustrated in FIG. 2 are available as two types of EB furnace.

The EB furnace 1A illustrated in FIG. 1 includes a raw material supplying portion 10, electron guns 20*a* to 20*e*, a melting hearth 31 and refining hearth 33, and a mold 40. The solid raw material 5 that is introduced into the melting hearth 31 from the raw material supplying portion 10 is irradiated with electron beams by the electron guns 20*a* and 20*b* to thereby melt the raw material 5 to obtain a molten metal 5*c*. The melted raw material (molten metal 5*c*) in the melting hearth 31 flows into the refining hearth 33 that communicates with the melting hearth 31. In the refining hearth 33, the temperature of the molten metal 5*c* is maintained or increased by radiation of electron beams onto the molten metal 5*c* by the electron guns 20*c* and 20*d*. By this means, impurities contained in the molten metal 5*c* are removed or the like, and the molten metal 5*c* is refined. Thereafter, the refined molten metal 5*c* flows into the mold 40 from a lip portion 33*a* provided at an end portion of the refining hearth 33. The molten metal 5*c* solidifies inside the mold 40, thereby producing an ingot 50. A hearth composed of the melting hearth 31 and the refining hearth 33 as illustrated in FIG. 1 is also referred to as a "long hearth".

On the other hand, the EB furnace 1B shown in FIG. 2 includes raw material supplying portions 10A and 10B, electron guns 20A to 20D, a refining hearth 30 and a mold 40. A hearth that is composed of only the refining hearth 30 in this way is also referred to as a "short hearth", relative to the "long hearth" illustrated in FIG. 1. In the EB furnace 1B that uses the short hearth, the solid raw material 5 that is placed on the raw material supplying portions 10A and 10B is melted by electron beams that are directly radiated from the electron guns 20A and 20B, and the melted raw material 5 is dripped into the molten metal 5*c* in the refining hearth 30 from the raw material supplying portions 10A and 10B. Thus, the melting hearth 31 illustrated in FIG. 1 can be omitted from the EB furnace 1B illustrated in FIG. 2. In addition, in the refining hearth 30, the temperature of the molten metal 5*c* is maintained or increased by radiating electron beams from the electron gun 20C over a wide range on the entire surface of the molten metal 5*c*. By this means, impurities contained in the molten metal 5*c* are removed or the like, and thus the molten metal 5*c* is refined. Thereafter, the refined molten metal 5*c* flows into the mold 40 from a lip portion 36 provided at an end portion of the refining hearth 30, and an ingot 50 is produced.

In the case of producing an ingot using a hearth and a mold by means of an electron beam melting process as described above, if impurities are mixed in with the ingot, the impurities will be the cause of cracks in the ingot. Therefore, there is a need for the development of electron beam melting technology that can ensure that impurities do not become mixed into molten metal that flows into a mold from a hearth. Impurities are mainly included in the raw material, and are classified into two kinds, namely, a HDI (High Density Inclusion) and a LDI (Low Density Inclusion). A HDI is, for example, an impurity in which tungsten is the principal component, and the density of the HDI is larger than the density of molten titanium. On the other hand, a LDI is an impurity in which the principal component is nitrided titanium or the like. The inside of the LDI is in a porous state, and therefore the density of the LDI is less than the relative density of molten titanium.

On the inner surface of a water-cooled copper hearth, a solidified layer is formed at which molten titanium that came in contact with the hearth solidified. The solidified layer is referred to as a "skull". Among the aforementioned impurities, because the HDIs have a high relative density, the HDIs settle in the molten metal (molten titanium) in the hearth, and adhere to the surface of the skull and are thereby trapped, and hence the possibility of HDIs becoming mixed into the ingot is low. On the other hand, because the density of the LDIs is less than the density of molten titanium, a major portion of the LDIs float on the molten metal surface within the hearth. While the LDIs are floating on the molten metal surface, the nitrogen diffuses and is dissolved into the molten metal. In the case of using the long hearth illustrated in FIG. 1, because the residence time of the molten metal in the long hearth can be prolonged, it is easier to cause impurities such as LDIs to dissolve into the molten metal in comparison to a case of using a short hearth. On the other hand, in the case of using a short hearth as illustrated in FIG. 2, because the residence time of the molten metal in the short hearth is short compared to the long hearth, the possibility that impurities will not dissolve into the molten metal is high compared to when using the long hearth. Further, in the case of LDIs that have a high nitrogen content, because the dissolving point thereof is high, the possibility of the LDIs dissolving into the molten metal during the residence time of normal operations is extremely low.

Therefore, for example, Patent Document 1 discloses a method of electron beam melting for metallic titanium in which the surface of molten metal in a hearth is scanned with an electron beam in the opposite direction to the direction in which the molten metal flows into a mold, and the average temperature of molten metal in a region adjacent to a molten metal discharging opening in the hearth is made equal to or higher than the melting point of impurities. According to the technique disclosed in Patent Document 1, by scanning an electron beam in a zig-zag manner in the opposite direction to the flow direction of the molten metal, it is attempted to push back impurities that float on the molten metal surface to the upstream side so that the impurities do not flow into a mold on the downstream side.

LIST OF PRIOR ART DOCUMENTS

Patent Document

Patent Document 1: JP2004-232066A

Non Patent Document

Non-Patent Document 1: Tao Meng, "Factors influencing the fluid flow and heat transfer in electron beam melting of Ti-6Al-4V", (2009)

SUMMARY OF INVENTION

Technical Problem

However, according to the method disclosed in the aforementioned Patent Document 1, because an electron beam is scanned in the opposite direction to the flow direction of the molten metal, there is a possibility that, on the downstream side of the molten metal flow relative to the electron beam radiation position, impurities will pass through into the mold. In addition, on the downstream side relative to the electron beam radiation position, the flow of molten metal accelerates toward the mold and thus the residence time of the molten metal in the hearth becomes shorter, and there is the possibility that the rate of removal of impurities will decrease. Further, when impurities are present on the downstream side of the molten metal flow relative to the radiation position of the electron beam, the risk of those impurities riding on the flow of molten metal and flowing out into the mold increases. For these reasons, there is a possibility that impurities contained in molten metal within the hearth, particularly LDIs floating on the surface of the molten metal 5*c*, will flow out into the mold from the hearth and become mixed in the ingot that is formed in the mold. Therefore, there is a need for a method for producing a metal ingot that, by inhibiting the outflow of impurities such as LDIs from a hearth into a mold, can inhibit impurities from being mixed into an ingot.

An objective of the present invention, which has been made in consideration of the aforementioned problem, is to provide a novel and improved method for producing a metal ingot, which makes it possible to inhibit impurities contained in molten metal in a hearth from being mixed into an ingot.

Solution to Problem

To solve the aforementioned problem, according to an aspect of the present invention, there is provided a method for producing a metal ingot by using an electron-beam melting furnace having an electron gun capable of controlling a radiation position of an electron beam and a hearth that accumulates a molten metal of a metal raw material, the metal ingot containing 50% by mass or more in total of at least one metallic element selected from a group consisting of titanium, tantalum, niobium, vanadium, molybdenum and zirconium, wherein:

among a plurality of side walls of the hearth that accumulates the molten metal of the metal raw material, a first side wall is a side wall provided with a lip portion for causing the molten metal in the hearth to flow out into a mold, and a second side wall is at least one of the side walls other than the first side wall;

the metal raw material is supplied to a position on a supply line that is disposed along an inside face of the second side wall on a surface of the molten metal;

a first electron beam is radiated along a first irradiation line, the first irradiation line being disposed along the supply line and being closer to a central part of the hearth relative to the supply line on the surface of the molten metal; and the radiation of the first electron beam along the first irradiation line increases a surface temperature (T2) of the molten metal at the first irradiation line above an average surface temperature (T0) of the entire surface of the molten metal in the hearth, and forms, in an outer layer of the molten metal, a first molten metal flow from the first irradiation line toward the supply line.

A configuration may be adopted so that a temperature gradient ΔT/L represented by Formula (A) below is −2.70 [K/mm] or more.

$$\Delta T/L=(T2-T1)/L \quad \text{(A)}$$

T1: surface temperature [K] of the molten metal at the supply line

T2: surface temperature [K] of the molten metal at the first irradiation line L: distance [mm] between the first irradiation line and the supply line on the surface of the molten metal A configuration may be adopted so that the aforementioned ΔT/L is 0.00 [K/mm] or more, and the first molten metal flow that flows from the first irradiation line across the supply line toward an inside face of the second side wall is formed in the outer layer of the molten metal.

A configuration may be adopted so that the metal raw material is melted at a raw material supplying portion, and the melted metal raw material is caused to drip from the raw material supplying portion onto a position on the supply line of the molten metal in the hearth.

A configuration may be adopted so that, on the surface of the molten metal, both ends of the first irradiation line are positioned on an outer side in an extending direction of the supply line relative to both ends of the supply line.

A configuration may be adopted so that a second molten metal flow toward the lip portion is formed in a belt-shaped region between the supply line and the first irradiation line, and a second electron beam is spot-radiated onto the second molten metal flow.

A configuration may be adopted so that the second electron beam is spot-radiated onto the second molten metal flow at a position of an irradiation spot that is disposed at an end portion on the lip portion side of the belt-shaped region.

A configuration may be adopted so that a third electron beam is radiated along a second irradiation line, the second irradiation line being disposed such that the second irradiation line blocks the lip portion on the surface of the molten metal and both ends of the second irradiation line are positioned in a vicinity of the first side wall.

The metal raw material may contain 50% by mass or more of a titanium element.

Advantageous Effects of Invention

According to the present invention as described above, the mixing of impurities contained in molten metal in a hearth into an ingot can be inhibited.

DESCRIPTION OF EMBODIMENTS

Figure 1:
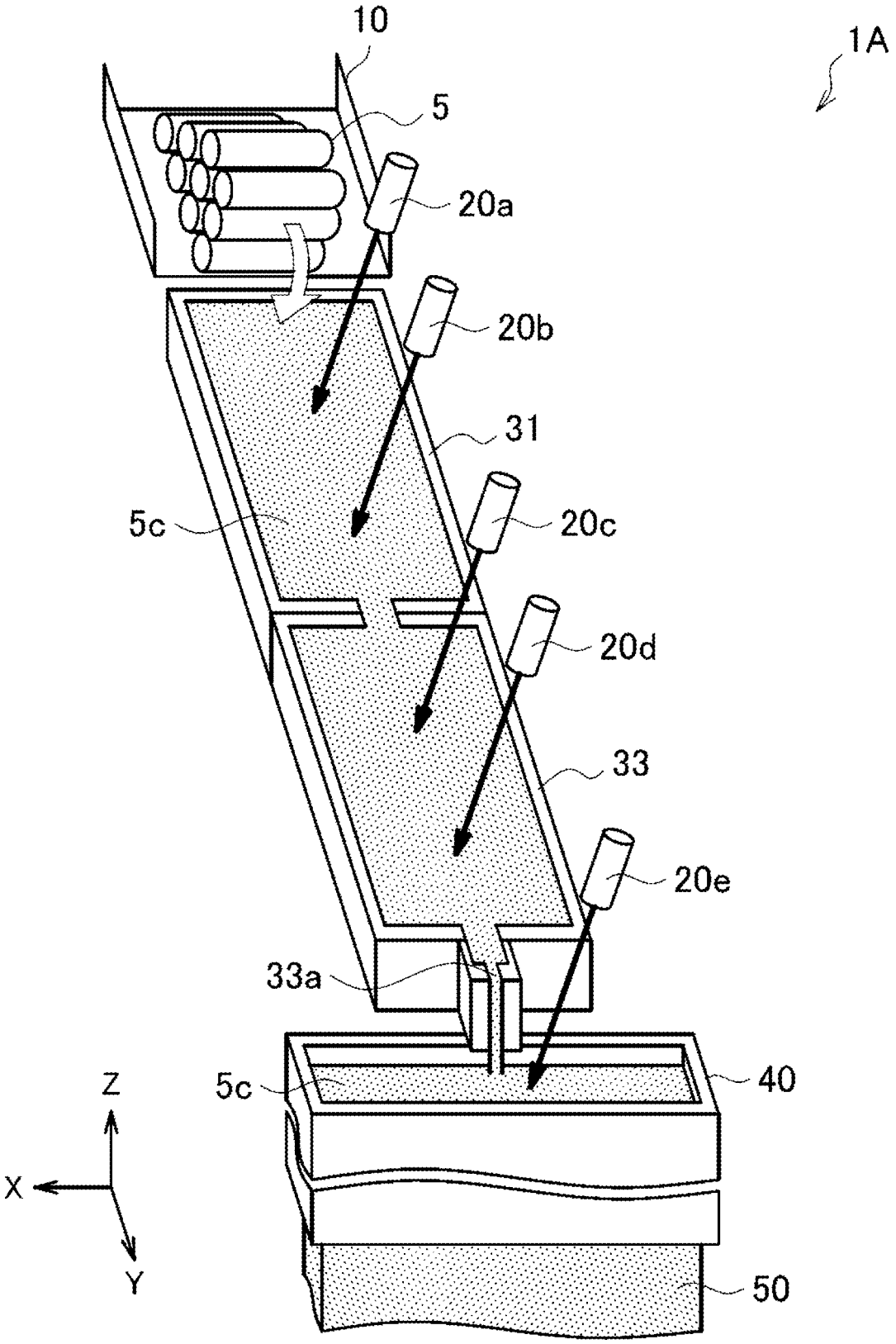
FIG. 1 is a schematic diagram illustrating an electron-beam melting furnace that includes a long hearth.
Figure 2:
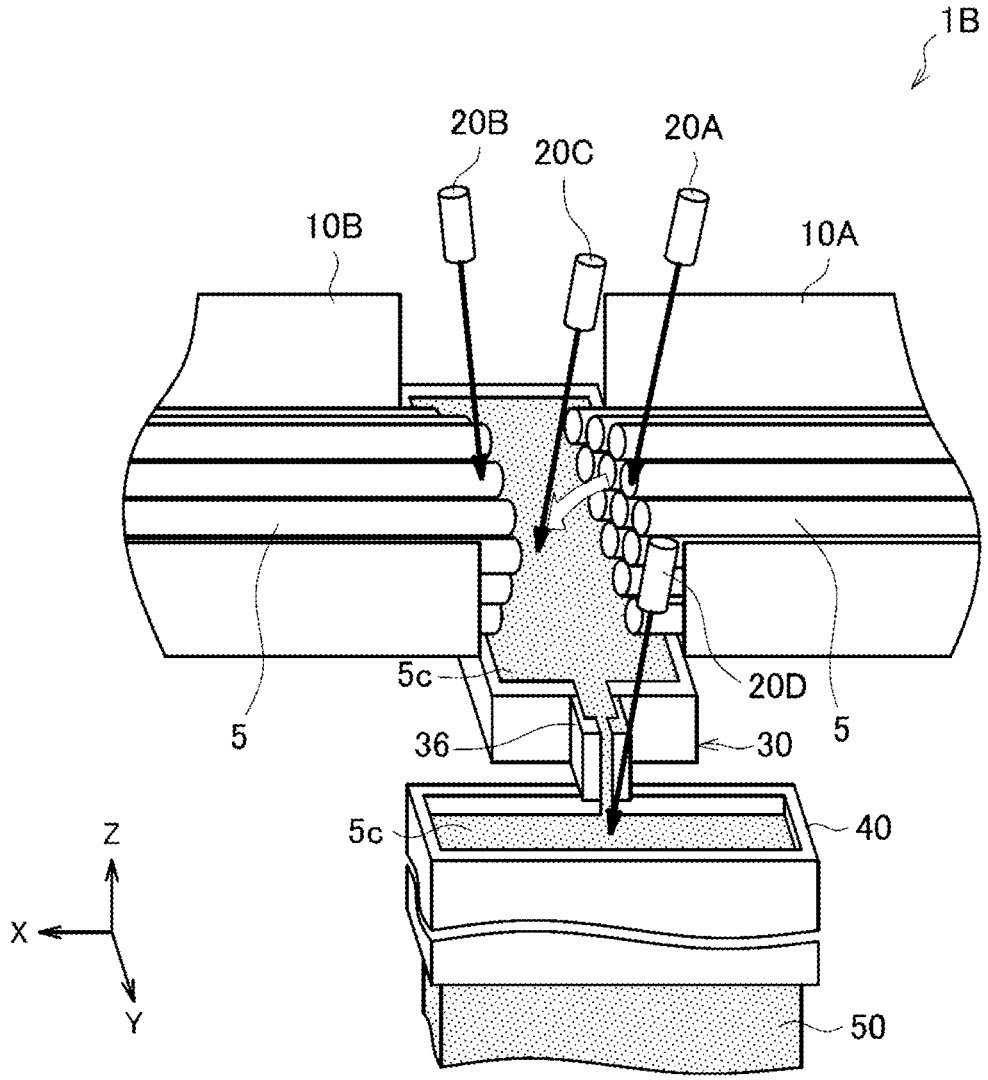
FIG. 2 is a schematic diagram illustrating an electron-beam melting furnace that includes a short hearth.

Hereunder, preferred embodiments of the present invention are described in detail while referring to the accompanying drawings. Note that, in the present specification and the accompanying drawings, constituent elements having substantially the same functional configuration are denoted by the same reference characters and a duplicate description thereof is omitted.

1. First Embodiment

First, a method for producing a metal ingot according to a first embodiment of the present invention will be described.

[1.1. Configuration of Electron-Beam Melting Furnace]

Figure 3:
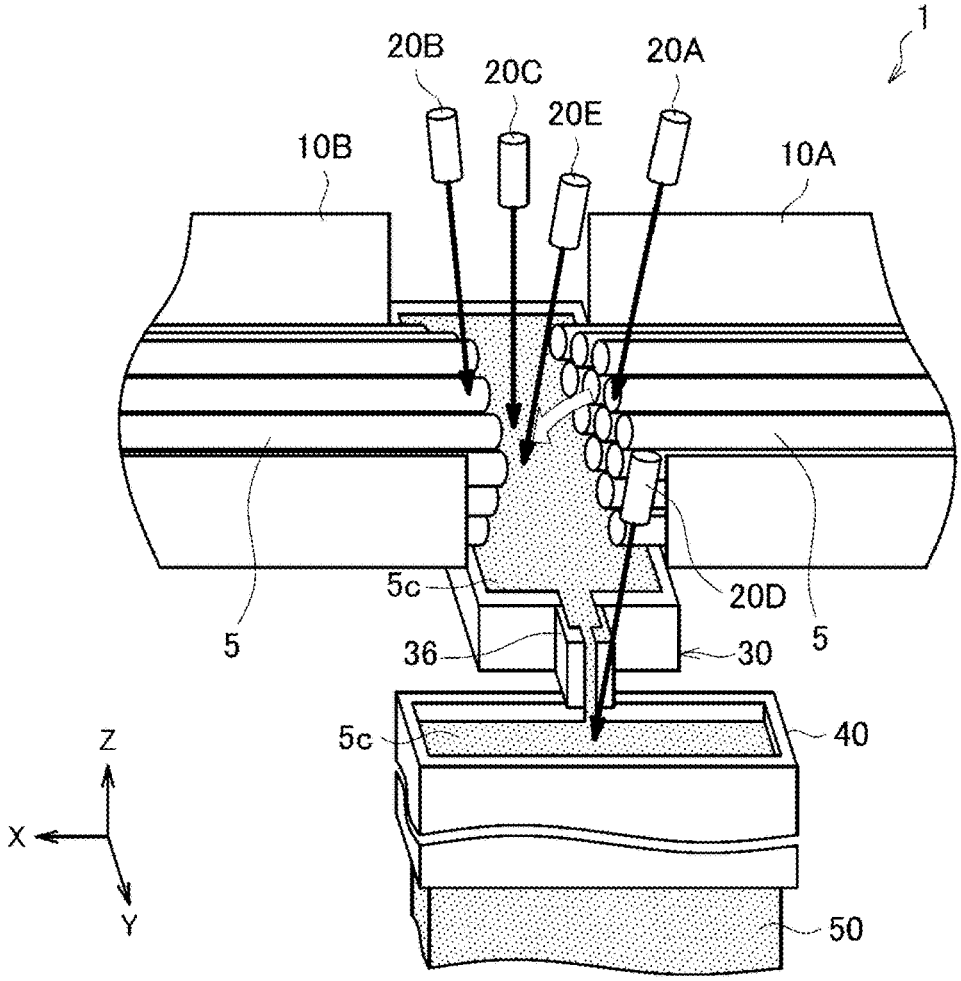
FIG. 3 is a schematic diagram illustrating an electron-beam melting furnace (short hearth) that implements a method for producing a metal ingot according to a first embodiment of the present invention.

First, referring to FIG. 3, the configuration of an electron-beam melting furnace for implementing the method for producing a metal ingot according to the present embodiment will be described. FIG. 3 is a schematic diagram illustrating the configuration of an electron-beam melting furnace 1 (hereunder, referred to as "EB furnace 1") according to the present embodiment.

As illustrated in FIG. 3, the EB furnace 1 includes a pair of raw material supplying portions 10A and 10B (hereunder, may be referred to generically as "raw material supplying portion 10"), a plurality of electron guns 20A to 20E (hereunder, may be referred to generically as "electron guns 20"), a refining hearth 30 and a mold 40. Thus, the EB furnace 1 according to the present embodiment includes only a single refining hearth 30 as a hearth, and the hearth structure in question is referred to as a "short hearth". Note that, although the method for producing a metal ingot of the present invention can be favorably applied to the EB furnace 1 with a short hearth as illustrated in FIG. 3, the method for producing a metal ingot of the present invention is also applicable to the EB furnace 1A that has a long hearth as illustrated in FIG. 1.

The refining hearth 30 (hereunder, referred to as "hearth 30") is an apparatus for refining a molten metal 5*c* of a metal raw material 5 (hereunder, referred to as "raw material 5") while accumulating the molten metal 5*c*, to thereby remove impurities contained in the molten metal 5*c*. The hearth 30 according to the present embodiment is constituted by, for example, a water-cooled copper hearth having a rectangular shape. A lip portion 36 is provided in a side wall at an end on one side in the longitudinal direction (Y direction) of the hearth 30. The lip portion 36 is an outlet for causing the molten metal 5*c* inside the hearth 30 to flow out into the mold 40.

The mold 40 is an apparatus for cooling and solidifying the molten metal 5*c* of the raw material 5, to thereby produce a metal ingot 50 (for example, a titanium ingot or titanium alloy ingot). The mold 40 is, for example, constituted by a water-cooled copper mold that has a rectangular tube shape. The mold 40 is disposed underneath the lip portion 36 of the hearth 30, and cools the molten metal 5*c* that is poured therein from the hearth 30 that is above the mold 40. As a result, the molten metal 5*c* within the mold 40 solidifies progressively toward the lower part of the mold 40, and a solid ingot 50 is formed.

The raw material supplying portion 10 is an apparatus for supplying the raw material 5 into the hearth 30. The raw material 5 is, for example, a titanium raw material such as titanium sponge or scrap. In the present embodiment, for example, as illustrated in FIG. 3, the pair of raw material supplying portions 10A and 10B are provided above a pair of side walls on the long sides of the hearth 30. The solid raw material 5 that has been conveyed from outside is placed in the raw material supplying portions 10A and 10B, and electron beams from the electron guns 20A and 20B are radiated onto the raw material 5.

Thus, in the present embodiment, in order to supply the raw material 5 into the hearth 30, the solid raw material 5 is melted by radiating electron beams onto the raw material 5 in the raw material supplying portion 10, and the melted raw material 5 (melted metal) is dripped into the molten metal 5*c* in the hearth 30 from inner edge portions of the raw material supplying portion 10. In other words, the raw material 5 is supplied into the hearth 30 by first melting the raw material 5 beforehand outside of the hearth 30, and then allowing the melted metal to drip into the molten metal 5*c* in the hearth 30. Drip lines that represent the positions at which the melted metal drips from the raw material supplying portion 10 onto the surface of the molten metal 5*c* in the hearth 30 in this way correspond to supply lines 26 that are described later (see FIG. 4).

Note that a method for supplying the raw material 5 is not limited to dripping as described in the aforementioned example. For example, the solid raw material 5 may be introduced as it is into the molten metal 5*c* in the hearth 30 from the raw material supplying portion 10. The introduced solid raw material 5 is then melted in the high-temperature molten metal 5*c* and thereby added to the molten metal 5*c*. In this case, introduction lines that represent the positions at which the solid raw material 5 is introduced into the molten metal 5*c* in the hearth 30 correspond to the supply lines 26 that are described later (see FIG. 4).

To implement an electron beam melting process, the electron guns 20 radiate electron beams onto the raw material 5 or the molten metal 5*c*. As illustrated in FIG. 3, the EB furnace 1 according to the present embodiment includes, for example, the electron guns 20A and 20B for melting the solid raw material 5 that was supplied to the raw material supplying portion 10, the electron gun 20C for maintaining the temperature of the molten metal 5*c* in the hearth 30, the electron gun 20D for heating the molten metal 5*c* at an upper part within the mold 40, and the electron gun 20E for inhibiting the outflow of impurities from the hearth 30. Each of the electron guns 20A to 20E is capable of controlling the radiation position of the electron beam. Therefore, the electron guns 20C and 20E are capable of radiating electron beams onto desired positions on the surface of the molten metal 5*c* in the hearth 30.

The electron guns 20A and 20B radiate electron beams onto the solid raw material 5 placed on the raw material supplying portion 10 to thereby heat and melt the raw material 5. The electron gun 20C heats the molten metal 5*c* and maintains the molten metal 5*c* at a predetermined temperature by radiating an electron beam over a wide range with respect to the surface of the molten metal 5*c* in the hearth 30. The electron gun 20D radiates an electron beam onto the surface of the molten metal 5*c* in the mold 40 to thereby heat the molten metal 5*c* at the upper part thereof and maintain the molten metal 5*c* that is at the upper part at a predetermined temperature so that the molten metal 5*c* at the upper part in the mold 40 does not solidify. The electron gun 20E radiates an electron beam in a concentrated manner along an irradiation line 25 (see FIG. 4) at the surface of the molten metal 5*c* in the hearth 30 in order to prevent an outflow of impurities from the hearth 30 to the mold 40.

Thus, the present embodiment is characterized in that the present embodiment prevents an outflow of impurities by, for example, radiating (line radiation) an electron beam in a concentrated manner along the irradiation line 25 at the surface of the molten metal 5*c* using the electron gun 20E. This characteristic will be described in detail later. Note that, in the EB furnace 1 according to the present embodiment, the electron gun 20E for line radiation as illustrated in FIG. 3 is provided separately from the other electron guns 20A to 20D. By this means, while utilizing the other electron guns 20A to 20D to melt the raw material 5 and maintain the temperature of the molten metal 5*c*, line radiation by the electron gun 20E can be continued concurrently and in parallel therewith, and therefore a decrease in the surface temperature of the molten metal 5*c* at the line radiation position can be prevented. However, the present invention is not limited to this example. For example, an electron beam may be radiated along the irradiation line 25 using one or a plurality of electron guns among the existing electron guns 20A and 20B for melting the raw material or the electron guns 20C and 20D for maintaining the temperature of the molten metal, and without additionally installing the electron gun 20E for line radiation. By this means, the number of electron guns installed in the EB furnace 1 can be decreased and the equipment cost can be reduced, and the existing electron guns can be effectively utilized.

[1.2. Outline of Method for Producing Metal Ingot]

Figure 4:
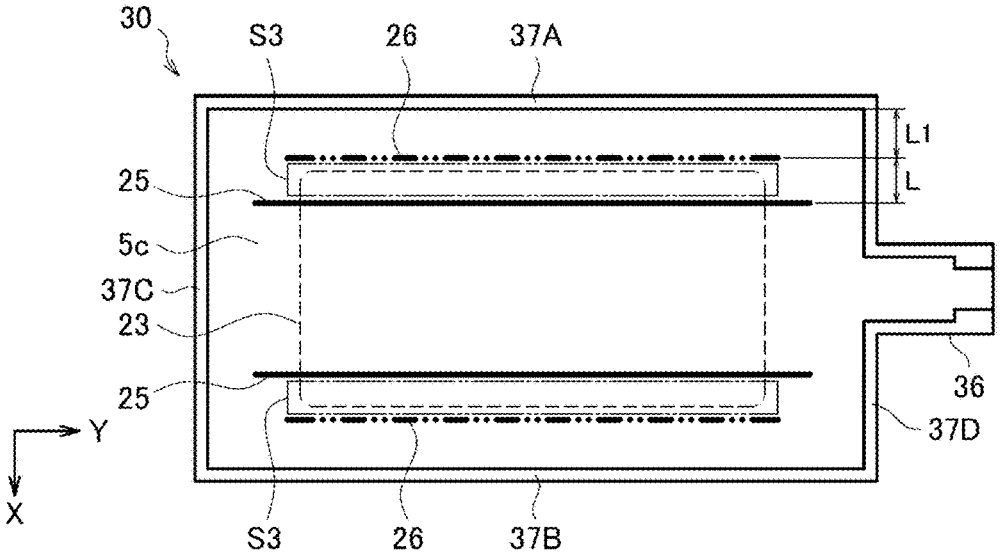
FIG. 4 is a plan view illustrating an example of an irradiation line and supply lines in a hearth according to the first embodiment of the present invention.
Figure 5:
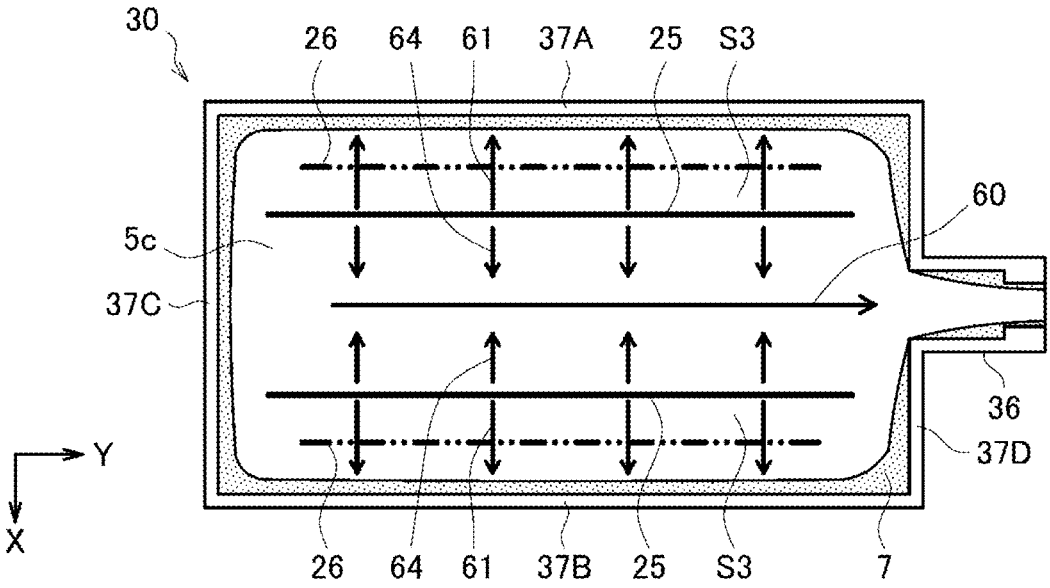
FIG. 5 is a plan view illustrating an example of molten metal flows that are formed by the method for producing a metal ingot according to the first embodiment of the present invention.

Next, an outline of the method for producing a metal ingot according to the present embodiment will be described referring to FIG. 3 to FIG. 5. FIG. 4 is a plan view illustrating an example of the irradiation line 25 and the supply lines 26 in the hearth 30 according to the present embodiment. FIG. 5 is a plan view illustrating an example of a molten metal flow that is formed according to the method for producing a metal ingot of the present embodiment. Note that, the plan views of the hearth 30 in FIG. 4 and FIG. 5 correspond to the hearth 30 of the EB furnace 1 that is illustrated in FIG. 3.

A problem to be solved by the method for producing a metal ingot according to the present embodiment is, when producing a metal ingot 50 of commercially pure titanium or a titanium alloy or the like, to inhibit impurities from mixing into the ingot 50, by inhibiting impurities contained in melted metal (the molten metal 5*c*) into which the solid raw material 5 was melted from flowing into the mold 40 from the hearth 30. According to the method for producing a metal ingot of the present embodiment, in particular, a titanium raw material as a metal raw material is taken as an object, and the method for producing a metal ingot solves the problem of inhibiting the occurrence of a situation in which LDIs that, among the impurities contained in the titanium raw material, have a density that is smaller than the density of molten metal of titanium (molten titanium) become mixed into the ingot 50 of titanium or a titanium alloy. Note that, the term "titanium" or "titanium alloy" as used herein refers to a metal containing 50% by mass or more of titanium as an element.

To solve the aforementioned problem, in the method for producing a metal ingot according to the present embodiment, as illustrated in FIG. 4, the raw material 5 is supplied into the molten metal 5*c* inside the hearth 30 at positions along the supply lines 26 that are adjacent to the side walls 37A and 37B on the long sides of hearth 30. Further, an electron beam is radiated in a concentrated manner along the irradiation lines 25 that are adjacent to the supply lines 26 on the surface of the molten metal 5*c* that is accumulated in the hearth 30.

The supply lines 26 (corresponds to "supply line" of the present invention) are imaginary lines representing positions at which the raw material 5 is supplied from outside of the hearth 30 into the molten metal 5*c* in the hearth 30. The supply lines 26 are disposed on the surface of the molten metal 5*c* at positions along the respective inside faces of the side walls 37A and 37B of the hearth 30.

In the present embodiment, the melted raw material 5 is dripped into the hearth 30 from inner edge portions of the raw material supplying portion 10 disposed at an upper part of the side walls 37A and 37B on the long sides of the hearth 30 as illustrated in FIG. 3. Therefore, the respective supply lines 26 are positioned at the surface of the molten metal 5*c* in the hearth 30 below the inner edge portions of the raw material supplying portion 10, and have a linear shape which extends along the inside face of the respective side walls 37A and 37B. Note that, as long as the supply lines 26 are a linear shape extending along the inside faces of the side walls 37A, 37B and 37C of the hearth 30, the supply lines 26 need not be in a strictly straight-line shape, and for example, may be in a broken-line shape, a dotted-line shape, a curve shape, a wavy line shape, a zigzag shape, a double line shape, a belt shape, a polygonal line shape or the like.

The irradiation line 25 (corresponds to "first irradiation line" of the present invention) is an imaginary line that represents the path of positions at which an electron beam (corresponds to "first electron beam" of the present invention) is radiated in a concentrated manner onto the surface of the molten metal 5*c* in the hearth 30. The irradiation line 25 is disposed along the supply line 26 of the raw material 5, on the surface of the molten metal 5*c*. As long as the irradiation line 25 is a linear shape extending along the supply line 26, the irradiation line 25 need not have a strictly straight-line shape, and, for example, may be a broken-line shape, a dotted-line shape, a curve shape, a wavy line shape, a zigzag shape, a double line shape, a belt shape, a polygonal line shape or the like.

The disposition of the irradiation line 25 and the supply lines 26 will now be described in further detail. As illustrated in FIG. 4, the rectangular hearth 30 according to the present embodiment has four side walls 37A, 37B, 37C and 37D (hereunder, may also be referred to generically as "side wall(s) 37"). The pair of side walls 37A and 37B that face each other in the X direction constitute a pair of long sides of the hearth 30, and are parallel to the longitudinal direction (Y direction) of the hearth 30. Further, the pair of side walls 37C and 37D that face each other in the Y direction constitute a pair of short sides of the hearth 30, and are parallel to the width direction (X direction) of the hearth 30.

The lip portion 36 for causing the molten metal 5*c* in the hearth 30 to flow out into the mold 40 is provided in the side wall 37D that is one of the short sides. On the other hand, the lip portion 36 is not provided in the three side walls 37A, 37B and 37C that are the side walls other than the side wall 37D. Therefore, the side wall 37D corresponds to "first side wall" in which a lip portion is provided, and the side walls 37A, 37B and 37C correspond to "second side wall(s)" in which the lip portion 36 is not provided.

In the example illustrated in FIG. 4, two rectilinear supply lines 26, 26 that are parallel to each other are disposed on the surface of the molten metal 5*c* in the hearth 30. In addition, two rectilinear irradiation lines 25, 25 that are parallel to each other are disposed on the inside (closer to the central part in the width direction (X direction) of the hearth 30) of the supply lines 26, 26. The supply lines 26, 26 are disposed along the inside faces of two side walls 37A and 37B (second side walls) among the four side walls of the hearth 30, at positions closer to the central part in the width direction (X direction) of the hearth 30 that are separated by a predetermined distance L1 from the corresponding inside faces. The irradiation lines 25, 25 are disposed along the supply lines 26, 26 at positions closer to the central part in the width direction of the hearth 30 that are separated by a predetermined distance L from the corresponding supply lines 26, 26.

In the present embodiment, a special temperature gradient is formed at the surface of the molten metal 5*c* in the hearth 30 by radiating an electron beam in a concentrated manner along the irradiation line 25 on the surface of the molten metal 5*c* as mentioned above, and flowage of the molten metal 5*c* is thereby controlled. The temperature distribution on the surface of the molten metal 5*c* in the hearth 30 will now be described.

In general, in the electron beam melting process, in order to prevent the molten metal 5*c* in the hearth 30 from solidifying, an electron beam is uniformly radiated by, for example, the electron gun 20C onto a heat-retention radiation region 23 that occupies a wide area of the surface of the molten metal 5*c*, to thereby maintain the temperature of the molten metal 5*c* in the hearth 30. By performing such radiation of an electron beam for heat retention, all of the molten metal 5*c* accumulated in the hearth 30 is heated, and an average surface temperature T0 (hereunder, referred to as "molten metal surface temperature T0") of the entire surface of the molten metal 5*c* is maintained at a predetermined temperature. The molten metal surface temperature T0 is for example, in the range of 1923 K (melting point of titanium alloy) to 2323 K, and preferably is in the range of 1973 K to 2273 K.

In the present embodiment, at the aforementioned raw material supplying portion 10, electron beams are radiated onto the solid raw material 5 by the electron guns 20A and 20B to melt the raw material 5, and the melted metal of a high temperature that was melted drips onto the positions of the supply lines 26 of the molten metal 5*c* in the hearth 30 to thereby supply the raw material 5 to the hearth 30. Therefore, among the entire molten metal 5*c* in the hearth 30, impurities such as LDIs contained in the raw material 5 are mainly present in the vicinity of the supply lines 26. Further, because the high-temperature melted metal is supplied continuously or discontinuously to the supply lines 26, a high temperature region (see region S1 in FIG. 6 and FIG. 7) having a surface temperature T1 that is higher than the aforementioned molten metal surface temperature T0 is formed in the vicinity of the supply lines 26. The surface temperature T1 (hereunder, referred to as "raw material supplying temperature T1") of the molten metal 5*c* at the supply lines 26 is approximately the same as the temperature of the melted metal that is dripped from the raw material supplying portion 10 into the hearth 30, and is higher than the aforementioned molten metal surface temperature T0 (T1>T0). The raw material supplying temperature T1 is, for example, within the range of 1923 K to 2423 K, and preferably within the range of 1973 K to 2373 K.

In addition, according to the method for producing a metal ingot of the present embodiment, separately to radiation of the aforementioned electron beam for heat retention onto the heat-retention radiation region 23 of the molten metal 5*c*, an electron beam is radiated in a concentrated manner by the electron gun 20E onto the surface of the molten metal 5*c* along the irradiation line 25. Specifically, the radiation position of the electron beam radiated by the electron gun 20E is moved on the irradiation line 25 on surface of the molten metal 5*c*. By such concentrated radiation of an electron beam along the irradiation line 25, a high temperature region (see region S2 in FIG. 7) having a surface temperature T2 that is higher than the aforementioned molten metal surface temperature T0 is formed in the vicinity of the irradiation line 25. The surface temperature T2 (hereunder, referred to as "line radiation temperature T2") of the molten metal 5*c* at the irradiation line 25 is higher than the aforementioned molten metal surface temperature T0 (T2>T0). In addition, in order to more reliably inhibit an outflow of impurities, preferably the line radiation temperature T2 is higher than the aforementioned raw material supplying temperature T1 (T2>T1>T0). The line radiation temperature T2 is, for example, within a range of 1923 K to 2473 K, and preferably is within a range of 1973 K to 2423 K.

Thus, according to the method for producing a metal ingot of the present embodiment, by radiating in a concentrated manner an electron beam along the irradiation line 25 on the surface of the molten metal 5*c*, a high temperature region of the molten metal 5*c* is also formed in the vicinity of the irradiation line 25, and not just the vicinity of the supply lines 26. By this means, as illustrated in FIG. 5, in the outer layer of the molten metal 5*c*, a molten metal flow 61 (corresponds to "first molten metal flow" of the present invention) can be forcibly formed from the irradiation line 25 toward the supply lines 26. In particular, by maintaining the temperature of the molten metal 5*c* at a temperature higher than T0 at arbitrary positions of the irradiation line 25, the molten metal flow 61 that is formed can be constantly maintained.

By means of the molten metal flow 61, the flowage of impurities such as LDIs that are present in a large amount in the vicinity of the supply lines 26 is controlled, and the impurities can be prevented from flowing toward the lip portion 36. Specifically, by means of the molten metal flow 61, impurities such as LDIs that are floating on the surface of the molten metal 5*c* in regions in the vicinity of the supply lines 26 are caused to move toward the side walls 37A and 37B of the hearth 30, and thus the impurities such as LDIs can be trapped by a skull 7 formed on the inside faces of the side walls 37A and 37B. Further, by radiating an electron beam along the irradiation lines 25 to increase the line irradiation temperature T2, dissolving of nitrided titanium or the like that is a principal component of the LDIs floating in the molten metal 5*c* in the vicinity of the irradiation line 25 can be promoted.

Thus, in the method for producing a metal ingot according to the present embodiment, electron beams are radiated along the irradiation lines 25, 25 that are closer to the central part (inner side) of the hearth 30 relative to the supply lines 26, 26. By this means, a high temperature region of the molten metal 5*c* is formed in the vicinity of each irradiation line 25, and by means of the molten metal flow 61 from the high temperature regions, impurities such as LDIs that are present in the vicinity of the supply lines 26 are caused to flow toward the side walls 37A and 37B, thus preventing the impurities from flowing toward the lip portion 36. Therefore, the impurities can be inhibited from flowing out from the hearth 30 to the mold 40.

[1.3. Flowage of Molten Metal Generated by Line Radiation]

Figure 6A:
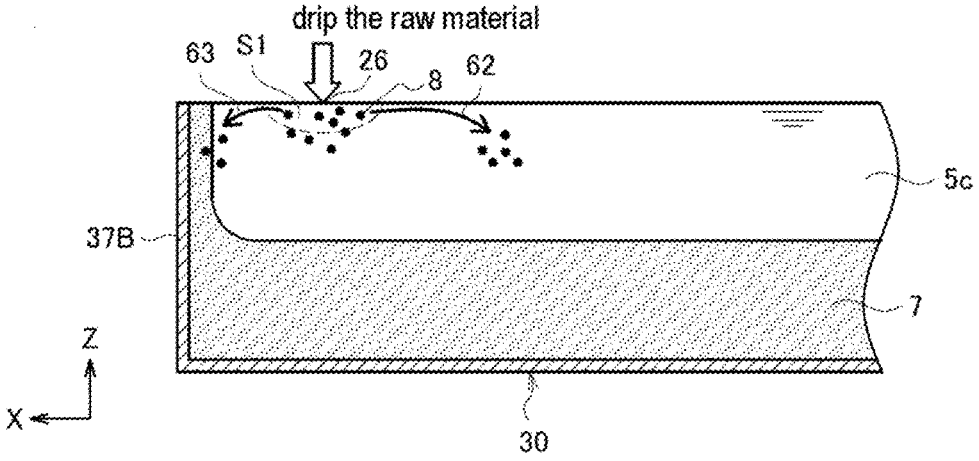
FIG. 6A is a longitudinal section illustrating a flow state of molten metal when an electron beam is not radiated along an irradiation line, as a comparative example of the first embodiment of the present invention.
Figure 6B:
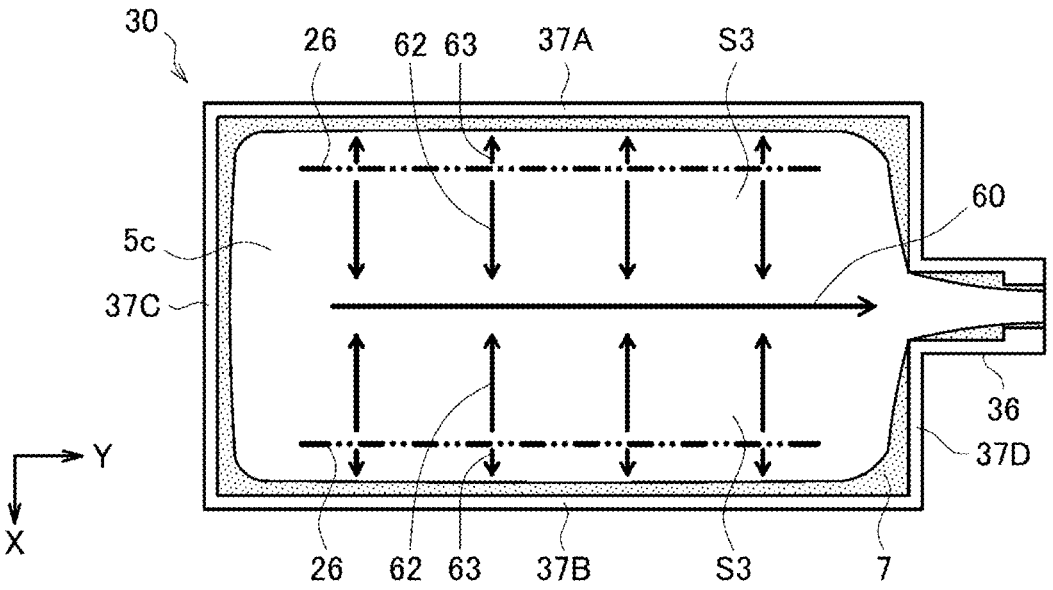
FIG. 6B is a plan view illustrating a flow state of molten metal when an electron beam is not radiated along an irradiation line, as a comparative example of the first embodiment of the present invention.
Figure 7:
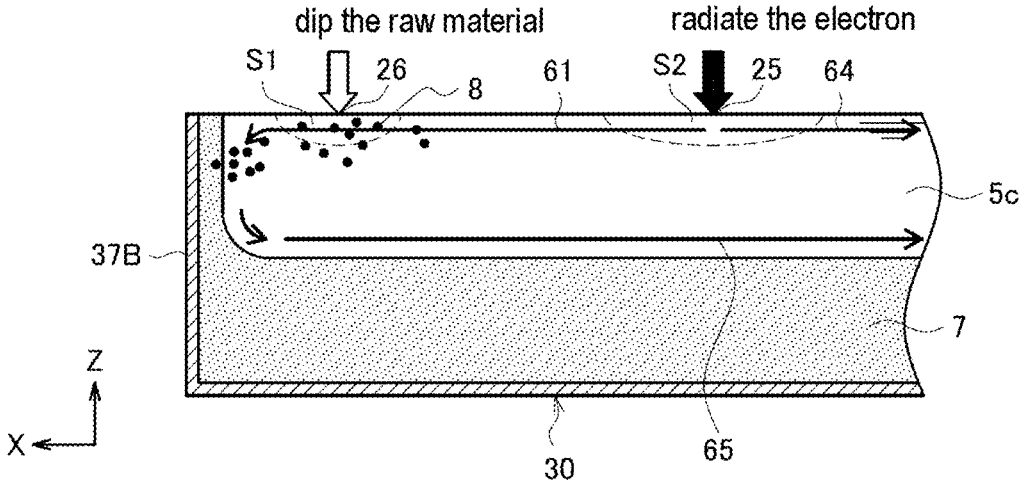
FIG. 7 is a longitudinal section illustrating a flow state of molten metal when an electron beam is radiated along an irradiation line according to the method for producing a metal ingot of the first embodiment of the present invention.

Next, a flowage of the molten metal 5*c* within the hearth 30 that is generated by line radiation of an electron beam will be described in further detail referring to FIG. 5 to FIG. 7. FIG. 6A and FIG. 6B are a longitudinal section and a plan view of a hearth, respectively, that illustrate a flow state of the molten metal 5*c* when an electron beam is not radiated along the irradiation lines 25, as a comparative example of the present embodiment. FIG. 7 is a longitudinal section of a hearth that illustrates a flow state of the molten metal 5*c* when an electron beam is radiated along the irradiation lines 25 according to the method for producing a metal ingot of the present embodiment.

As described above, in the present embodiment, raw material supplying portions 10A and 10B are disposed above the side walls 37A and 37B on the long sides of the hearth 30, respectively, and electron beams are radiated by the electron guns 20A and 20B onto the solid raw material 5 on the raw material supplying portions 10A and 10B to thereby melt the raw material 5. The melted raw material 5 is dripped onto the positions of the supply lines 26, 26 of the molten metal 5*c* in the hearth 30 from the raw material supplying portions 10A and 10B. Thus, in the present embodiment, the raw material 5 is supplied into the hearth 30 by causing the melted metal of the raw material 5 to drip onto the molten metal 5*c* in the hearth 30. In this respect, the supply lines 26 according to the present embodiment correspond to imaginary lines (drip lines) that represent the positions at which melted metal of the raw material 5 is dripped onto the surface of the molten metal 5*c*.

The molten metal 5*c* that is accumulated inside the hearth 30 is refined while residing in the hearth 30, and thereafter flows out from the lip portion 36 and is discharged into the mold 40. As illustrated in FIG. 5, at a central part in the width direction (X direction) inside the hearth 30, a molten metal flow 60 that flows along the longitudinal direction (Y direction) of the hearth 30 is formed from the vicinity of the side wall 37C that is one of the short sides toward the lip portion 36. By means of this molten metal flow 60, the molten metal 5*c* that is being accumulated inside the hearth 30 flows out from the lip portion 36 into the mold 40.

Further, as illustrated in FIG. 5 to FIG. 7, a solidified layer (referred to as "skull 7") in which the molten metal 5*c* solidified is formed on the inside face of the side walls 37 and the bottom face of the hearth 30. By accumulating the molten metal 5*c* in the hearth 30, it is possible to remove impurities contained in the molten metal 5*c* by utilizing the skull 7 and the like. Impurities are categorized as HDIs (not illustrated) that have a high relative density compared to the molten metal 5*c*, and LDIs 8 that have a low relative density compared to the molten metal 5*c*. The HDIs that have a high relative density settle in the molten metal 5*c* and adhere to the skull 7 that is formed on the bottom face of the hearth 30, and hence the possibility of HDIs flowing out into the mold 40 from the lip portion 36 is low. On the other hand, a major portion of the LDIs 8 that have a low relative density float on the surface of the molten metal 5*c* and flow by riding on the flow at the outer layer of the molten metal 5*c*. Therefore, it is preferable to control an outer layer flow of the molten metal 5*c* so that the LDIs 8 floating in the molten metal 5*c* of the hearth 30 do not flow out from the lip portion 36 into the mold 40.

Therefore, in the method for producing a metal ingot according to the present embodiment, electron beams are radiated in a concentrated manner along the irradiation lines 25, 25 that are on the inner side relative to the supply lines 26, 26 on the surface of the molten metal 5*c* in the hearth 30. By this means, the Marangoni convection is generated by a temperature gradient at the surface of the molten metal 5*c*, and as illustrated in FIG. 5 and FIG. 7, an outer layer flow of the molten metal 5*c* (first molten metal flow 61) toward the supply lines 26 from the irradiation line 25 is formed in the outer layer of the molten metal 5*c*. By this means, the LDIs 8 that are present in a large amount in the vicinity of the supply lines 26 are caused to flow toward the side walls 37A and 37B of the hearth 30 that are adjacent to the supply lines 26, and are trapped by the skull 7 that is formed on the inside face of the side walls 37A and 37B. This principle is described in detail hereunder.

When a temperature gradient arises at the outer layer of a fluid, a gradient also arises in the surface tension of the fluid, and such a gradient causes the occurrence of convection in the fluid. Such convection in the fluid is called "Marangoni convection". In a case where the fluid is molten titanium or a molten titanium alloy, the Marangoni convection is a flow from a high temperature region toward a low temperature region of the fluid. This is because molten titanium and a molten titanium alloy have a property such that when the temperature thereof is high, the surface tension weakens.

Here, as a comparative example of the present embodiment, as illustrated in FIG. 6A, a case will be considered in which an electron beam is not radiated onto the irradiation line 25, and the temperature of melted metal (raw material supplying temperature T1) that is dripped onto the supply lines 26 is higher than the surface temperature T0 of the molten metal that is already accumulated in the hearth 30. In this case, the region S1 in the vicinity of the supply lines 26 at which the melted raw material 5 (melted metal) is dripped is a high temperature region in which the temperature is higher than the temperature of the molten metal 5*c* in other regions. Therefore, as illustrated in FIG. 6A, because the molten metal 5*c* in the region S1 flows from the relevant supply line 26 in both the direction of the central part in the width direction (X direction) of the hearth 30 and the direction of the side wall 37B, molten metal flows 62 and 63 are formed in the outer layer of the molten metal 5*c*.

Thus, as illustrated in FIG. 6A and FIG. 6B, the LDIs 8 contained in the melted metal that is dripped onto the supply lines 26 ride on the molten metal flow 62 and flow toward the central part in the width direction (X direction) of the hearth 30, and also ride on the molten metal flow 63 and flow toward the side wall 37B of the hearth 30. As illustrated in FIG. 6B, the molten metal flows 62, 62 that flow toward the central part of the hearth 30 from each of the pair of left and right supply lines 26, 26 collide at the central part in the width direction of the hearth 30, thereby forming the molten metal flow 60 toward the lip portion 36 along the longitudinal direction (Y direction) of the hearth 30. As a result, the LDIs 8 floating in the molten metal 5*c* also ride on the molten metal flow 60 and flow toward the lip portion 36, and flow out from the lip portion 36 to the mold 40. Therefore, to ensure that impurities such as the LDIs 8 do not flow out from the lip portion 36 to the mold 40, it is preferable that the outer layer flow of the molten metal 5*c* is controlled so that the LDIs 8 that are present in the vicinity of the supply lines 26 do not ride on the molten metal flow 62 illustrated in FIG. 6A and FIG. 6B and flow toward the central part in the width direction of the hearth 30.

Therefore, in the present embodiment, as illustrated in FIG. 5 and FIG. 7, an electron beam is radiated in a concentrated manner along the irradiation lines 25 that are positioned closer to the central part of the hearth 30 relative to the supply lines 26. By this means, the surface temperature T2 of the molten metal 5*c* in the region S2 in the vicinity of each irradiation line 25 is increased, and a temperature gradient is generated in the surface temperature of the molten metal 5*c* in a belt-shaped region S3 between each irradiation line 25 and the corresponding supply line 26. As a result, in the outer layer of the molten metal 5*c*, Marangoni convection in the molten metal 5*c* (first molten metal flow 61) occurs from the irradiation lines 25 toward the inside face of the side walls 37A and 37B. By means of the molten metal flow 61, the LDIs 8 that are floating at the surface of the molten metal 5*c* in the vicinity of the supply lines 26 are forcibly caused to flow toward the side walls 37A and 37B, and can be prevented from proceeding toward the lip portion 36. Accordingly, in the regions between the irradiation lines 25 and the side walls 37A and 37B, the LDIs 8 contained in the melted metal that was dripped onto the positions of the supply lines 26 ride on the corresponding molten metal flows 61 and flow toward the side walls 37A and 37B, and adhere to the skull 7 formed on the inside faces of the side walls 37A and 37B and are thereby trapped.

The flowage of the molten metal 5*c* generated by line radiation that is mentioned above will now be described in further detail. FIG. 5 and FIG. 7 illustrate the flow of the molten metal 5*c* in a case where the surface temperature T2 of the molten metal 5*c* at the irradiation line 25 (line irradiation temperature T2) is higher than the surface temperature T1 of the molten metal 5*c* at the supply line 26 (raw material supplying temperature T1).

As described above, in a case where the molten metal 5*c* is molten titanium, Marangoni convection is a flow from a high temperature region toward a low temperature region of the molten metal 5*c*. When an electron beam is radiated in a concentrated manner along the irradiation line 25, the region S2 in the vicinity of the irradiation line 25 onto which the electron beam is radiated is heated and becomes a high temperature region. Accordingly, Marangoni convection occurs from the region S2 toward a low temperature region around the region S2. As a result, as illustrated in FIG. 7, in the outer layer of the molten metal 5*c*, a molten metal flow 64 is formed from the irradiation line 25 toward a central part in the width direction of the hearth 30, and the molten metal flow 61 is formed from the irradiation line 25 toward the side wall 37B across the supply line 26. On the other hand, at a deep layer of the molten metal 5*c*, a molten metal flow 65 is formed toward the central part of the hearth 30 from the side wall 37B at an end portion in the width direction (X direction) of the hearth 30.

In this case, it is preferable that, in the outer layer of the molten metal 5*c*, a temperature distribution is formed such that the line irradiation temperature T2 is higher than the raw material supplying temperature T1, and the surface temperature of the molten metal 5*c* progressively decreases from the irradiation line 25 to the supply line 26. By realizing such a temperature distribution, as illustrated in FIG. 7, in the outer layer of the molten metal 5*c*, a molten metal flow is not formed from the supply lines 26 toward the central part of the hearth 30 (corresponds to the molten metal flow 62 in FIG. 6A and FIG. 6B), and the molten metal flow 61 from the irradiation line 25 toward the supply line 26 can cross the supply line 26 and reach the inside face of the side wall 37B.

As a result, as illustrated in FIG. 7, the LDIs 8 that are stagnating in the vicinity of the supply line 26 are caused to flow toward the side wall 37B from the region S1 in the vicinity of the supply line 26 by the molten metal flow 61, and therefore the LDIs 8 do not flow toward the central part of the hearth 30. Note that, the LDIs 8 that are contained in the melted metal that is dripped onto the supply line 26 temporarily spread to both sides in the width direction (X direction) from the supply line 26 due to the effect of colliding with the surface of the molten metal 5*c* when the melted metal is dripped onto the molten metal 5*c*. However, thereafter, the LDIs 8 are forcibly caused to flow toward the side wall 37B from the region S1 in the vicinity of the supply line 26 by the aforementioned molten metal flow 61.

In general, the distance L1 between the supply line 26 at which the raw material 5 is dripped and the side wall 37B is small. Therefore, if the LDIs 8 that float in the vicinity of the supply line 26 are caused to move toward the side wall 37B of the hearth 30 by the molten metal flow 61, the LDIs 8 easily adhere to the skull 7 that is formed on the inside face of the side wall 37B. Accordingly, by forming the molten metal flow 61 in the outer layer of the molten metal 5*c* by line radiation of an electron beam, the LDIs 8 that float in the region S1 in the vicinity of the supply line 26 can be efficiently trapped by the skull 7 on the inside face of the side wall 37B and thereby removed from the molten metal 5*c*.

Further, the contamination source of the LDIs 8 that float in the molten metal 5*c* inside the hearth 30 is the melted metal that is dripped into the hearth 30 from outside, and at least one part of the LDIs 8 contained in the melted metal that is dripped on the supply lines 26 dissolves in the molten metal 5*c* or adheres to the skull 7 while residing inside the hearth 30. Therefore, it is considered that almost no LDIs 8 float in the molten metal 5*c* in regions other than the vicinity of the supply lines 26. Accordingly, as illustrated in FIG. 7, there are almost no floating LDIs 8 present in the region S2 in the vicinity of the irradiation line 25 on which an electron beam is radiated in a concentrated manner, and the LDIs 8 are not contained in the molten metal flow 64 from the region S2 toward the central part in the width direction of the hearth 30. As illustrated in FIG. 5, the molten metal flow 64 in the X direction changes direction at the central part in the width direction of the hearth 30 and becomes the molten metal flow 60 in the Y direction toward the lip portion 36, and the LDIs 8 are also not contained in the molten metal flow 60. Therefore, a problem does not arise even if the molten metal flow 60 is allowed to flow out as it is from the lip portion 36 to the mold 40.

[1.4. Disposition of Irradiation Line]

Next, the disposition of the irradiation line 25 along which an electron beam is radiated in a concentrated manner will be described in detail.

According to the method for producing a metal ingot of the present embodiment, as illustrated in FIG. 4, electron beams are radiated in a concentrated manner on the irradiation lines 25, 25 that are disposed closer to the central part in the width direction (X direction) of the hearth 30 relative to the supply lines 26, 26. The supply lines 26 are imaginary lines representing positions at which melted metal of the raw material 5 is dripped into the molten metal 5*c* in the hearth 30. The irradiation line 25 is an imaginary line that corresponds to a radiation path of an electron beam that is emitted by the electron gun 20E for line radiation.

From the viewpoint of accurately preventing an outflow of impurities by means of line radiation, it is preferable that the supply lines 26, 26 have a straight-line shape that is substantially parallel to the inside face of the side walls 37A and 37B that are the pair of long sides of the hearth 30. In addition, each irradiation line 25 is preferably a straight-line shape that is substantially parallel to each supply line 26.

Here, the term "substantially parallel" refers not only to a case where the relevant two objects are strictly parallel (the angular difference is 0°), but also includes a case where an angular difference between the relevant two objects is not greater than a predetermined angle. As a specific example, if an angular difference between the supply lines 26 and the inside faces of the side walls 37A and 37B of the hearth 30 is not more than 6°, the effect of the present invention is obtained. However, this does not apply to a case where the supply lines 26 are too close to the side walls 37A and 37B, specifically, a case where the supply lines 26 are around 5 mm or less from the side walls 37A and 37B and a hindrance thus arises with respect to supplying the melted metal. Further, with regard to the irradiation lines 25 also, the effect of the present invention can be expected to be obtained if an angular difference with respect to the corresponding supply line 26 is not more than 4°. However, this does not apply to a case where the relevant irradiation line 25 is too close to the corresponding supply line 26, specifically, a case where the irradiation line 25 is around 5 mm or less from the supply line 26, and a hindrance thus arises with respect to formation of the molten metal flow 61 that is described later.

In the method for producing a metal ingot according to the present embodiment, as illustrated in FIG. 5, by radiating electron beams in a concentrated manner along the irradiation lines 25, Marangoni convection (the molten metal flow 61) is generated from the irradiation lines 25 toward the supply lines 26. The molten metal flows 62 from each of the supply lines 26 toward the central part of the hearth 30 are pushed back toward the side walls 37A and 37B of the hearth 30 by the molten metal flow 61. At such time, it is preferable to appropriately set the disposition of the supply lines 26 and the irradiation lines 25 so that the molten metal flows 62 from the supply lines 26 toward the central part of the hearth 30 do not pass through the irradiation lines 25 and flow toward the central part of the hearth 30.

Therefore, in the present embodiment, as illustrated in FIG. 4, the supply lines 26 are set in a straight-line shape that is substantially parallel to the inside face of the side walls 37A and 37B on the long side of the hearth 30, and the irradiation lines 25 are set in a straight-line shape that is substantially parallel to the supply lines 26. By this means, regardless of the position in the longitudinal direction (Y direction) of the hearth 30, the distance L1 between the inside face of the side wall 37A or 37B and the corresponding supply line 26 is approximately constant, and the distance L between each irradiation line 25 and the corresponding supply line 26 is approximately constant. Accordingly, the molten metal flows 61 in the X direction from the irradiation lines 25 toward the supply lines 26 are formed approximately equally in the longitudinal direction (Y direction) of the hearth 30. Hence, the molten metal flows 62 from the supply lines 26 toward the central part of the hearth 30 can be evenly controlled by the molten metal flows 61 across the entire area in the Y direction of the supply lines 26. Hence, the occurrence of a situation in which the molten metal flows 62 cross the irradiation lines 25 and flow toward the central part in the width direction (X direction) of the hearth 30 can be prevented more reliably.

Next, the distance L between each irradiation line 25 and the corresponding supply line 26 will be described. As illustrated in FIG. 5, in the space between the supply line 26 and the central part in the width direction of the hearth 30, the irradiation line 25 is disposed at a position that is separated from the supply line 26 by a predetermined distance L. In general the distance L is determined by the raw material supplying temperature T1 and radiation conditions of the electron beam that is radiated along the irradiation line 25 and the like, and, for example, the distance L is preferably within the range of 5 mm to 35 mm. Thus, the LDIs 8 that stagnate in the vicinity of the supply lines 26 are caused to flow in a favorable manner as far as the side walls 37A and 37B by the molten metal flow 61 from the irradiation line 25, and can thereby be trapped by the skull 7.

If the distance L is less than 5 mm, the irradiation line 25 will be too close to the supply line 26, and the high temperature region S2 and the high temperature region S1 illustrated in FIG. 7 will overlap. Therefore, there is a possibility that it will become difficult for the molten metal flow 61 to be formed from the irradiation line 25 toward the supply line 26, and that the LDIs 8 in the vicinity of the supply line 26 will flow toward the lip portion 36. On the other hand, if the distance L is more than 35 mm, the molten metal flow 61 from the irradiation line 25 toward the supply line 26 will weaken before reaching the supply line 26. Consequently, it will become difficult to cause the LDIs 8 in the vicinity of each supply line 26 to flow as far as the side walls 37A and 37B, and there is a possibility that, in the belt-shaped region S3 between the irradiation line 25 and the supply line 26, the LDIs 8 will flow toward the lip portion 36. Accordingly, in order to appropriately push back the molten metal flow 62 by means of the molten metal flow 61, it is preferable that the distance L is within the range of 5 mm to 35 mm.

Further, as illustrated in FIG. 4 and FIG. 5, it is preferable that the irradiation lines 25 are longer than the supply lines 26, and that the two ends of each irradiation line 25 are disposed on the outer side in the extending direction of the corresponding supply line 26 relative to the two ends of the supply line 26, respectively (in the example illustrated in the drawings, the outer side in the longitudinal direction (Y direction) of the hearth 30). By this means, since each irradiation line 25 covers the corresponding supply line 26 by a wide amount in the Y direction, the molten metal flow 62 that flows in the X direction from each supply line 26 can be suppressed such that the molten metal flow 62 does not bypass the two ends in the Y direction of the corresponding irradiation line 25 and flow toward the central part of the hearth 30.

[1.5. Settings of Electron Beam for Line Radiation]

Next, the settings with respect to the electron beam for line radiation (first electron beam) that is radiated in a concentrated manner along the aforementioned irradiation line 25 will be described.

In order to push back the molten metal flow 62 from the supply lines 26 (see FIG. 6A and FIG. 6B) toward the side wall 37B of the hearth 30 by means of the molten metal flow 61 from the irradiation line 25 (see FIG. 7) as mentioned above, it is preferable to appropriately set the radiation conditions such as the heat transfer amount, the scanning speed and the heat flux distribution of the electron beam for line radiation.

The heat transfer amount [W] of the electron beam is a parameter that influences an increase in the temperature of the molten metal 5*c* at the irradiation line 25, and the flow velocity of the Marangoni convection (the molten metal flow 61) that occurs due to the temperature increase in question. If the heat transfer amount of the electron beam is small, a molten metal flow 61 that overcomes the molten metal flow 62 from the supply lines 26 cannot be formed. Accordingly, the larger that the heat transfer amount of the electron beam is, the more preferable it is, and for example, the heat transfer amount is in the range of 0.15 to 0.60 [MW].

The scanning speed [m/s] of the electron beam is a parameter that influences the flow velocity of the aforementioned molten metal flow 61. When radiating an electron beam along the irradiation line 25, the irradiation line 25 on the surface of the molten metal 5*c* is repeatedly scanned with an electron beam emitted from the electron gun 20E. If the scanning speed of the electron beam at such time is slow, positions at which the electron beam is not radiated for a long time will arise on the irradiation line 25. The surface temperature of the molten metal 5*c* will rapidly decrease at a position at which the electron beam is not radiated, and the flow velocity of the molten metal flow 61 that arises from the position in question will decrease. In such a case, it will be difficult to suppress the molten metal flow 62 from the supply lines 26 by means of the molten metal flow 61, and the possibility that the molten metal flow 62 will pass through the irradiation line 25 will increase. Therefore, the scanning speed of the electron beam is preferably as fast as possible, and for example is within a range of 1.0 to 20.0 [m/s].

The heat flux distribution at the surface of the molten metal 5*c* that is produced by the electron beam is a parameter that influences the heat transfer amount imparted to the molten metal 5*c* from the electron beam. The heat flux distribution corresponds to the size of the aperture of the electron beam. The smaller that the aperture of the electron beam is, the greater the degree to which a steep heat flux distribution can be imparted to the molten metal 5*c*. The heat flux distribution at the surface of the molten metal 5*c* is, for example, represented by the following Formula (1) (for example, see Non-Patent Document 1). The following Formula (1) represents that a heat flux is exponentially attenuated in accordance with the distance from the electron beam spot.

[Expression 1]

$$q(t, x, y) = q_0 \exp\left(-\frac{(x-x_o)^2 + (y-y_o)^2}{2\sigma^2}\right) \quad (1)$$

$$\int\int_{all\ surface} q dx dy = Q \quad (2)$$

Where, (x,y) represents a position of the molten metal surface, $(x_0, y_0)$ represents the electron beam spot, and σ represents the standard deviation of the heat flux distribution. In addition, as illustrated in the above Formula (2), the heat transfer amount Q of the electron gun is set to become the total sum of the heat flux q with respect to the surface of the entire molten metal 5*c* within the hearth 30. With respect to these parameters, for example, by means of a heat flow simulation or the like, values may be determined and set so as to cause the molten metal flows 62 that flow from the supply lines 26 toward the central part of the hearth 30 to flow toward the side walls 37A and 37B of the hearth 30 by Marangoni convection that is generated by radiation of an electron beam along the irradiation lines 25.

At such time, if the flow velocity of the molten metal flows 61 from the irradiation lines 25 to the supply lines 26 is greater than the flow velocity of the molten metal flows 62 from the supply lines 26 to the central part of the hearth 30, the molten metal flows 61 can more reliably stop the molten metal flows 62 and can push back the molten metal flows 62 toward the inside faces of the side walls 37A and 37B of the hearth 30.

Therefore, it is good to set the radiation conditions of the electron beam for line radiation so that, as illustrated in FIG. 7, the temperature (line irradiation temperature T2) of the high temperature region S2 in the vicinity of the irradiation line 25 becomes higher than the temperature (raw material supplying temperature T1) of the high temperature region S1 in the vicinity of the supply line 26. By this means, the temperature difference between the line irradiation temperature T2 and the molten metal surface temperature T0 can be made greater than the temperature difference between the raw material supplying temperature T1 and the molten metal surface temperature T0, and hence the molten metal flow 61 from the irradiation line 25 toward the supply line 26 can be strengthened.

Note that, the aforementioned radiation conditions such as the heat transfer amount, scanning speed and heat flux distribution of the electron beam for line radiation are constrained by the specifications of the equipment that radiates the electron beam. Accordingly, when setting the radiation conditions of the electron beam it is good to make the heat transfer amount as large as possible, the scanning speed as fast as possible, and the heat flux distribution as narrow as possible (make the aperture of the electron beam as small as possible) within the range of the equipment specifications. Further, radiation of an electron beam with respect to the irradiation line 25 may be performed by a single electron gun or may be performed by a plurality of electron guns. In addition, as the electron gun for line radiation described here, the electron gun 20E for exclusive use for line radiation (see FIG. 3) may be used, or alternatively, electron guns for other purposes such as the electron guns 20A and 20B for melting raw material or the electron guns 20C and 20D for maintaining the temperature of the molten metal (see FIG. 3) may also be used for the purpose of line radiation.

[1.6. Temperature Gradient ΔT/L]

Next, the influence that a temperature gradient ΔT/L between the irradiation lines 25 and the supply lines 26 has on the flowage of the molten metal 5*c* in the hearth 30 will be described referring to FIG. 5, FIG. 8 and FIG. 9.

The strength of the aforementioned molten metal flow 61 flowing from each irradiation line 25 toward the corresponding supply line 26 changes depending on a temperature gradient ΔT/L between the irradiation line 25 and the corresponding supply line 26. Here, a temperature gradient ΔT/L [K/mm] is represented by Formula (A) below.

$$\Delta T/L = (T2 - T1)/L \quad (A)$$

T1: surface temperature of the molten metal 5*c* at the supply line 26 (raw material supplying temperature) [K]

T2: surface temperature of the molten metal 5*c* at the irradiation line 25 (line irradiation temperature) [K]

L: distance between the irradiation line 25 and the supply line 26 on the surface of the molten metal 5*c* [mm]

The temperature gradient ΔT/L is preferably −2.70 [K/mm] or more (ΔT/L≥−2.70 K/mm), and more preferably 0.00 [K/mm] or more (ΔT/L≥0.00 K/mm). Thus, the molten metal flow 61 that flows from the irradiation line 25 to the supply line 26 can be appropriately formed. Therefore, in the belt-shaped region S3 between the irradiation line 25 and the supply line 26, impurities such as the LDIs 8 floating in the vicinity of the supply lines 26 can be inhibited from flowing toward the lip portion 36, and the outflow amount of impurities from the lip portion 36 can be favorably suppressed. The reason is described in detail hereunder.

(1) Case where "ΔT/L≥0.00"

First, a case where the temperature gradient ΔT/L is 0.00 [K/mm] or more will be described referring to FIG. 5. In this case, the line irradiation temperature T2 increases to a temperature that is equal to or higher than the raw material supplying temperature T1 (T2≥T1>T0), and ΔT/L also increases sufficiently.

Accordingly, as illustrated in FIG. 5, in the belt-shaped regions S3 between the irradiation lines 25 and the supply lines 26, the molten metal flows 61 that flow from the irradiation lines 25 toward the supply lines 26 are dominant over the molten metal flows 62 that flow from the supply lines 26 toward the irradiation lines 25 (see FIG. 6A and FIG. 6B). Therefore, the molten metal flows 61 that flow from the irradiation lines 25 and cross the supply lines 26 to flow toward the inside faces of the side walls 37A and 37B can be appropriately formed. Accordingly, by means of the molten metal flows 61, the LDIs 8 in the vicinity of the supply lines 26 can be caused to appropriately flow toward the side walls 37A and 37B, and can be reliably trapped by the skull 7 on the inside faces of the side walls 37A and 37B and thereby removed from the molten metal 5*c* (see FIG. 7). Hence, if ΔT/L≥0.00 K/mm, since impurities such as the LDIs 8 can be suitably inhibited from flowing out from the lip portion 36, the outflow amount of impurities from the lip portion 36 can be reduced by a large degree to, for example, 0.1% or less in comparison to a case where electron beams are not radiated along the irradiation lines 25. In this case, the outflow amounts of impurities are values obtained by totaling up the amounts of impurities (mass) contained in the molten metal 5*c* that flows out from the lip portion 36 per unit time, and comparing the obtained values.

(2) Case where "−2.70≤ΔT/L<0.00"

Next, a case where the temperature gradient ΔT/L is −2.70 [K/mm] or more and less than 0.00 [K/mm] will be described referring to FIG. 8. In this case, although the line irradiation temperature T2 increases to a temperature that is higher than the molten metal surface temperature T0 (T2>T0), the line irradiation temperature T2 is less than the raw material supplying temperature T1, and ΔT/L is also less than zero.

Figure 8:
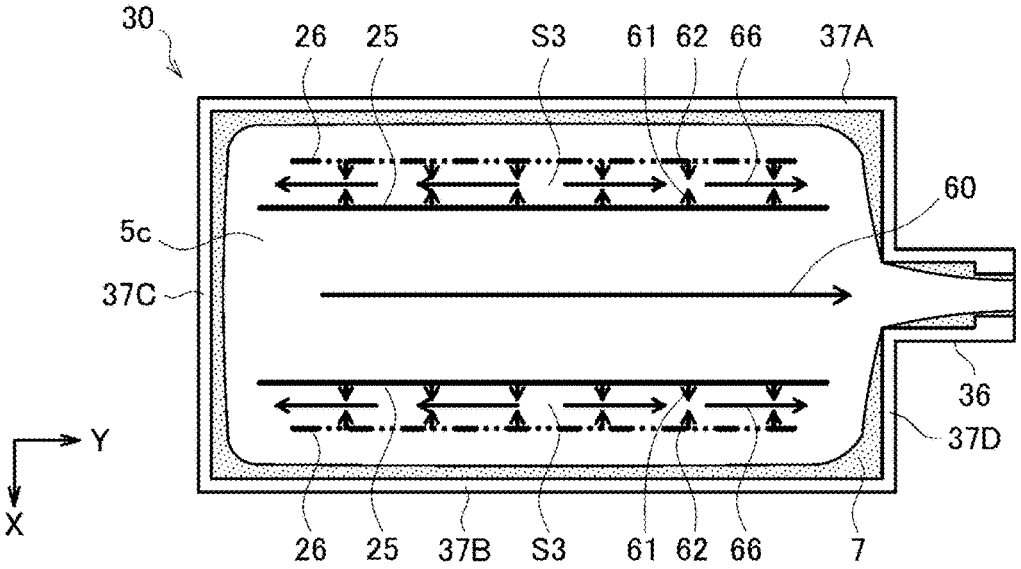
FIG. 8 is a plan view illustrating another example of molten metal flows that are formed by the method for producing a metal ingot according to the first embodiment of the present invention.

Accordingly, as illustrated in FIG. 8, in the belt-shaped regions S3 between the irradiation lines 25 and the supply lines 26, the molten metal flows 62 that flow from the supply lines 26 toward the irradiation lines 25 and the molten metal flows 61 that flow from the irradiation lines 25 toward the supply lines 26 become equal to each other. Therefore, in the belt-shaped regions S3, in some cases a molten metal flow 66 that flows in the Y direction toward the lip portion 36 is formed. However, since the molten metal flows 62 from the supply lines 26 can be suppressed by the molten metal flows 61 from the irradiation lines 25, the molten metal flows 62 can be prevented from crossing over the irradiation lines 25 and flowing toward the central part in the width direction of the hearth 30. The LDIs 8 which were stopped from entering into the central part ride on the molten metal flow 66 and move through the belt-shaped region S3, and gradually proceed toward the lip portion 36. Because the belt-shaped region S3 is sandwiched between the supply line 26 at which the temperature is T1 and the irradiation line 25 at which the temperature is T2, the temperature in the belt-shaped region S3 is higher than T0. Therefore, some of the LDIs 8 are dissolved while the LDIs 8 are in the belt-shaped region S3. Hence, if ΔT/L≥−2.70, since impurities such as the LDIs 8 can be inhibited from flowing out from the lip portion 36, the outflow amount of impurities from the lip portion 36 can be reduced to, for example, 1% or less in comparison to a case where electron beams are not radiated along the irradiation lines 25.

(3) Case where "ΔT/L<−2.70"

Next, a case where the temperature gradient ΔT/L is less than −2.70 [K/mm] will be described referring to FIG. 9. In this case, the line irradiation temperature T2 becomes lower than the raw material supplying temperature T1 by a large margin (T1>T2>T0), and ΔT/L also becomes a negative value that is smaller by a large margin. Therefore, with respect to the molten metal flows 61 that flow from the irradiation lines 25 toward the supply lines 26, positions at which the molten metal flows 61 are formed and positions at which the molten metal flows 61 are not formed may arise depending on the radiation positions (position in the Y direction) of the electron beams with respect to the irradiation lines 25.

Figure 9:
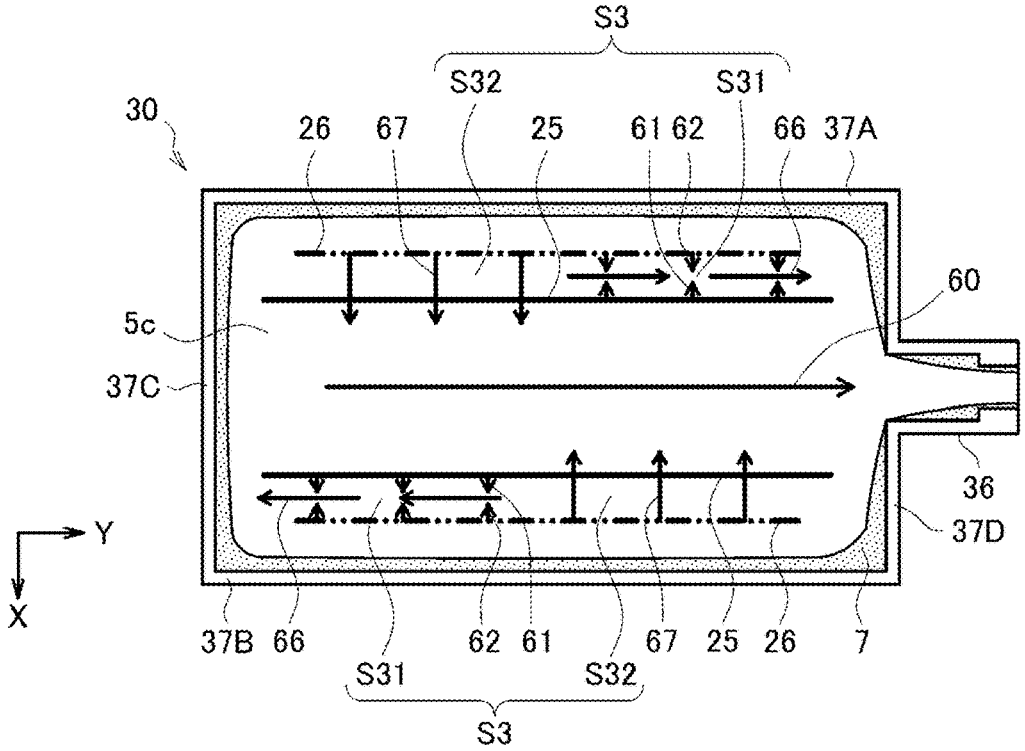
FIG. 9 is a plan view of a hearth that illustrates another example of molten metal flows that are formed by the method for producing a metal ingot according to the first embodiment of the present invention.

Specifically, as illustrated in FIG. 9, in each of the belt-shaped regions S3 between the irradiation lines 25 and the supply lines 26, both the molten metal flow 61 that flows from the irradiation line 25 toward the supply line 26, and the molten metal flow 62 that flows from the supply line 26 toward the irradiation line 25 are formed. Further, depending on the radiation position of the electron beam with respect to the irradiation line 25, a region S31 at which the molten metal flow 61 and the molten metal flow 62 are equal to each other and a region S32 at which the molten metal flow 62 is dominant over the molten metal flow 61 intermix with each other. That is, although the molten metal flow 61 and the molten metal flow 62 become equal in the region S31 in which the line irradiation temperature T2 is high because the region S31 is near to the radiation position of the electron beam that moves on the irradiation line 25, in the region S32 in which the line irradiation temperature T2 decreases relatively due to being away from the radiation position of the electron beam, sometimes the molten metal flow 61 that has sufficient strength is not formed.

Therefore, there is a possibility that, in the belt-shaped region S3 between the irradiation line 25 and the supply line 26, the molten metal flow 66 that flows toward the lip portion 36 will be formed, and a molten metal flow 67 that flows from the supply line 26 and flows across the irradiation line 25 toward the central part in the width direction of the hearth 30 will be formed. Hence, there is a risk that the LDIs 8 that ride on the molten metal flow 66 or the molten metal flow 67 and reside in the vicinity of the supply lines 26 will flow out from the lip portion 36.

However, even in a case where ΔT/L<−2.70, the molten metal flow 62 from the supply line 26 can be suppressed to a certain extent by the molten metal flow 61 from the irradiation line 25. Therefore, the LDIs 8 which were stopped from entering the central part in the width direction of the hearth 30 by the molten metal flow 61 are gradually dissolved while residing in the belt-shaped region S3. Hence, since impurities such as the LDIs 8 in the vicinity of the supply lines 26 can be inhibited to a certain extent from flowing toward the lip portion 36, the outflow amount of impurities from the lip portion 36 can be reduced to, for example, 5% or less in comparison to a case where electron beams are not radiated along the irradiation lines 25.

Therefore, in order to form an appropriate molten metal flow 61 by line radiation and reduce the outflow amount of impurities, a preferable temperature gradient ΔT/L is −2.70 [K/mm] or more, and more preferably is 0.00 [K/mm] or more. It suffices to appropriately set the radiation conditions of the electron beam for line radiation (for example, the heat transfer amount, scanning speed and heat flux distribution of the electron beam), the temperatures T0, T1 and T2 of the molten metal 5*c*, or the disposition of the irradiation lines 25 and the supply lines 26 or distances L and L1 and the like so that a temperature gradient ΔT/L that is within the relevant suitable numerical value range is obtained.

Note that, the larger that the value of the temperature gradient ΔT/L is, the better the value is from the viewpoint of suppressing the outflow amount of impurities. However, an upper limit value of the temperature gradient ΔT/L is constrained by the specifications of the equipment that radiates the electron beam. Because of such constraints with regard to the equipment specifications, for example, the upper limit value of the temperature gradient ΔT/L is preferably 64.0 [K/mm] or less, and more preferably is 10.0 [K/mm] or less.

[1.7. Modification]

Next, a modification of the first embodiment that is described above will be described. In the foregoing, an example was described in which, as illustrated in FIG. 4, the pair of irradiation lines 25, 25 are disposed that are parallel to the side walls 37A and 37B in the longitudinal direction (Y direction) of the hearth 30 and the supply lines 26, 26. However, the present invention is not limited to the foregoing example. It suffices that the irradiation lines 25 and the supply lines 26 are disposed along an arbitrary one or more of the side walls 37A, 37B and 37C (second side walls) that are other than the side wall 37D (first side wall) in which the lip portion 36 is provided, and the irradiation line 25 as well as the number and the direction of irradiation lines 25 that are disposed and the like are not limited to the example illustrated in the aforementioned FIG. 4.

Figure 10:
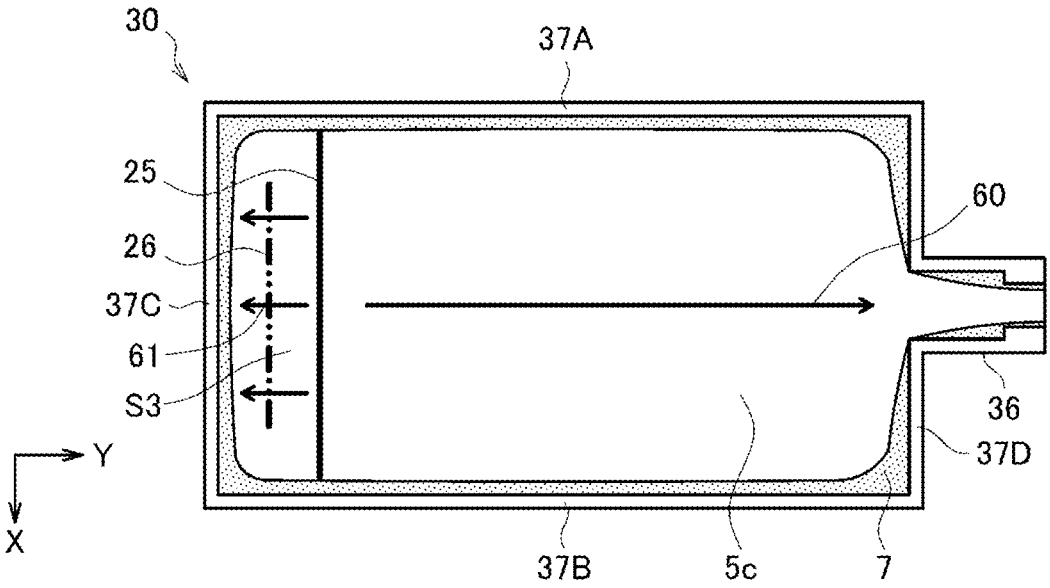
FIG. 10 is a plan view of a hearth that illustrates an example of a molten metal flow formed by a method for producing a metal ingot according to a modification of the first embodiment of the present invention.

For example, as illustrated in FIG. 10, in some cases the raw material 5 is supplied into the hearth 30 along one rectilinear supply line 26 that is substantially parallel to the side wall 37C that is on one short side of the hearth 30. In this case, it suffices to dispose the irradiation line 25 at a position that is along the supply line 26 and that is closer to the central part in the longitudinal direction (Y direction) of the hearth 30 relative to the supply line 26. If the molten metal flow 61 is formed that flows from the irradiation line 25 toward the side wall 37C on the short side, impurities in the vicinity of the supply line 26 can be trapped by the skull 7 on the inside face of the side wall 37C and thereby removed from the molten metal 5*c*.

Figure 11:
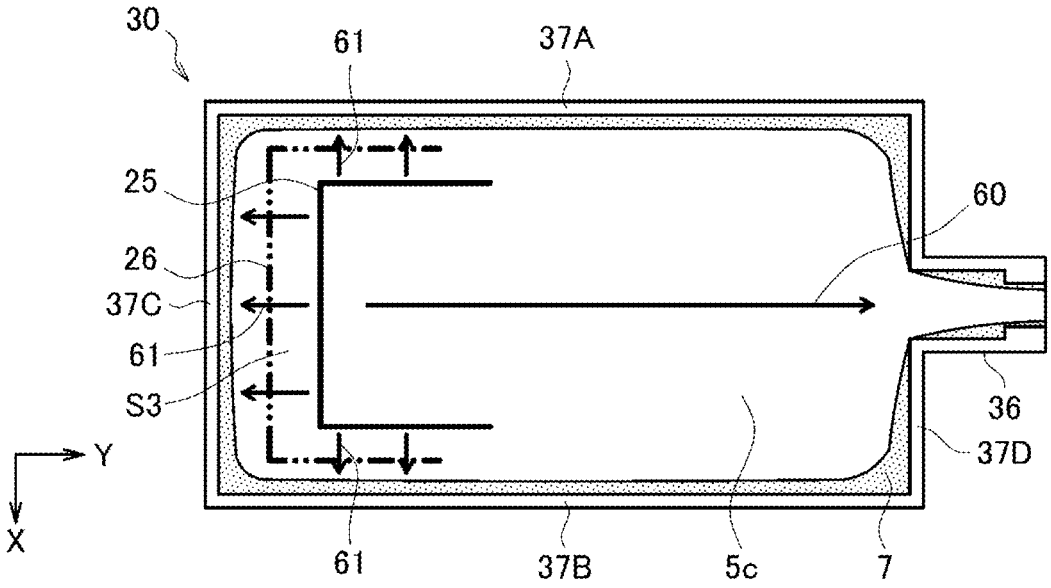
FIG. 11 is a plan view of a hearth that illustrates an example of a molten metal flow formed by a method for producing a metal ingot according to a modification of the first embodiment of the present invention.

Further, as illustrated in FIG. 11, there are also cases where one supply line 26 having an inverted C-shape is disposed along the side walls 37A and 37B on the pair of long sides and one side wall 37C on the short side, and the raw material 5 is supplied to the hearth 30 along the supply line 26. In this case, it suffices to dispose a single irradiation line 25 that has an inverted C-shape along the aforementioned supply line 26, closer to the central part in the longitudinal direction (Y direction) and width direction (X direction) of the hearth 30 relative to the supply line 26. If the molten metal flow 61 is formed that flows from the irradiation line 25 toward the side walls 37A and 37B on the long sides and the side wall 37C on the short side, impurities in the vicinity of the supply line 26 can be trapped by the skull 7 on the inside faces of the side walls 37A, 37B and 37C and thereby removed from the molten metal 5*c*.

Further, although not illustrated in the drawings, for example, there are also cases where side walls of the hearth are a curved shape such as elliptical shape or an oval shape. In such a case, the supply line 26 and the irradiation line 25 that have a curved shape may be disposed along the curved side walls of the hearth.

[1.8. Summary]

A method for producing a metal ingot according to the first embodiment of the present invention has been described above. According to the present embodiment, the irradiation lines 25 are disposed along the supply lines 26 at positions closer to the central part in the width direction of the hearth 30 relative to the supply lines 26, and electron beams are radiated in a concentrated manner along the irradiation lines 25. By this means, as illustrated in FIG. 5, FIG. 8, FIG. 9 and the like, a high temperature region can be formed in the vicinity of each irradiation line 25, and the molten metal flow 61 can be formed that flows from the irradiation line 25 to the corresponding supply line 26. Accordingly, diffusion of impurities such as the LDIs 8 that float on the surface of the molten metal 5*c* in the vicinity of the supply lines 26 can be prevented by the molten metal flow 61. By this means, the impurities can be inhibited from flowing out from the lip portion 36 of the hearth 30 to the mold 40 and mixing into the ingot 50.

In addition, by making $\Delta T/L \geq 0.00$, as illustrated in FIG. 5, if the molten metal flows 61 that flow from the irradiation lines 25 and cross the corresponding supply lines 26 to flow toward the side walls 37A and 37B of the hearth 30 are formed, the aforementioned impurities are caused to flow toward the side walls 37A and 37B of the hearth 30 and can be caused to adhere to the skull 7 on the inside faces of the side walls 37A and 37B. By this means, the impurities can be more reliably inhibited from flowing out from the lip portion 36 of the hearth 30 to the mold 40 and mixing into the ingot 50.

Further, by making $\Delta T/L \geq -2.70$, as illustrated in FIG. 8, the molten metal flows 62 from the supply lines 26 can be suppressed by the molten metal flows 61 from the irradiation lines 25. Therefore, the occurrence of a situation in which impurities such as the LDIs 8 that float on the surface of the molten metal 5*c* in the vicinity of the supply lines 26 ride on the molten metal flow 62 and cross the irradiation lines 25 and flow toward the central part in the width direction of the hearth 30 can be prevented. Hence, since the impurities such as the LDIs 8 can be caused to reside inside the belt-shaped region S3 which has a high temperature and thereby dissolved, the impurities can be appropriately inhibited from flowing out from the lip portion 36.

Further, according to the method for producing a metal ingot of the present embodiment, since it is not necessary to change the shape of an existing hearth 30, the method can be easily implemented and special maintenance is also not required.

In the conventional methods for producing an ingot of a titanium or a titanium alloy, it is common to remove impurities by causing the molten metal to reside for a long time period in the hearth to thereby dissolve LDIs in the molten metal while also causing HDIs to adhere to a skull formed on the bottom face of the hearth. Consequently, conventionally, a long hearth has generally been used to thereby secure the residence time of the molten metal in the hearth. However, according to the present embodiment, since impurities can be appropriately removed even in a case where the residence time of molten metal in the hearth is comparatively short, it is possible to use a short hearth. Accordingly, by using a short hearth in the EB furnace 1, the running cost of the EB furnace 1 can be decreased. In addition, if a short hearth is used, the yield of the ingot 50 can be improved even without reutilizing the skull 7 that remained in the hearth.

2. Second Embodiment

Next, a method for producing a metal ingot according to a second embodiment of the present invention will be described.

[2.1. Outline of Method for Producing Metal Ingot]

Figure 12:
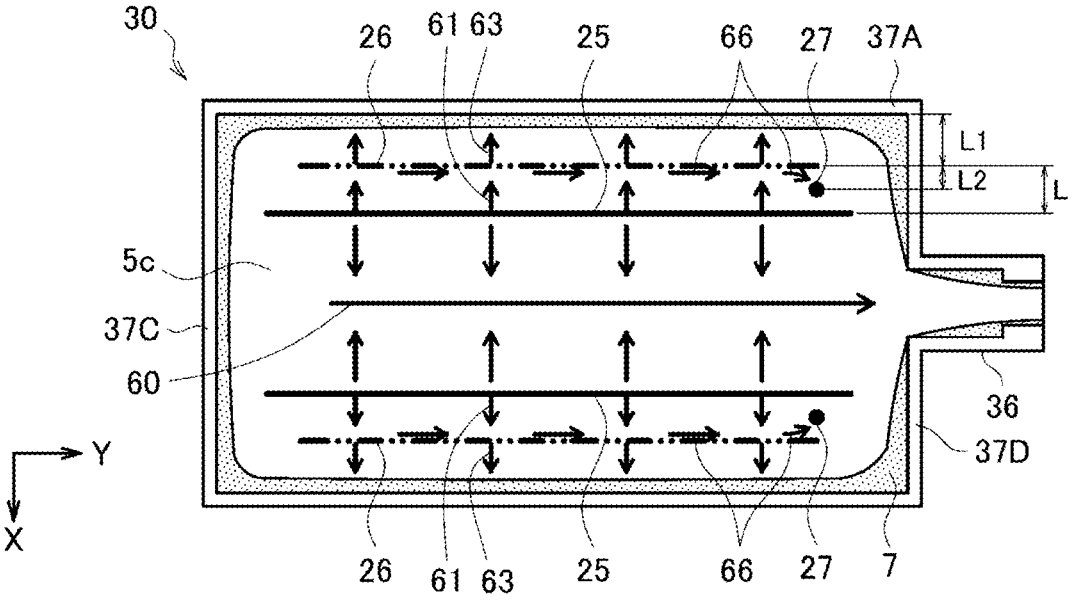
FIG. 12 is a plan view illustrating an example of molten metal flows that are formed by the method for producing a metal ingot according to a second embodiment of the present invention.

First, an outline of the method for producing a metal ingot according to the second embodiment will be described referring to FIG. 12. FIG. 12 is a plan view illustrating an example of molten metal flows that are formed by the method for producing a metal ingot according to the second embodiment.

As illustrated in FIG. 12, a characteristic of the method for producing a metal ingot according to the second embodiment is that, in order to further reduce the outflow amount of impurities from the hearth 30, in addition to radiation (line radiation) of an electron beam along the irradiation lines 25 according to the first embodiment that is described above, an electron beam for dissolving impurities (corresponds to "second electron beam" of the present invention) is radiated in a spot-like manner onto a molten metal flow 66 (corresponds to "second molten metal flow" of the present invention) that flows through the belt-shaped region S3 between the irradiation line 25 and the corresponding supply line 26.

In the second embodiment also, by radiating an electron beam along the aforementioned irradiation lines 25, the high temperature region S2 is formed in the vicinity of each irradiation line 25, and the molten metal flows 61 are formed that flow from each irradiation line 25 toward the corresponding supply line 26. By this means, the flowage of the molten metal 5*c* is controlled between the irradiation lines 25 and the side walls 37 of the hearth 30, and impurities such as the LDIs 8 that float in the vicinity of the supply lines 26 are restricted so as not to flow toward the lip portion 36. In addition, in the second embodiment also, if the molten metal flows 61 are formed from the irradiation lines 25 toward the side walls 37A and 37B, the LDIs 8 that reside in the vicinity of the supply lines 26 can be caused to be trapped by the skull 7 that is formed on the inside faces of the side walls 37 of the hearth 30 and can thus be removed from the molten metal 5*c*.

With regard to this point, in the aforementioned first embodiment, as described with reference to FIG. 5, in a case where the temperature gradient ΔT/L between the irradiation line 25 and the supply line 26 is sufficiently large (for example, in a case where ΔT/L≥0.00), the molten metal flows 61 that flow from the irradiation lines 25 toward the supply lines 26 pass by the supply lines 26 and reach the side walls 37A and 37B. By means of these strong molten metal flows 61, the LDIs 8 that float in the vicinity of the supply lines 26 are caused to flow to the inside faces of the side walls 37A and 37B, thereby allowing the skull 7 that is formed on the inside faces to trap the LDIs 8. Thus, impurities such as the LDIs 8 can be appropriately inhibited from flowing out from the lip portion 36.

However, as described with reference to FIG. 8 and FIG. 9, when the temperature gradient ΔT/L is small (for example, in a case where ΔT/L<0.00), the molten metal flows 61 that flow from the irradiation lines 25 toward the supply lines 26 are relatively weak, and therefore it is difficult for the molten metal flows 61 to push back the molten metal flows 62 that flow from the supply lines 26 toward the irradiation lines 25. For this reason, as illustrated in FIG. 8, the molten metal flows 66 that flow in the Y direction toward the lip portion 36 are formed in the belt-shaped regions S3 between the irradiation lines 25 and the supply lines 26. In this case, there is a risk that impurities such as the LDIs 8 that ride on the molten metal flows 66 and flow toward the lip portion 36 will flow out from the lip portion 36 into the mold 40.

Therefore, in the second embodiment, as illustrated in FIG. 12, an electron beam is radiated in a concentrated manner onto irradiation spots 27 that are disposed in the belt-shaped regions S3 between the irradiation lines 25 and the supply lines 26 (spot radiation). By this means, an electron beam is radiated in a spot-like manner onto the molten metal flows 66 that flow through the belt-shaped regions S3 toward the lip portion 36. Accordingly, the surface temperature of the molten metal 5*c* is locally increased at the positions of the irradiation spots 27, and impurities such as the LDIs 8 that are contained in the molten metal flows 66 can be dissolved in the molten metal 5*c* and thereby removed. Hence, the impurities such as the LDIs 8 can be more reliably prevented from flowing out from the lip portion 36 into the mold 40.

[2.2. Spot Irradiation Temperature]

The LDIs 8 are composed of titanium nitride and the like, and the melting point of titanium nitride is higher than the melting point of commercially pure titanium. Therefore, in a case where the molten metal surface temperature T0 is comparatively low, even if titanium that is the principal component of the molten metal 5*c* melts, titanium nitride that is a component of the LDIs 8 is liable not to dissolve and to remain as a granular solid. Therefore, at the aforementioned irradiation spots 27, an electron beam is radiated in a concentrated manner to increase a surface temperature T3 of the molten metal 5*c* at the relevant irradiation spot 27 (hereunder, referred to as "spot irradiation temperature T3") by a large margin relative to the molten metal surface temperature T0. By this means, the spot irradiation temperature T3, for example, can be made higher than the melting point of titanium nitride, and thus the titanium nitride can be dissolved in the molten metal 5*c* to cause the nitrogen to diffuse and thereby change the titanium nitride to titanium. Accordingly, the LDIs 8 that are contained in the molten metal flows 66 that pass through the irradiation spots 27 can be reliably dissolved into the molten metal 5*c* and thereby removed. Note that, the melting point of titanium nitride varies depending on the nitrogen concentration. For example, in a case where the nitrogen concentration is in a range of 1.23 to 4% by mass, the melting point of the titanium nitride is 2300 K.

In this case, the spot irradiation temperature T3 is, for example, in the range of 2300 K to 3500 K, and preferably in the range of 2400 K to 2700 K. Preferably, the spot irradiation temperature T3 is higher than the aforementioned raw material supplying temperature T1 and line irradiation temperature T2 (T3>T1, and T3>T2). By this means, even in a case where the LDIs 8 are not dissolved and remain in a solid state when the raw material 5 is melted at the raw material supplying portion 10 (raw material supplying temperature T1) and when line radiation is performed (line irradiation temperature T2), since the LDIs 8 can be heated at the spot irradiation temperature T3 that is a higher temperature, the LDIs 8 can be more reliably dissolved.

[2.3. Position of Irradiation Spot]

First, the position in the Y direction of the respective irradiation spots 27 will be described. As illustrated in FIG. 12, within the belt-shaped region S3 between the irradiation line 25 and the supply line 26, the irradiation spot 27 is preferably disposed at an end portion on the lip portion 36 side or in the vicinity of the end portion. The molten metal flow 66 that flows through the belt-shaped region S3 toward the lip portion 36 flows out to the outside of the belt-shaped region S3 from the end portion on the lip portion 36 side of the belt-shaped region S3. Therefore, the LDIs 8 contained in the molten metal flow 66 that flows through the belt-shaped region S3 pass through the end portion on the lip portion 36 side of the belt-shaped region S3. Therefore, it is preferable to dispose the irradiation spot 27 at the end portion on the lip portion 36 side of the belt-shaped region S3, and to radiate an electron beam in a concentrated manner on the irradiation spot 27. By this means, all or most of the LDIs 8 that ride on the molten metal flow 66 which flows through the belt-shaped region S3 toward the lip portion 36 can be more reliably dissolved and removed at the position of the irradiation spot 27.

Next, the position in the X direction of the respective irradiation spots 27 will be described. The irradiation spot 27 is disposed between the irradiation line 25 and the supply line 26. A distance L2 between the irradiation spot 27 and the supply line 26 is appropriately set in accordance with the raw material supplying temperature T1, the line irradiation temperature T2, and the radiation conditions for line radiation and spot radiation and the like, and the distance L2 is preferably around half of the distance L between the irradiation line 25 and the supply line 26. By this means, since the irradiation spot 27 can be appropriately disposed at a position of the molten metal flow 66 that flows through the belt-shaped region S3 between the irradiation line 25 and the supply line 26, the LDIs 8 contained in the molten metal flow 66 can be efficiently dissolved and removed.

Note that, in the example illustrated in FIG. 12, in each of the belt-shaped regions S3, only one irradiation spot 27 is disposed at the end portion on the lip portion 36 side, and an electron beam is spot-radiated onto the molten metal flow 66 at one place. However, the present invention is not limited to this example, and an electron beam may be spot-radiated at arbitrary positions which impurities such as the LDIs 8 pass through on the surface of the molten metal 5*c*. For example, a plurality of irradiation spots 27 may be disposed at positions that are separated from each other in the belt-shaped region S3, and an electron beam may be spot-radiated onto the molten metal flow 66 at a plurality of places. Further, as long as the position in question is a position at which spot radiation can be performed with respect to the molten metal flow 66 inside the belt-shaped region S3, an electron beam may be spot-radiated at an any position inside the belt-shaped region S3 (for example, at a central part in the Y direction, or at a position on the upstream side or downstream side in the Y direction of the central part). In addition, an electron beam may also be spot-radiated onto a molten metal flow that flows toward the lip portion 36 outside of the belt-shaped region S3, and not just inside the belt-shaped region S3, and an electron beam may also be spot-radiated at a place that is located around the lip portion 36.

[2.4. Settings of Electron Beam for Spot Radiation]

In the second embodiment, as described above, a flow path of the LDIs 8 (the molten metal flow 66) is formed in the belt-shaped region S3 between the irradiation line 25 and the corresponding supply line 26, the irradiation spot 27 is disposed so as to cut off the flow path, and an electron beam is radiated in a concentrated manner onto the irradiation spot 27. By maintaining the spot irradiation temperature T3 at the irradiation spot 27 at a high temperature in this way, the LDIs 8 in the molten metal flow 66 that flows toward the lip portion 36 can be more reliably dissolved. In a case where the molten metal 5*c* is molten titanium, if the spot irradiation temperature T3 that is measured with a radiation thermometer is maintained at, for example, 2400 K or higher, the LDIs 8 contained in the molten titanium can be reliably dissolved.

Note that, as long as the spot irradiation temperature T3 can be maintained within a predetermined temperature range, the electron beam for spot radiation that dissolves impurities such as the LDIs 8 may be radiated continuously or may be radiated intermittently at the irradiation spot 27. Further, radiation conditions such as the heat transfer amount, scanning speed and heat flux distribution of the electron beam for spot radiation are constrained by the specifications of the equipment that radiates the electron beam. Accordingly, when setting the radiation conditions of the electron beam it is preferable to make the heat transfer amount of the electron beam as large as possible, the scanning speed as fast as possible, and the heat flux distribution as narrow as possible (make the aperture of the electron beam as small as possible) within the range of the equipment specifications.

Further, radiation of an electron beam at the irradiation spots 27 may be performed using a single electron gun or may be performed using a plurality of electron guns. In addition, preferably the aforementioned electron gun 20E for line radiation (see FIG. 3) also serves as an electron gun for spot radiation. By this means, the number of electron guns installed in the EB furnace 1 can be decreased and the equipment cost can be reduced, and the electron guns that are already installed can be effectively utilized. However, the present invention is not limited to this example, and as the electron gun for spot radiation, an electron gun for exclusive use for spot radiation (not illustrated) may be used, or alternatively, an electron gun for other purposes such as the electron gun 20A or 20B for melting raw material or the electron gun 20C or 20D for maintaining the temperature of the molten metal (see FIG. 3) may be used for spot radiation also.

[2.5. Modification]

Next, a modification of the foregoing second embodiment will be described. In the foregoing, an example was described in which, as illustrated in FIG. 12, two belt-shaped regions S3, S3 are disposed substantially parallel to the side walls 37A and 37B in the longitudinal direction (Y direction) of the hearth 30. However, the present invention is not limited to the foregoing example. The belt-shaped region S3 may be disposed along any one or more of the side walls 37A, 37B and 37C (second side walls) other than the side wall 37D (first side wall) in which the lip portion 36 is provided, and the number, direction and shape and the like of the belt-shaped regions S3 that are provided is not limited to the example in the aforementioned FIG. 12.

Figure 13:
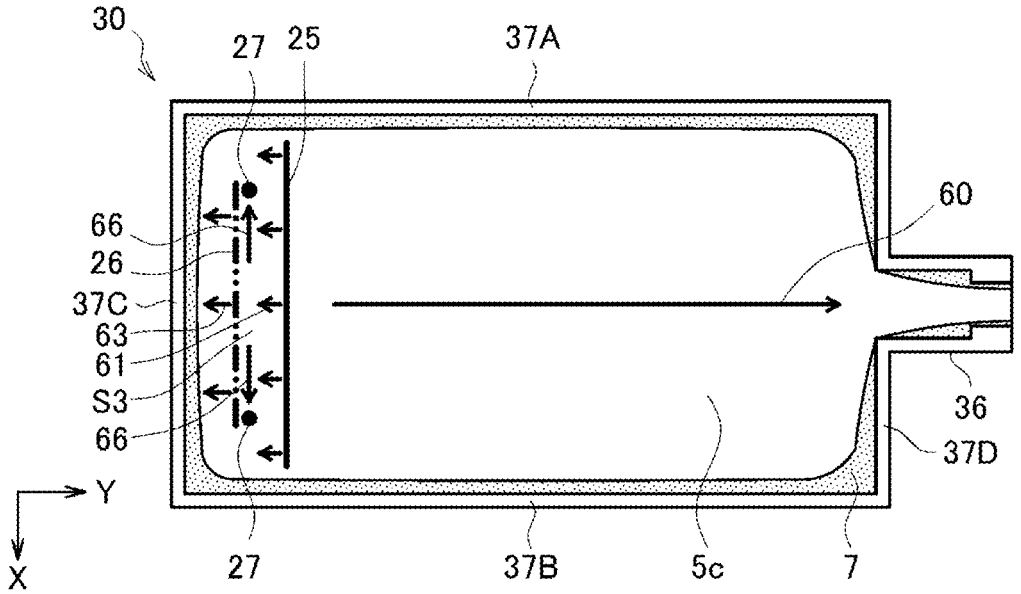
FIG. 13 is a plan view of a hearth that illustrates an example of a molten metal flow formed by a method for producing a metal ingot according to a modification of the second embodiment of the present invention.

For example, as illustrated in FIG. 13, a single supply line 26 having a straight-line shape and a single irradiation line 25 may be disposed substantially parallel to the side wall 37C on one of the short sides of the hearth 30, and the belt-shaped region S3 that is substantially parallel to the side wall 37C on the short side may be disposed between the supply line 26 and the irradiation line 25. In this case, it suffices to dispose two irradiation spots 27, 27 at the two end portions in the X direction of the belt-shaped region S3, and to radiate electron beams in a concentrated manner at the positions of the two irradiation spots 27, 27 onto the molten metal flows 66, 66 that flow through the inside of the belt-shaped region S3 in the X direction. By this means, since the LDIs 8 contained in the molten metal flows 66, 66 can be dissolved, the LDIs 8 can be prevented from bypassing the two ends in the X direction of the irradiation line 25 and flowing toward the lip portion 36.

Figure 14:
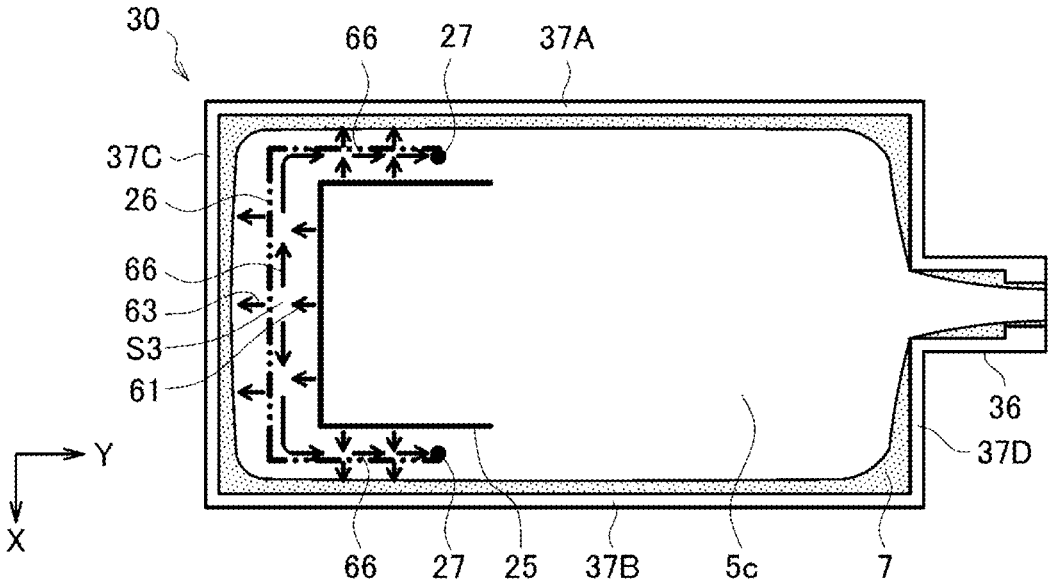
FIG. 14 is a plan view of a hearth that illustrates an example of a molten metal flow formed by a method for producing a metal ingot according to a modification of the second embodiment of the present invention.

Further, as illustrated in FIG. 14, a supply line 26 and the irradiation line 25 that each have an inverted C-shape may be disposed along the side walls 37A and 37B on the pair of long sides and the side wall 37C that is on one of the short sides, and the belt-shaped region S3 that has an inverted C-shape may be disposed between the supply line 26 and the irradiation line 25. In this case, it suffices to dispose two irradiation spots 27, 27 at the two end portions on the lip portion 36 side of the belt-shaped region S3 that has an inverted C-shape, and to radiate electron beams in a concentrated manner at the positions of the two irradiation spots 27, 27 onto the molten metal flows 66, 66 that flow through the inside of the belt-shaped region S3 toward the lip portion 36. By this means, since the LDIs 8 contained in the molten metal flows 66, 66 can be dissolved, the LDIs 8 can be prevented from passing through the two end portions of the belt-shaped region S3 that has an inverted C-shape and flowing toward the lip portion 36.

[2.6. Summary]

The method for producing a metal ingot according to the second embodiment of the present invention has been described above. According to the second embodiment, the following effects are obtained in addition to the aforementioned effects of the first embodiment.

According to the second embodiment, when the molten metal flow 66 that flows toward the lip portion 36 is formed in the belt-shaped region S3 between the irradiation line 25 and the supply line 26, an electron beam for dissolving impurities is radiated in a concentrated manner onto the molten metal flow 66 at an irradiation spot 27 that is disposed at one end portion or both ends on the belt-shaped region S3. By this means, before impurities such as the LDIs 8 that are contained in the molten metal flow 66 arrive at the lip portion 36 from the belt-shaped region S3, the impurities can be dissolved at the high-temperature irradiation spot 27 and thereby removed from the molten metal. Hence, impurities such as the LDIs 8 can be more reliably inhibited from flowing out from the lip portion 36 to the mold 40.

In the foregoing first embodiment, in a case where the line irradiation temperature T2 is lower than the raw material supplying temperature T1 or a case where the temperature gradient ΔT/L between the supply line 26 and the irradiation line 25 is less than 0.00 due to the equipment specifications or other constraints, there is a possibility that a molten metal flow 66 that flows toward the lip portion 36 will be formed in the belt-shaped region S3, and that impurities which ride on the molten metal flow 66 will flow out to the lip portion 36. Even in such a case, in the method for producing a metal ingot according to the second embodiment, impurities can be more reliably inhibited from flowing out to the lip portion 36, and hence the method for producing a metal ingot according to the second embodiment is particularly useful.

3. Third Embodiment

Next, a method for producing a metal ingot according to a third embodiment of the present invention will be described.

[3.1. Outline of Method for Producing a Metal Ingot]

Figure 15:
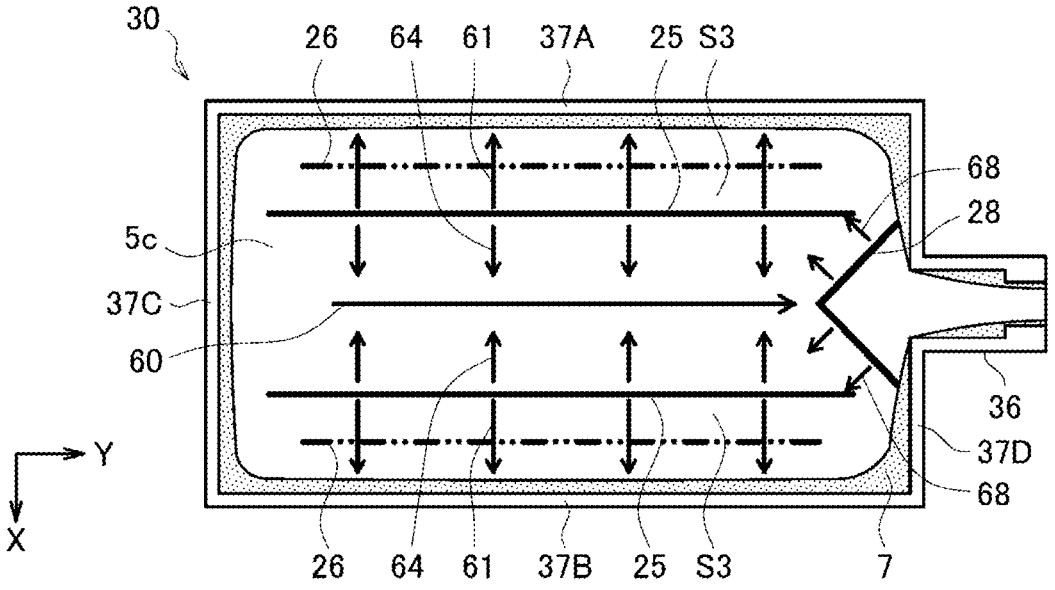
FIG. 15 is a plan view illustrating an example of molten metal flows that are formed by the method for producing a metal ingot according to a third embodiment of the present invention.

First, an outline of the method for producing a metal ingot according to the third embodiment will be described referring to FIG. 15. FIG. 15 is a plan view illustrating an example of molten metal flows that are formed by the method for producing a metal ingot according to the third embodiment.

As illustrated in FIG. 15, a characteristic of the method for producing a metal ingot according to the third embodiment is that, in order to further reduce the outflow amount of impurities from the hearth 30, in addition to radiation (line radiation) of an electron beam along the irradiation lines 25 (correspond to "first irradiation line" of the present invention) according to the first embodiment that is described above, an electron beam (corresponds to "third electron beam" of the present invention) is radiated along an irradiation line 28 (corresponds to "second irradiation line" of the present invention) that is disposed so as to block the lip portion 36.

In the third embodiment also, by radiating an electron beam along the aforementioned irradiation lines 25, the high temperature region S2 is formed in the vicinity of each irradiation line 25, and the molten metal flows 61 are formed that flow from each irradiation line 25 toward the corresponding supply line 26. By this means, the flowage of the molten metal 5*c* is controlled between the irradiation lines 25 and the side walls 37 of the hearth 30, and impurities such as the LDIs 8 that float in the vicinity of the supply lines 26 are restricted so as not to flow toward the lip portion 36. In addition, in the third embodiment also, if the molten metal flows 61 can be formed from the irradiation lines 25 toward the side walls 37A and 37B, the LDIs 8 that reside in the vicinity of the supply lines 26 can be caused to be trapped by the skull 7 that is formed on the inside faces of the side walls 37 of the hearth 30 and can thus be removed from the molten metal.

However, as described with reference to FIG. 8 and FIG. 9, when the temperature gradient ΔT/L is small (for example, in a case where ΔT/L<0.00, particularly in a case where ΔT/L<−2.70), the molten metal flows 61 that flow from the irradiation lines 25 toward the supply lines 26 are relatively weak, and therefore the molten metal flows 61 cannot push back the molten metal flows 62 that flow from the supply lines 26 toward the irradiation lines 25. For this reason, in some cases the molten metal flows 66 that flow in the Y direction toward the lip portion 36 are formed in the belt-shaped regions S3 between the irradiation lines 25 and the supply lines 26 (see FIG. 8), and the molten metal flows 67 from the supply lines 26 cross the irradiation lines 25 and flow toward the central part of the hearth 30 (see FIG. 9). In this case, there is a risk that the LDIs 8 that ride on the molten metal flows 66 or the molten metal flows 67 and the molten metal flow 60 will flow toward the lip portion 36 and will flow out from the lip portion 36 into the mold 40.

Therefore, in the third embodiment, as illustrated in FIG. 15, the irradiation line 28 is disposed so as to block the lip portion 36 on the surface of the molten metal 5*c* in the hearth 30, and an electron beam is radiated in a concentrated manner along the irradiation line 28 (second line radiation). By this means, the surface temperature of the molten metal 5*c* is locally increased along the irradiation line 28, and a high temperature region is formed in the vicinity of the irradiation line 28. As a result, a molten metal flow 68 that flows in the opposite direction to the lip portion 36 from the vicinity of the irradiation line 28 is formed in the outer layer of the molten metal 5*c* in the area around the lip portion 36. By means of the molten metal flow 68, the molten metal flows 66 or the molten metal flow 60 that contain impurities such as the LDIs 8 are prevented from flowing into the lip portion 36 and can be pushed back. Since the molten metal 5*c* that is pushed back will reside for a long period inside the hearth 30, nitrogen contained in the impurities such as the LDIs 8 contained in the molten metal 5*c* in question diffuses into the molten metal 5*c* with the passage of time and is dissolved, thereby removing the impurities from the molten metal 5*c*.

Hence, in the third embodiment, in comparison to the aforementioned first embodiment, impurities such as the LDIs 8 can be even more reliably prevented from flowing out from the lip portion 36 into the mold 40.

[3.2. Position of Radiation Line and Line Irradiation Temperature]

The irradiation line 28 is an imaginary line that represents the path of positions at which an electron beam is radiated in a concentrated manner onto the surface of the molten metal 5*c* in the hearth 30. The irradiation line 28 is disposed on the surface of the molten metal 5*c* so as to surround the lip portion 36. The two ends of the irradiation line 28 are positioned in the vicinity of the inside face of the side wall 37D (first side wall) of the hearth 30. As used here, the term "vicinity" means that a distance between the two ends of the irradiation line 28 and the inside face of the side wall 37 is within a range of not more than 5 mm. By disposing both ends of the irradiation line 28 in the vicinity of the side wall 37D, the occurrence of a situation in which impurities pass through gaps between the two ends of the irradiation line 28 and the side wall 37D and flow toward the lip portion 36 can be appropriately inhibited.

Note that, although the irradiation line 28 in the example illustrated in FIG. 15 is a V-shaped line, as long as the irradiation line 28 is a linear shape that is disposed so as to surround the lip portion 36, the irradiation line 28 may be, for example, an arc shape, an elliptical shape, another curved shape, an inverted C-shape, a U-shape, a wavy line shape, a zigzag shape, a double line shape, a belt shape or the like.

By radiating an electron beam in a concentrated manner along the aforementioned irradiation line 28, a high temperature region having a surface temperature T4 that is higher than the aforementioned molten metal surface temperature T0 is formed in the vicinity of the irradiation line 28 on the surface of the molten metal 5*c*. Preferably, the surface temperature T4 (hereunder, referred to as "second line irradiation temperature T4") of the molten metal 5*c* at the irradiation line 28 is higher than the aforementioned molten metal surface temperature T0 (T4>T0), and is higher than the aforementioned raw material supplying temperature T1 (T4>T1>T0). The second line irradiation temperature T4 is, for example, within a range of 1923 K to 2473 K, and preferably is within a range of 1973 K to 2423 K.

[3.3. Settings of Electron Beam for Second Line Radiation]

In the third embodiment, as illustrated in FIG. 15, by radiating an electron beam in a concentrated manner along the irradiation line 28 that surrounds the lip portion 36, the molten metal flow 68 is formed that flows from the irradiation line 28 toward the opposite side to the lip portion 36. The area around the lip portion 36 is guarded by the molten metal flow 68 so that a molten metal flow containing impurities such as the LDIs 8 does not flow into the lip portion 36. As long as the second line irradiation temperature T4 can be maintained within a predetermined range, the electron beam for second line radiation may be radiated continuously or may be radiated intermittently along the irradiation line 28. Further, radiation conditions such as the heat transfer amount, scanning speed and heat flux distribution of the electron beam for second line radiation are constrained by the specifications of the equipment that radiates the electron beam. Accordingly, when setting the radiation conditions of the electron beam it is preferable to make the heat transfer amount of the electron beam as large as possible, the scanning speed as fast as possible, and the heat flux distribution as narrow as possible (make the aperture of the electron beam as small as possible) within the range of the equipment specifications.

Further, radiation of an electron beam along the irradiation line 28 (second line radiation) may be performed using a single electron gun or may be performed using a plurality of electron guns. In addition, preferably the aforementioned electron gun 20E for line radiation (see FIG. 3) also serves as an electron gun for second line radiation. By this means, the number of electron guns installed in the EB furnace 1 can be decreased and the equipment cost can be reduced, and the electron guns that are already installed can be effectively utilized. However, the present invention is not limited to this example, and as the electron gun for second line radiation, the aforementioned electron gun for spot radiation (not illustrated in the drawings) may be used, or alternatively, an electron gun for other purposes such as the electron gun 20A or 20B for melting raw material or the electron gun 20C or 20D for maintaining the temperature of the molten metal (see FIG. 3) may be used for second line radiation also.

[3.4. Modification]

Figure 16:
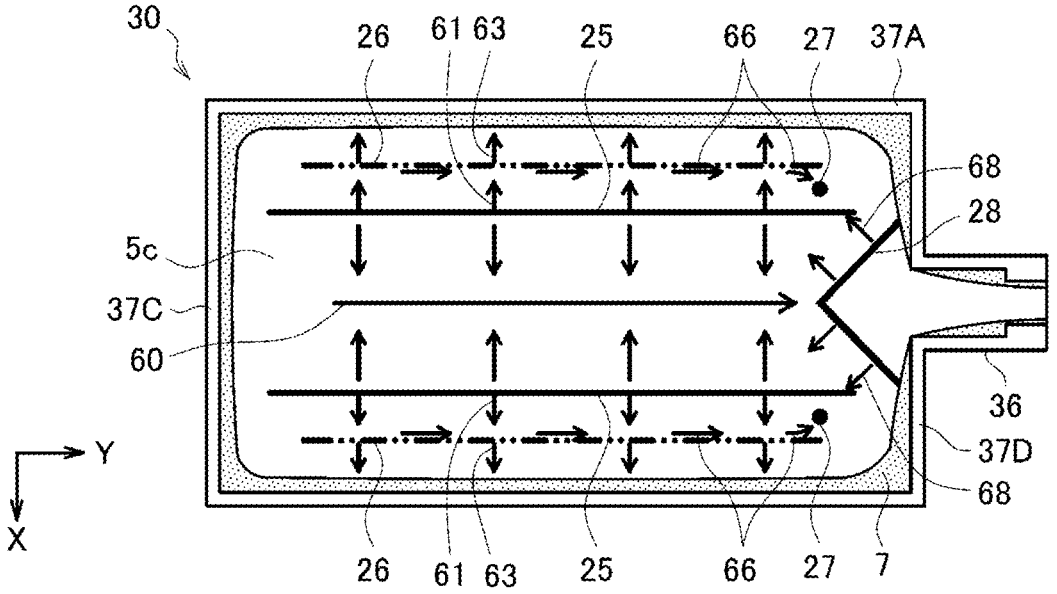
FIG. 16 is a plan view of a hearth that illustrates an example of a molten metal flow formed by a method for producing a metal ingot according to a modification of the third embodiment of the present invention.

Next, a modification of the aforementioned third embodiment will be described referring to FIG. 16. FIG. 16 is a plan view illustrating an example of molten metal flows formed by a method for producing a metal ingot according to a modification of the third embodiment.

The method for producing a metal ingot according to this modification is an example in which spot radiation according to the aforementioned second embodiment (see FIG. 12 and the like) is further applied to the method for producing a metal ingot according to the third embodiment illustrated in FIG. 15. As illustrated in FIG. 16, according to this modification, line radiation with respect to the irradiation line 25 (first embodiment), spot radiation with respect to the irradiation spot 27 (second embodiment), and second line radiation with respect to the irradiation line 28 (third embodiment) are combined. In this case, the disposition of each of the irradiation line 25, the irradiation spot 27 and the irradiation line 28 is adjusted so that the irradiation line 25, the irradiation spot 27 and the irradiation line 28 do not interfere with each other.

By combining the irradiation line 25, the irradiation spot 27 and the irradiation line 28 in this manner, even if impurities such as the LDIs 8 are not completely removed by the line radiation according to the first embodiment and the spot radiation according to the second embodiment, and some impurities ride on a molten metal flow and flow toward the lip portion 36, ultimately the impurities in question can be prevented from flowing into the lip portion 36 at the irradiation line 28 that is in the vicinity of the lip portion 36. Hence, impurities can be even more reliably prevented from flowing out from the lip portion 36 to the mold 40.

EXAMPLES

Next, examples of the present invention will be described. The following examples are merely concrete examples for verifying the effects of the present invention, and the present invention is not limited to the following examples.

(1) Examples of Line Radiation

First, referring to Table 1 and FIG. 18 to FIG. 26, examples will be described in which simulations were performed to verify an LDI removal effect obtained by line radiation according to the first embodiment of the present invention that is described above.

With respect to the present examples, a molten metal flow inside the hearth 30 was simulated for a case where a titanium alloy, for example, was used as the raw material 5, and an electron beam was radiated along the irradiation line 25 with respect to the molten metal 5*c* of the titanium alloy that was accumulated inside the short hearth illustrated in FIG. 3. The temperature distribution of the molten metal 5*c* in the hearth 30, the behavior of LDIs, and the amount of the outflow of LDIs from the hearth 30 were ascertained.

The simulation conditions and evaluation results of the present examples are shown in Table 1.

TABLE 1

Simulation Conditions and Evaluation Results of Examples of Line Radiation

Figure 19:
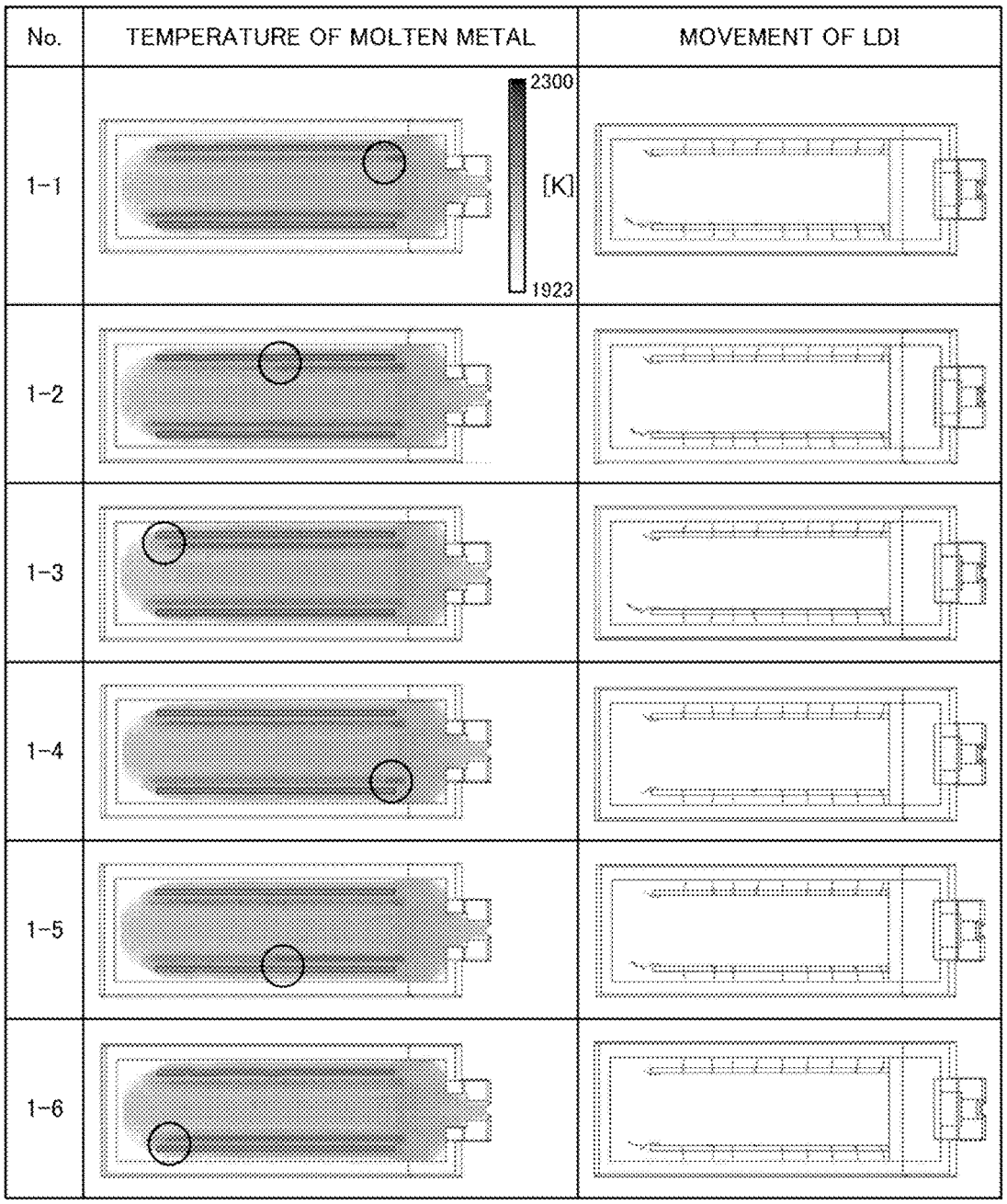
FIG. 19 is an explanatory drawing illustrating a simulation result according to Example 1.
Figure 20:
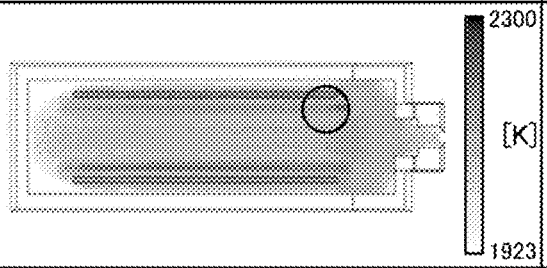
FIG. 20 is an explanatory drawing illustrating a simulation result according to Example 2.
Figure 20:
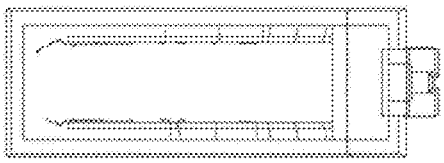
Figure 20:
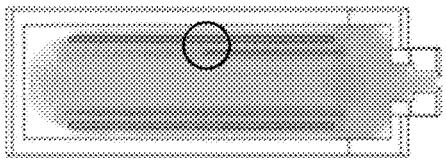
Figure 20:
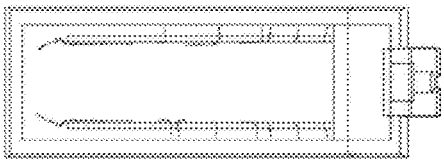
Figure 20:
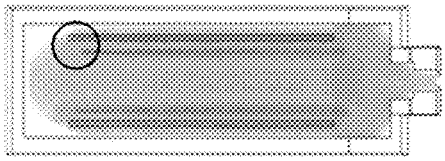
Figure 20:
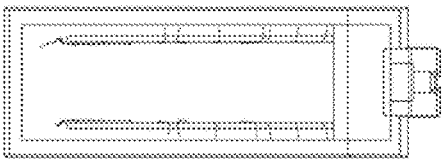
Figure 20:
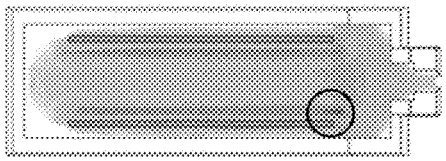
Figure 20:
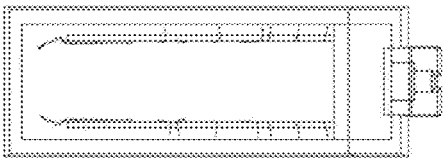
Figure 20:
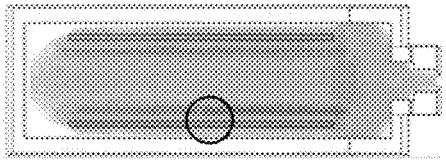
Figure 20:
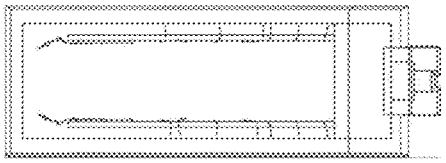
Figure 20:
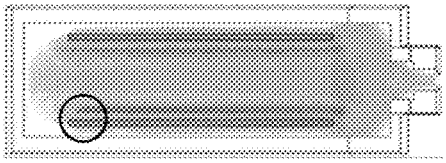
Figure 20:
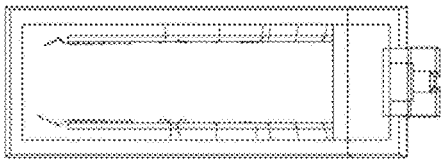
Figure 21:
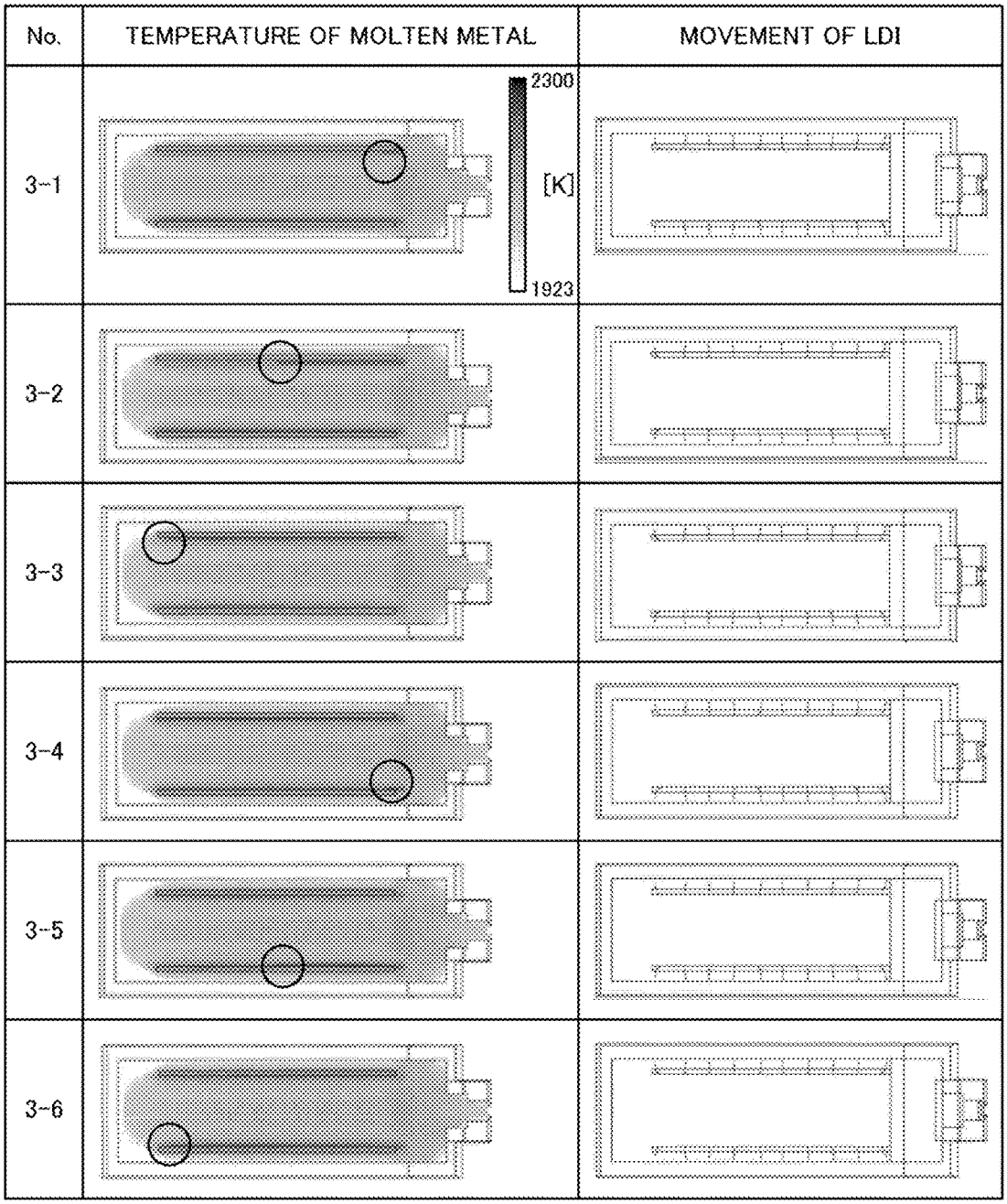
FIG. 21 is an explanatory drawing illustrating a simulation result according to Example 3.
Figure 22:
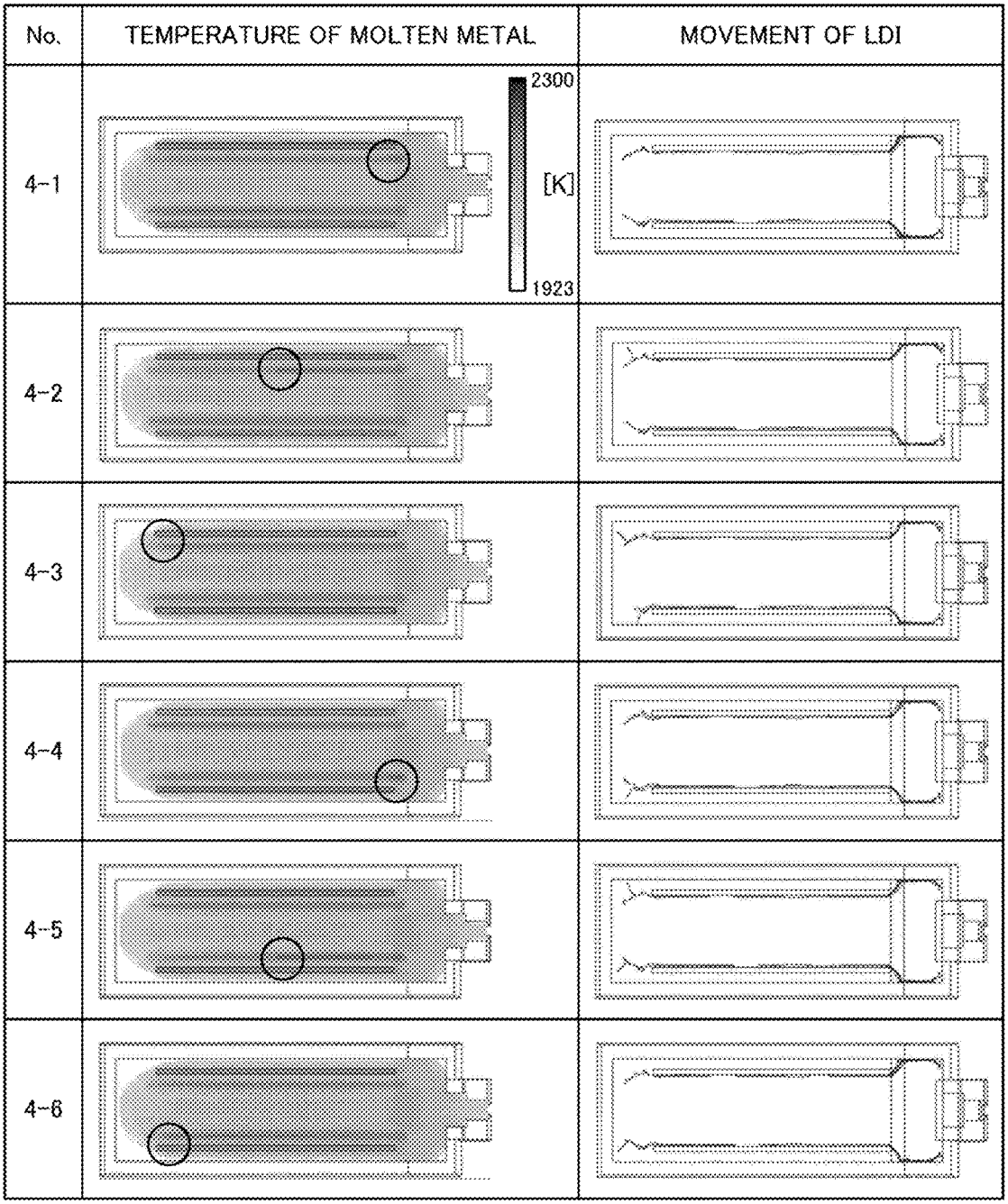
FIG. 22 is an explanatory drawing illustrating a simulation result according to Example 4.

| NO. | FIG. | Line Radiation | Spot Radiation | Molten Metal Surface Temperature T0 [K] | Raw Material Supplying Temperature T1 [K] | Line Irradiation Temperature T2 [K] | Spot Irradiation Temperature T3 [K] |
|---|---|---|---|---|---|---|---|
| Example 1 | FIG. 19 | present | absent | 2093 | 2173 | 2177 | — |
| Example 2 | FIG. 20 | present | absent | 2093 | 2173 | 2174 | — |
| Example 3 | FIG. 21 | present | absent | 2087 | 2173 | 2197 | — |
| Example 4 | FIG. 22 | present | absent | 2096 | 2173 | 2170 | — |

TABLE 1-continued

Simulation Conditions and Evaluation Results of Examples of Line Radiation

Figure 23:
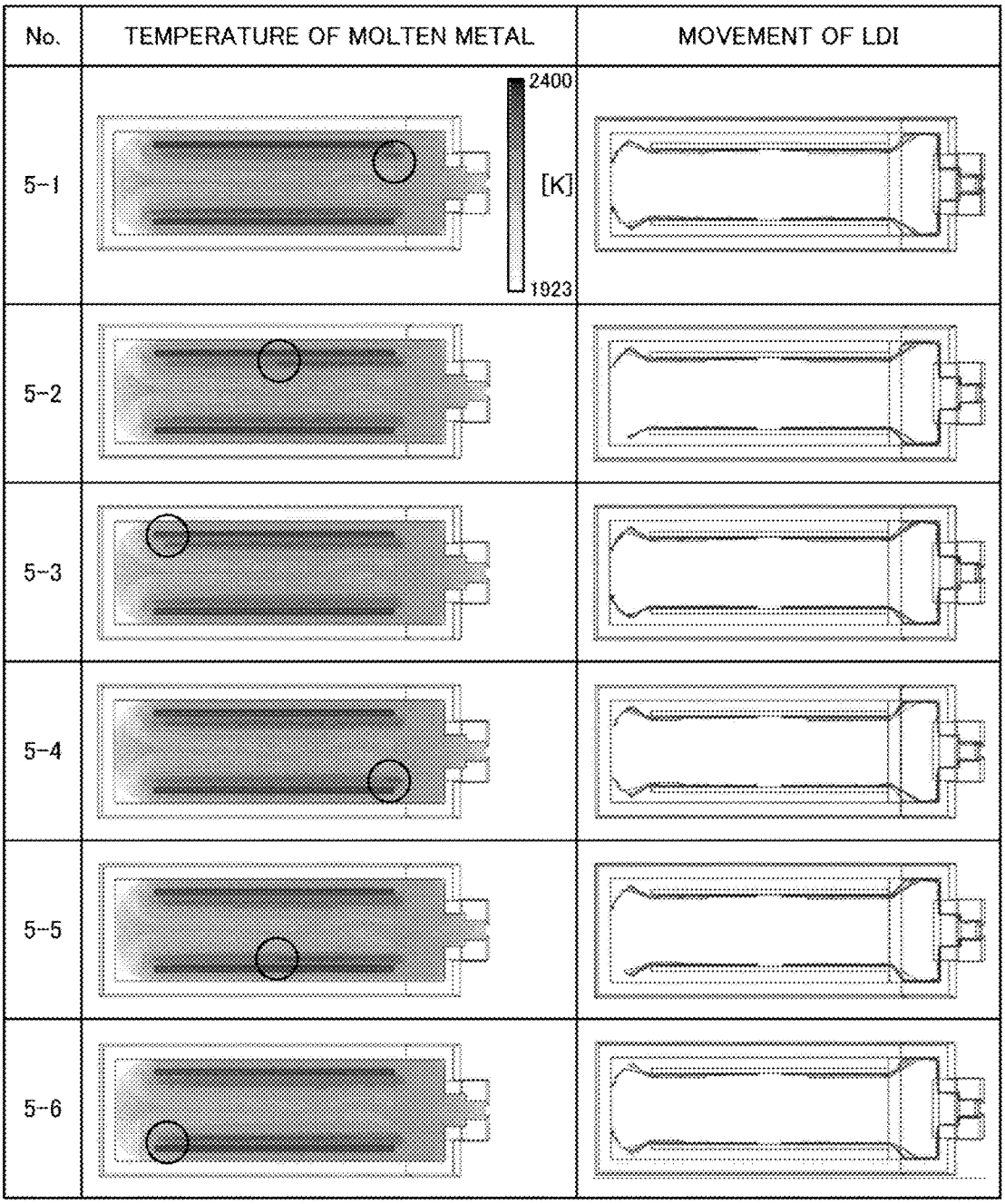
FIG. 23 is an explanatory drawing illustrating a simulation result according to Example 5.
Figure 24:
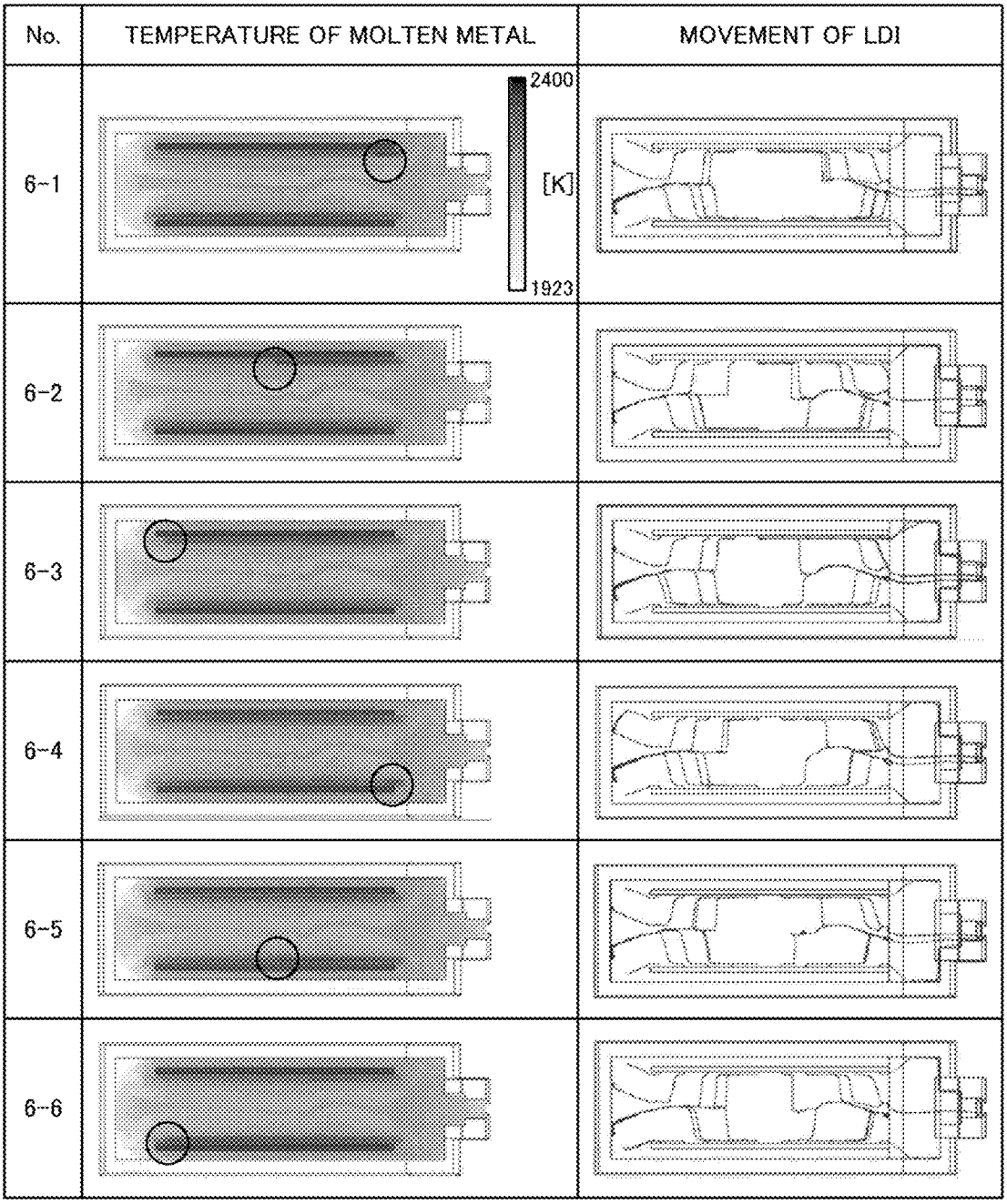
FIG. 24 is an explanatory drawing illustrating a simulation result according to Example 6.
Figure 25:
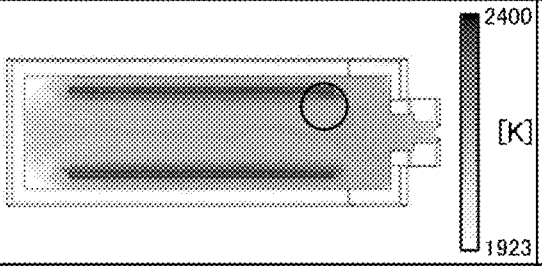
FIG. 25 is an explanatory drawing illustrating a simulation result according to Example 7.
Figure 25:
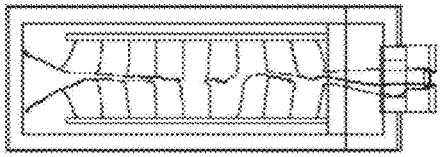
Figure 25:
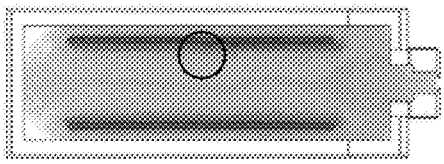
Figure 25:
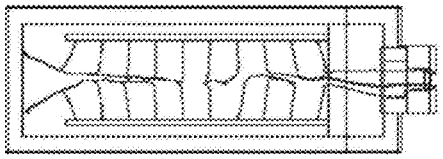
Figure 25:
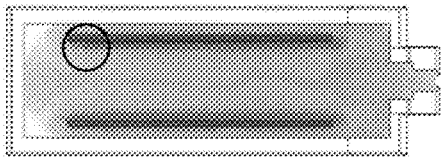
Figure 25:
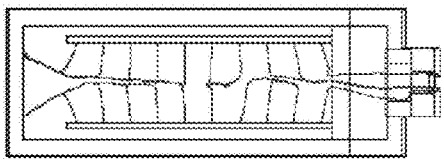
Figure 25:
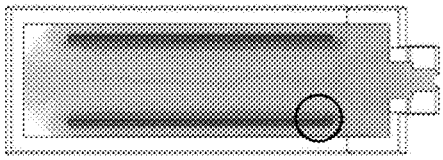
Figure 25:
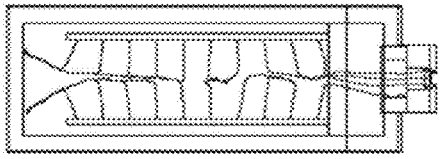
Figure 25:
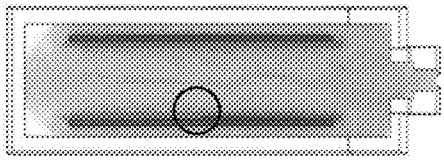
Figure 25:
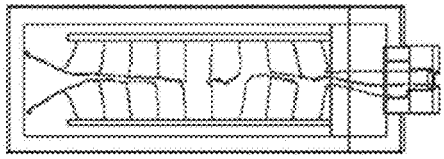
Figure 25:
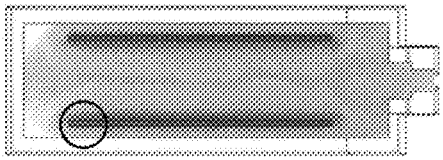
Figure 25:
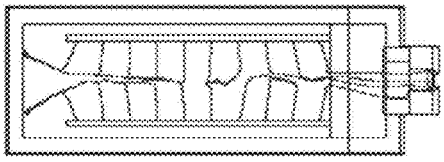
Figure 26:
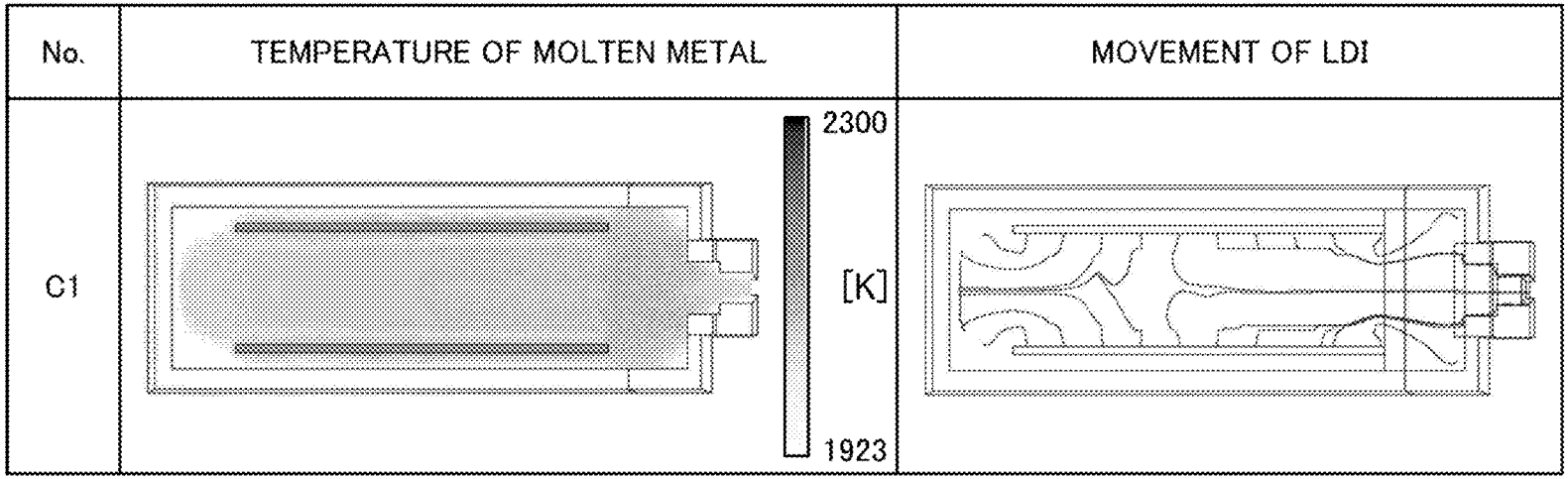
FIG. 26 is an explanatory drawing illustrating a simulation result according to Comparative Example 1.

| | | | | | | | |
|---|---|---|---|---|---|---|---|
| Example 5 | FIG. 23 | present | absent | 2166 | 2373 | 2298 | — |
| Example 6 | FIG. 24 | present | absent | 2165 | 2373 | 2300 | — |
| Example 7 | FIG. 25 | present | absent | 2157 | 2373 | 2300 | — |
| Comparative Example 1 | FIG. 26 | absent | absent | 2065 | 2173 | — | — |

| NO. | Temperature Difference ΔT (=T2 − T1) [K] | Output Q2 of Electron Beam for Line Radiation [MW] | Output Q3 of Electron Beam for Spot Radiation [MW] | Distance L between Irradiation Line and Introduction Line [mm] | Temperature Gradient ΔT/L [K/mm] | Evaluation of LDI Removal Effect |
|---|---|---|---|---|---|---|
| Example 1 | 4 | 0.4 | — | 30 | 0.13 | A |
| Example 2 | 1 | 0.4 | — | 35 | 0.03 | A |
| Example 3 | 24 | 0.4 | — | 5 | 4.80 | A |
| Example 4 | −3 | 0.4 | — | 40 | −0.08 | B |
| Example 5 | −75 | 0.4 | — | 30 | −2.50 | B |
| Example 6 | −73 | 0.4 | — | 20 | −3.65 | C |
| Example 7 | −73 | 0.4 | — | 10 | −7.30 | C |
| Comparative Example 1 | — | — | — | — | — | D |

In the simulations of Examples 1 to 7 shown in Table 1, as illustrated in FIG. 4, two supply lines 26, 26 having a straight-line shape were disposed parallel to the side walls 37A and 37B, and two irradiation lines 25, 25 having a straight-line shape were disposed parallel to the supply lines 26. While dripping a molten titanium alloy at the raw material supplying temperature T1 along the supply lines 26, 26, an electron beam for heat retention was radiated onto the heat-retention radiation region 23 of the molten metal 5*c* inside the hearth 30 (heat-retention radiation) to maintain the surface temperature of the molten metal 5*c* at the molten metal surface temperature T0, and an electron beam for line radiation was radiated in a concentrated manner along the irradiation lines 25, 25 (line radiation).

Figure 17:
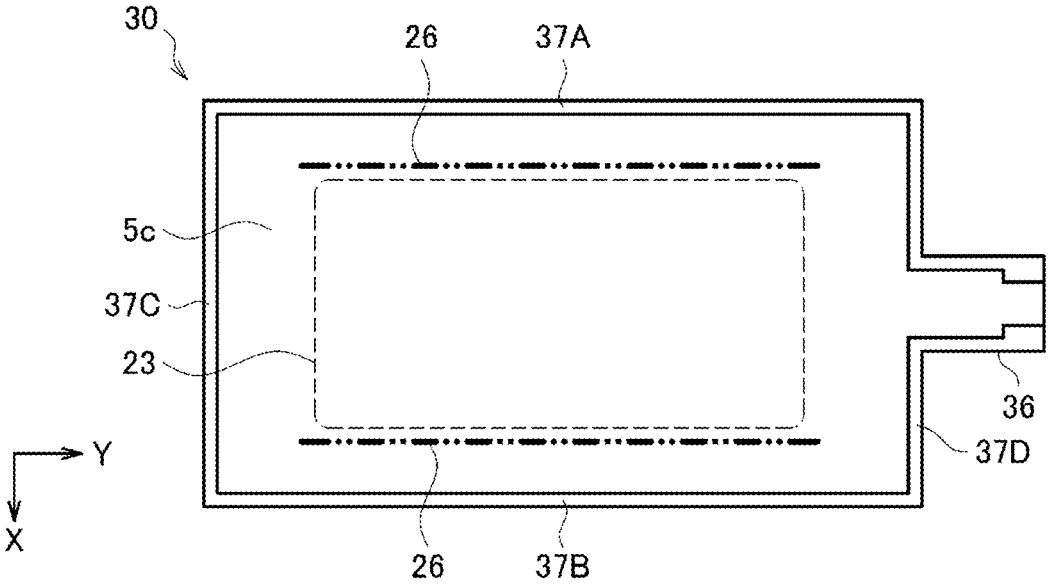
FIG. 17 is a plan view illustrating the state of a hearth according to Comparative Examples 1 and 2.

On the other hand, as Comparative Example 1, as illustrated in FIG. 17, a similar simulation was also performed for a case in which an electron beam for heat retention was radiated onto the heat-retention radiation region 23 of the molten metal 5*c* inside the hearth 30, but in which line radiation along the irradiation lines 25, 25 was not performed. Note that, in the simulations of Examples 1 to 7 and Comparative Example 1 shown in Table 1, spot radiation of an electron beam onto an irradiation spot 27 was not performed.

In Examples 1 to 7 and Comparative Example 1, the various temperatures T0, T1 and T2, an output Q2 of the electron beam for line radiation, a distance L between the irradiation line 25 and the supply line 26, a temperature gradient ΔT/L and the like were as shown in the aforementioned Table 1.

For each simulation, a transient calculation was performed because the flow and the temperature of the molten metal 5*c* change from moment to moment depending on radiation of an electron beam. The simulation was performed based on the assumption that the LDIs were titanium nitride, the grain size of the titanium nitride was 3.5 mm, and the density of the titanium nitride was 10% less than the molten metal 5*c*. Further, in Examples 1 to 7 and Comparative Example 1, an electron beam was radiated in a concentrated manner along each of the irradiation lines 25, 25 by scanning an electron beam from one end to the other end of each of the irradiation lines 25, 25 using one electron gun for line radiation. Although the line irradiation temperature T2 fluctuated temporally and spatially, the average value of the line irradiation temperature T2 was as shown in Table 1.

As illustrated in Table 1, in Examples 1 to 7 and Comparative Example 1, an LDI removal effect was evaluated on a four-grade scale (A grade to D grade). The outflow amount [g/min] of LDIs per unit time from the hearth 30 in the respective Examples 1 to 7 were evaluated based on the following evaluation criteria when taking the outflow amount [g/min] of LDIs per unit time from the hearth 30 in Comparative Example 1 as a reference value (100%).

A grade: outflow amount of LDIs is less than 0.1%, or outflow of LDIs is not detected B grade: outflow amount of LDIs is 0.1% or more and less than 1%

C grade: outflow amount of LDIs is 1% or more and less than 5%

D grade: outflow amount of LDIs is 100% (reference value)

Figure 18:
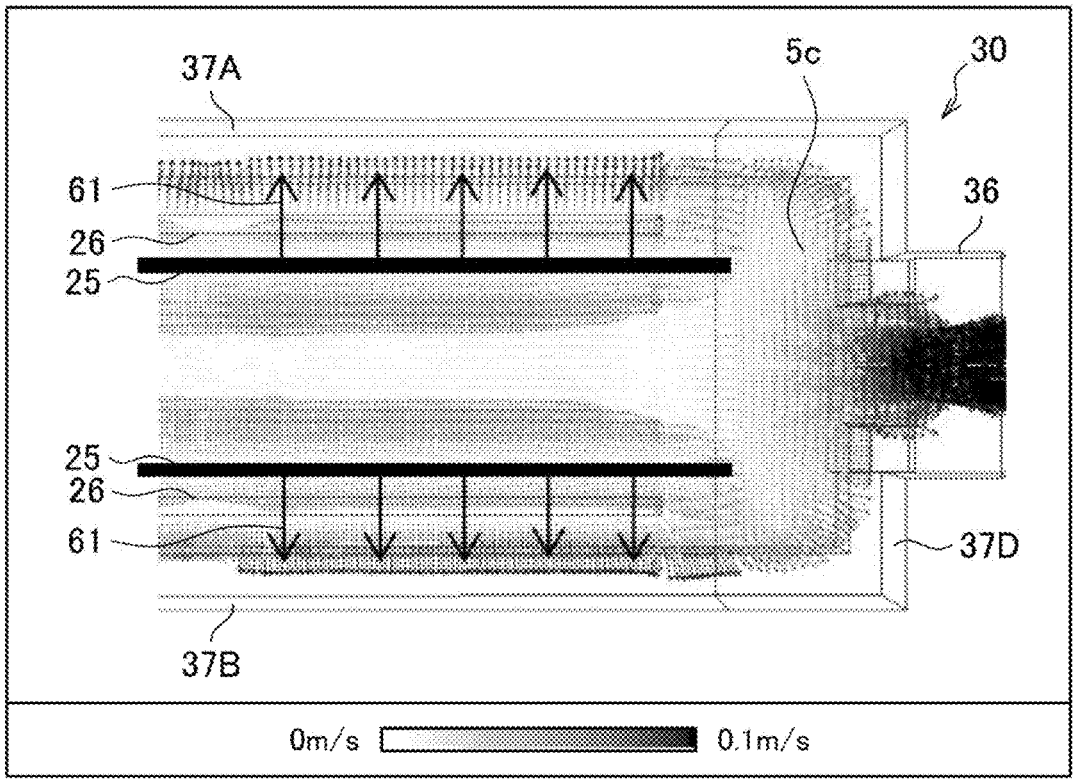
FIG. 18 is a flow line diagram illustrating the flowage of molten metal according to Example 1.

Next, the simulation results and the evaluation of the outflow amount of LDIs for Examples 1 to 7 and Comparative Example 1 will be described. FIG. 18 is a flow line diagram illustrating the flow of the molten metal 5*c* in Example 1. FIG. 19 to FIG. 25 show the simulation results for Examples 1 to 7, respectively, and FIG. 26 shows the simulation result for Comparative Example 1.

FIG. 19 to FIG. 25 show the temperature distribution at the surface of the molten metal 5*c* in the hearth 30 and the behavior of LDIs that flow through the surface of the molten metal 5*c*, when the radiation position of an electron beam for line radiation that was scanned along the irradiation line 25 was at six representative positions. In the temperature distribution charts on the left side in the aforementioned FIG. 19 to FIG. 25, a region at which the temperature is high that is marked with a round circle indicates a radiation position of an electron beam with respect to the irradiation line 25 at that time point, two upper and lower belt-like portions with a high temperature indicate the two supply lines 26, 26, and a low temperature portion in the vicinity of an inside face of the hearth indicates a portion at which the skull 7 is formed. Further, in the flow line diagrams on the right side in FIG.

19 to FIG. 25, flow lines that are drawn in a non-linear shape indicate the flow trajectory of LDIs.

In Example 1, as illustrated in FIG. 18 and FIG. 19, a high temperature region was formed along the irradiation lines 25 on the inner side of the supply lines 26, and the molten metal flows 61 were formed that passed over the supply lines 26 from the irradiation lines 25 and flowed toward the side walls 37A and 37B of the hearth 30. Therefore, as illustrated in FIG. 19, all of the LDIs in the vicinity of the supply lines 26 rode on the molten metal flows 61 and flowed toward the side walls 37A and 37B, and there were no flow lines extending from the lip portion 36 to the mold 40 side. Thus, it was found that the LDIs inside the hearth 30 were trapped by the skull 7 at the side walls 37A and 37B, and the LDIs did not flow out from the lip portion 36 to the mold 40. As a result, in Example 1 the LDI outflow amount was an extremely low value of less than 0.1%, and thus the LDI removal effect was evaluated as A grade.

Similarly, in Example 2 shown in FIG. 20 and Example 3 shown in FIG. 21 also, it was found that all of the LDIs in the vicinity of the supply lines 26 were caused to flow toward the side walls 37A and 37B by the molten metal flows 61 from the irradiation lines 25 to the side walls 37A and 37B and were trapped by the skull 7, and the LDIs were thus prevented from flowing out from the lip portion 36 to the mold 40. As a result, in Examples 2 and 3 also, the LDI outflow amount was an extremely low value of less than 0.1% of the LDI outflow amount in Comparative Example 1, and thus the LDI removal effect was evaluated as A grade.

It is considered that the reason is as follows. In each of the aforementioned Examples 1 to 3, the line irradiation temperature T2 was higher than the raw material supplying temperature T1, and the temperature gradient ΔT/L between the supply lines 26 and the irradiation lines 25 was a large value of 0.00 K/mm or more. Therefore, it is considered that because strong molten metal flows 61 could be formed from the irradiation lines 25 that crossed over the supply lines 26 and flowed toward the side walls 37A and 37B, the LDIs were appropriately controlled so as not to flow toward the lip portion 36, and thus the LDIs could be reliably prevented from flowing out into the mold 40.

Next, in Example 4 and Example 5, as illustrated in FIG. 22 and FIG. 23, although the LDIs in the vicinity of the supply lines 26 could be prevented from crossing the irradiation lines 25 and flowing out closer to the central part in the width direction (X direction) of the hearth 30, some LDIs flowed in the longitudinal direction (Y direction) of the hearth 30 through the belt-shaped regions S3 between the supply lines 26 and the irradiation lines 25. Therefore, in Examples 4 and 5, in comparison to Comparative Example 1, although the LDIs could be inhibited to a large degree from flowing out from the lip portion 36, a slight amount of LDIs flowed out from the lip portion 36. As a result, in Examples 4 and 5, the LDI outflow amount was in the range of 0.1% to less than 1% of the LDI outflow amount in Comparative Example 1, and thus the LDI removal effect was evaluated as B grade.

It is considered that the reason is as follows. In Examples 4 and 5, the line irradiation temperature T2 was lower than the raw material supplying temperature T1, and the temperature gradient ΔT/L was in the range of −2.70 K/mm to less than 0.00 K/mm, which was smaller than the temperature gradient ΔT/L in the aforementioned Examples 1 to 3. Therefore, in Examples 4 and 5, the molten metal flows 61 from the irradiation lines 25 toward the supply lines 26 that are illustrated in FIG. 8 could not suppress the molten metal flows 62 from the supply lines 26 toward the irradiation lines 25, and the molten metal flows 66 in the Y direction were formed in the belt-shaped regions S3 between the supply lines 26 and the irradiation lines 25. Therefore, it is considered that some LDIs rode on the molten metal flows 66 and flowed to the lip portion 36.

Further, according to the results of comparing the aforementioned Examples 1 to 3 with Examples 4 and 5, it can be said that the effect of preventing an outflow of LDIs by line radiation is superior in Examples 1 to 3 ($T2 \geq T1$, $\Delta T/L \geq 0.00$) compared to Examples 4 and 5 ($T2 < T1$, $-2.70 \leq \Delta T/L < 0.00$).

Next, in Example 6 and Example 7, as illustrated in FIG. 24 and FIG. 25, flowing of LDIs in the vicinity of the supply lines 26 toward the central part in the width direction (X direction) of the hearth 30 could be inhibited to a certain extent by high temperature regions in the vicinity of the irradiation lines 25. However, some LDIs flowed from the supply lines 26 and crossed the irradiation lines 25 and flowed toward the central part in the width direction (X direction) of the hearth 30, and then flowed in the Y direction toward the lip portion 36 from the central part, and a certain amount of LDIs flowed out from the lip portion 36. As a result, in Examples 6 and 7, the LDI outflow amount was in the range of 1% to less than 5% of the LDI outflow amount in Comparative Example 1, and thus the LDI removal effect was evaluated as C grade.

It is considered that the reason is as follows. In Examples 6 and 7, the line irradiation temperature T2 was lower than the raw material supplying temperature T1, and the temperature gradient ΔT/L was less than −2.70 K/mm, which was even smaller than the temperature gradient ΔT/L in the aforementioned Examples 4 and 5. Therefore, in Examples 6 and 7, in a part of the region illustrated in FIG. 9, the molten metal flows 62 from the supply lines 26 toward the irradiation lines 25 were dominant over the molten metal flows 61 from the irradiation lines 25 toward the supply lines 26. Therefore, it is considered that molten metal flows 67 were formed from the supply lines 26 that crossed over the irradiation lines 25, and some LDIs leaked out to the central part of the hearth 30.

Further, according to the results of comparing Examples 1 to 5 with Examples 6 and 7, it can be said that the effect of preventing an outflow of LDIs by line radiation is superior in Examples 1 to 5 ($\Delta T/L \geq -2.70$) compared to Examples 6 and 7 ($\Delta T/L < -2.70$).

In contrast, in Comparative Example 1, as illustrated in FIG. 17, an electron beam was not radiated along the irradiation lines 25. Therefore, as illustrated in FIG. 26, LDIs freely flowed from the high temperature regions at the supply lines 26 toward the central part of the hearth 30 and rode on the molten metal flow 60 at the central part of the hearth 30, and a large amount of LDIs flowed out from the lip portion 36 to the mold 40. The result of Comparative Example 1 in which the LDI removal effect according to the present invention was not obtained was taken as D grade, and was adopted as a reference for other examples.

The simulation results for Examples 1 to 7 and Comparative Example 1 have been described above. According to these results it can be said that is was verified that by performing line radiation of an electron beam in a concentrated manner along the irradiation lines 25 as described in Examples 1 to 7, a flowage of LDIs that reside in the vicinity of the supply lines 26 is restricted and the LDIs can be inhibited from flowing toward the lip portion 36, and thus an outflow amount of the LDIs from the lip portion 36 can be reduced to less than 5% of the outflow amount of the LDIs in Comparative Example 1. In particular, it can be said that it was verified that from the viewpoint of preventing an outflow of LDIs by line radiation and increasing the LDI removal effect, Examples 4 and 5 ($-2.70 \leq \Delta T/L < 0.00$) are preferable, and Examples 1 to 3 ($\Delta T/L \geq 0.00$) are further preferable.

(2) Line Radiation and Spot Radiation Examples

Next, referring to Table 2 and FIG. 27 to FIG. 32, examples will be described in which simulations were performed to verify an LDI removal effect obtained by a combination of line radiation and spot radiation according to the second embodiment of the present invention that is described above.

With respect to the present examples, a molten metal flow inside the hearth 30 was simulated for a case where a titanium alloy, for example, was used as the raw material 5, and with respect to the molten metal 5*c* of the titanium alloy that was accumulated inside the short hearth illustrated in FIG. 3, an electron beam was radiated along the irradiation lines 25 and an electron beam was radiated onto the irradiation spots 27. The temperature distribution of the molten metal 5*c* in the hearth 30, the behavior of LDIs, and the outflow amount of the LDIs from the hearth 30 were ascertained.

The simulation conditions and evaluation results for the present examples are shown in Table 2.

TABLE 2

Simulation Conditions and Evaluation Results of Examples of Line Radiation and Spot Radiation

Figure 27:
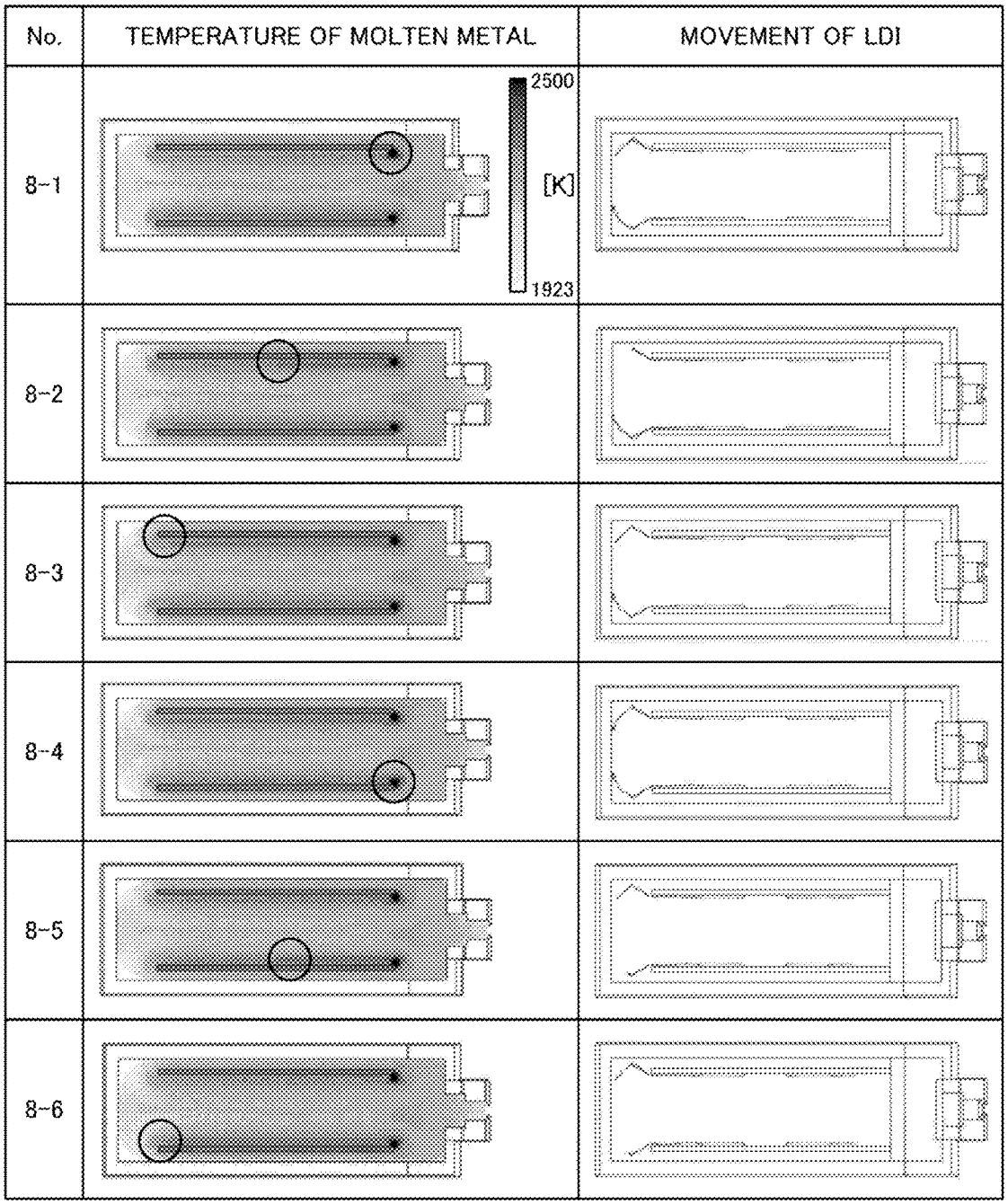
FIG. 27 is an explanatory drawing illustrating a simulation result according to Example 8.
Figure 28:
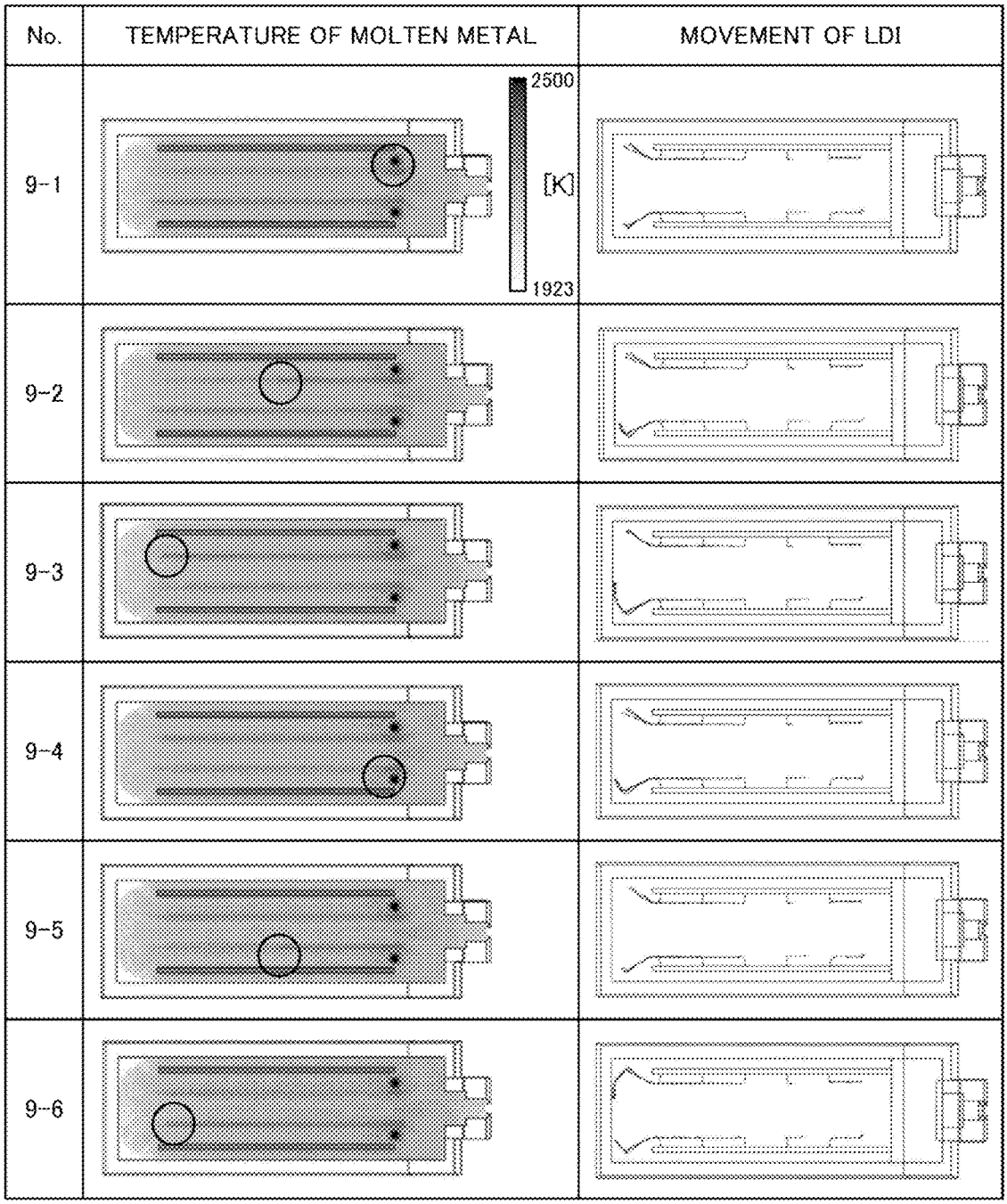
FIG. 28 is an explanatory drawing illustrating a simulation result according to Example 9.
Figure 29:
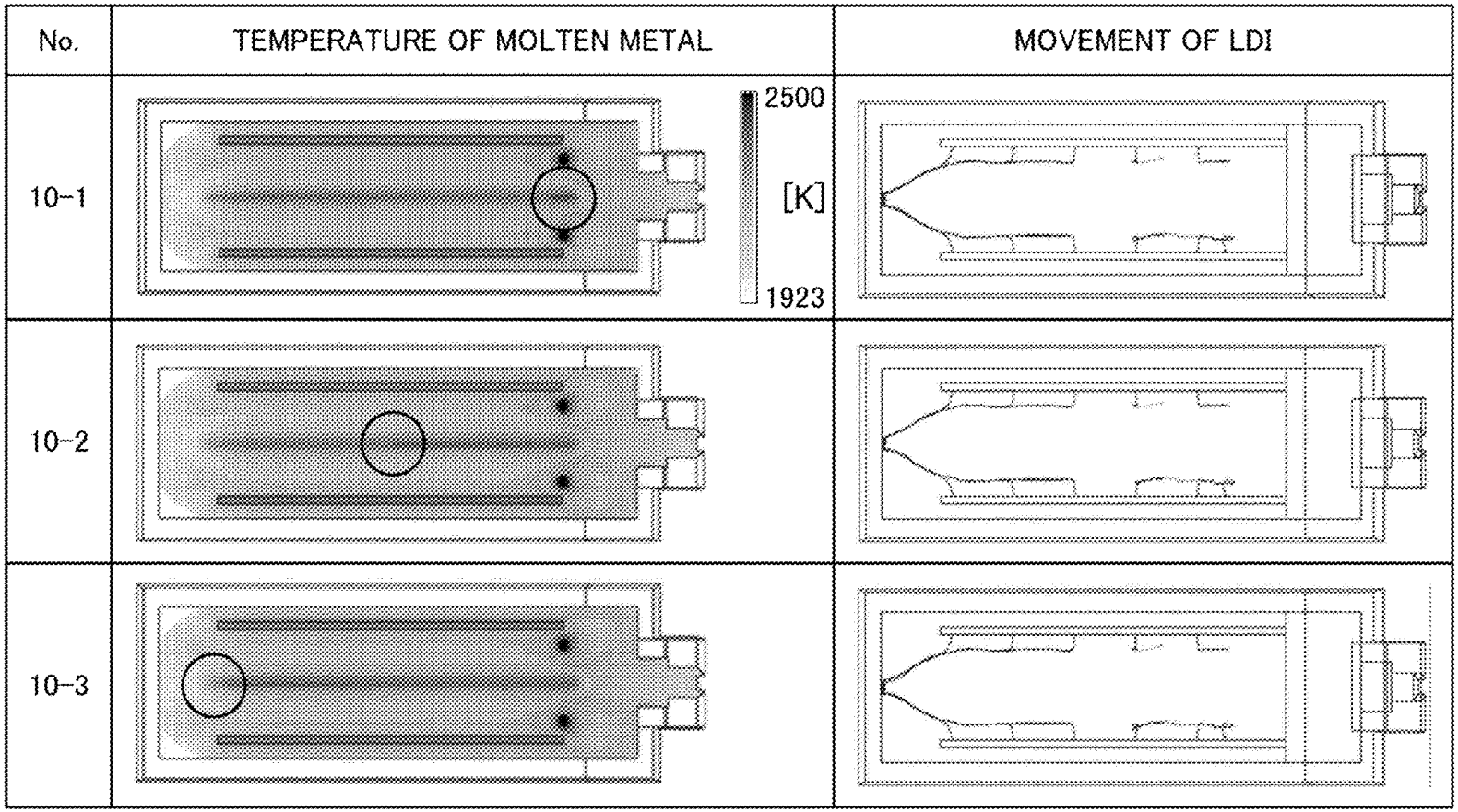
FIG. 29 is an explanatory drawing illustrating a simulation result according to Example 10.
Figure 30:
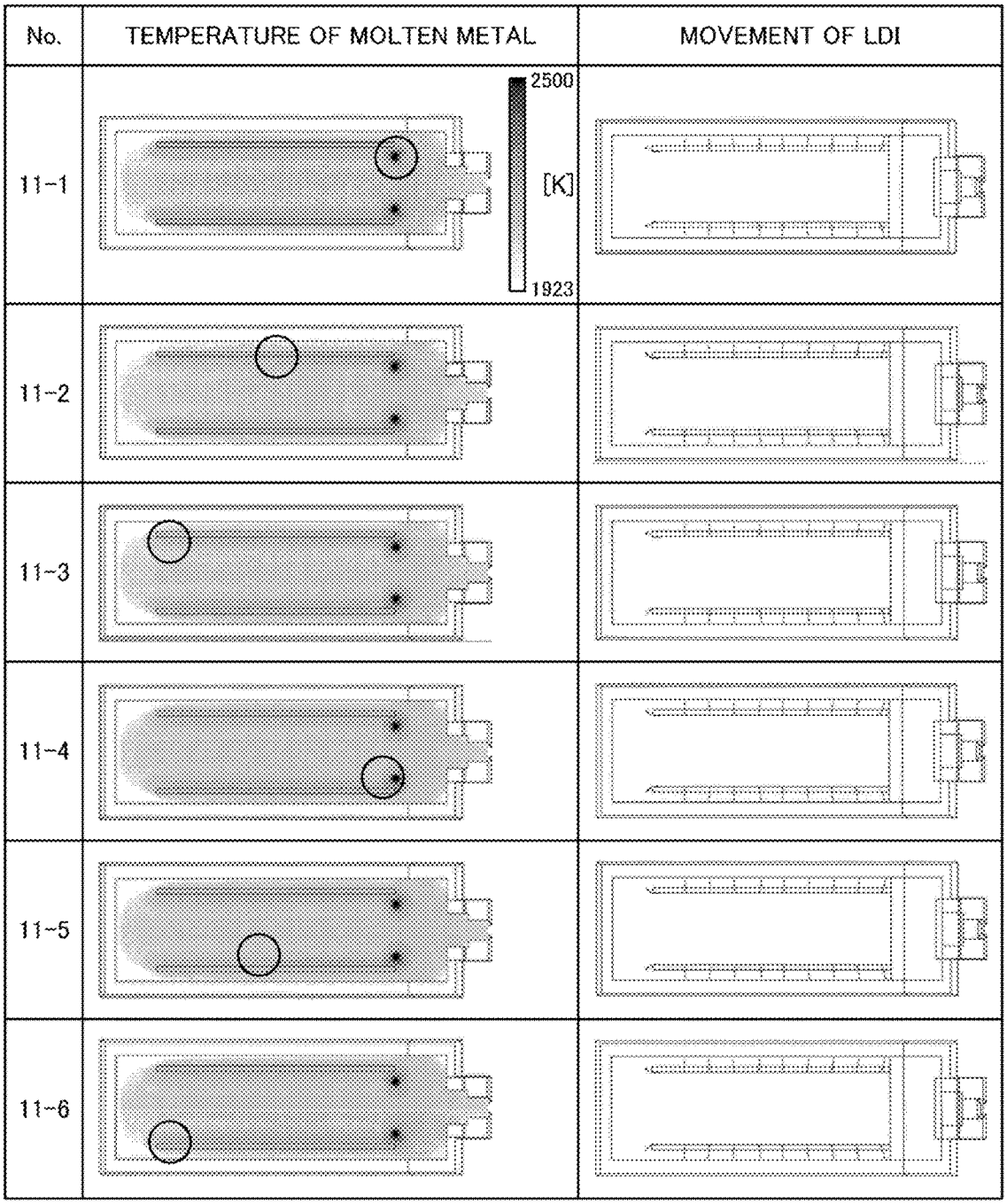
FIG. 30 is an explanatory drawing illustrating a simulation result according to Example 11.
Figure 31:
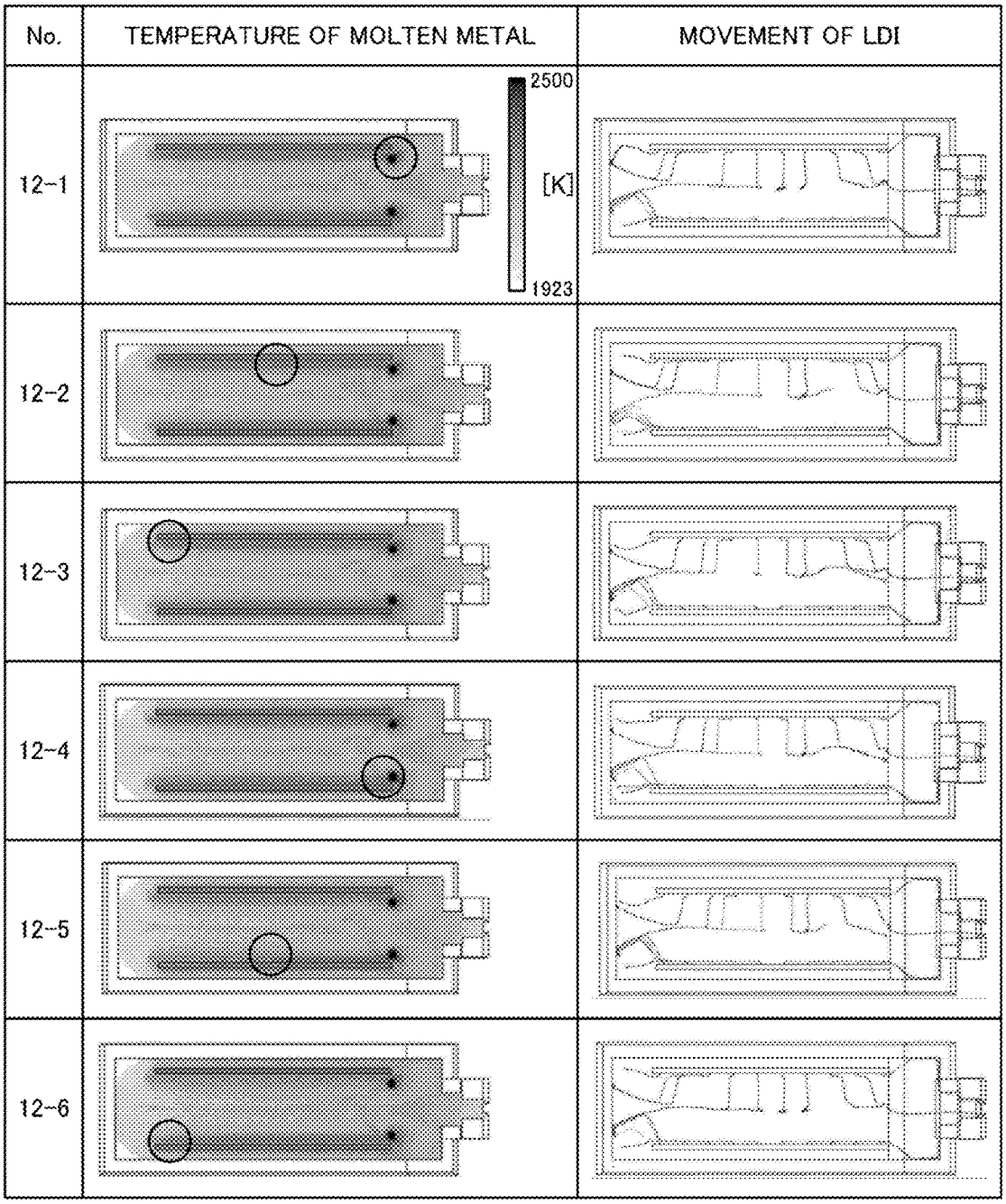
FIG. 31 is an explanatory drawing illustrating a simulation result according to Example 12.
Figure 32:
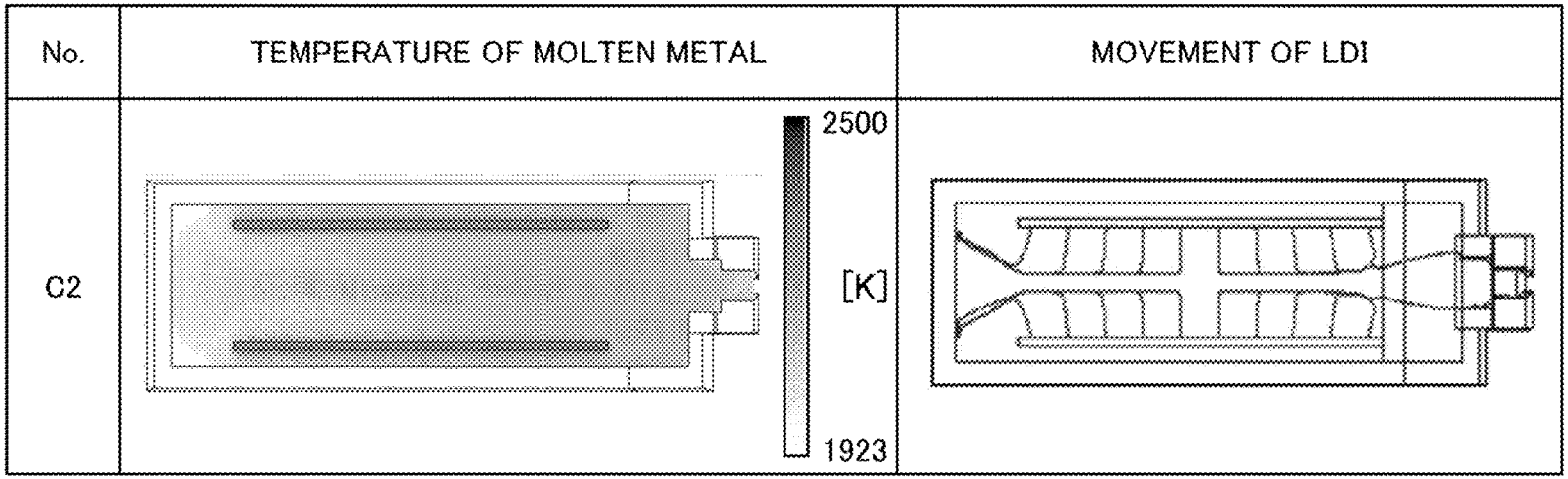
FIG. 32 is an explanatory drawing illustrating a simulation result according to Comparative Example 2.

| NO. | FIG. | Line Radiation | Spot Radiation | Molten Metal Surface Temperature T0 [K] | Raw Material Supplying Temperature T1 [K] | Line Irradiation Temperature T2 [K] | Spot Irradiation Temperature T3 [K] |
|---|---|---|---|---|---|---|---|
| Example 8 | FIG. 27 | present | present | 2160 | 2373 | 2307 | 2432 |
| Example 9 | FIG. 28 | present | present | 2172 | 2373 | 2263 | 2432 |
| Example 10 | FIG. 29 | present | present | 2176 | 2373 | 2362 | 2432 |
| Example 11 | FIG. 30 | present | present | 2089 | 2173 | 2187 | 2432 |
| Example 12 | FIG. 31 | present | present | 2153 | 2373 | 2301 | 2432 |
| Comparative Example 2 | FIG. 32 | absent | absent | 2159 | 2373 | — | — |

| NO. | Temperature Difference ΔT (=T2 − T1) [K] | Output Q2 of Electron Beam for Line Radiation [MW] | Output Q3 of Electron Beam for Spot Radiation [MW] | Distance L between Irradiation Line and Introduction Line [mm] | Temperature Gradient ΔT/L [K/mm] | Evaluation of LDI Removal Effect |
|---|---|---|---|---|---|---|
| Example 8 | −66 | 0.4 | 0.1 | 25 | −2.64 | A |
| Example 9 | −110 | 0.4 | 0.1 | 80 | −1.38 | A |
| Example 10 | −11 | 0.4 | 0.1 | 140 | −0.08 | A |
| Example 11 | 14 | 0.4 | 0.1 | 20 | 0.70 | A |
| Example 12 | −72 | 0.4 | 0.1 | 20 | −3.60 | C |
| Comparative Example 2 | — | — | — | — | — | D |

In the simulations of Examples 8 to 12 shown in Table 2, as illustrated in FIG. 12, two supply lines 26, 26 having a straight-line shape were disposed parallel to the side walls 37A and 37B, two irradiation lines 25, 25 having a straight-line shape were disposed parallel to the supply lines 26, and irradiation spots 27, 27 were disposed at the end portions on the lip portion 36 side of the belt-shaped regions S3, S3 between the two pairs of an irradiation line 25 and a supply line 26. While dripping a molten titanium alloy at the raw material supplying temperature T1 along the supply lines 26, 26, an electron beam for heat retention was radiated onto the heat-retention radiation region 23 of the molten metal 5*c* inside the hearth 30 (heat-retention radiation) to maintain the surface temperature of the molten metal 5*c* at the molten metal surface temperature T0, and an electron beam for line radiation was radiated in a concentrated manner along the irradiation lines 25, 25 (line radiation), and an electron beam for spot radiation was radiated in a concentrated manner onto the irradiation spots 27, 27 (spot radiation).

On the other hand, as Comparative Example 2, as illustrated in FIG. 17, a similar simulation was also performed for a case in which heat-retention radiation was performed with respect to the molten metal 5*c*, but line radiation along the irradiation lines 25, 25 and spot radiation onto the irradiation spots 27, 27 was not performed.

In Examples 8 to 12 and Comparative Example 2, the various temperatures T0, T1, T2 and T3, an output Q2 of the electron beam for line radiation, an output Q3 of the electron beam for spot radiation, a distance L between the irradiation line 25 and the supply line 26, a temperature gradient ΔT/L and the like were as shown in the aforementioned Table 2. The other conditions were made the same as the simulation conditions in the aforementioned Examples 1 to 7. Further, with regard to the evaluation criteria for evaluating the LDI removal effect (evaluation based on four grades from A to D), the evaluation criteria were made the same as in the aforementioned Examples 1 to 7 with the exception that Comparative Example 2 was adopted as a reference value (100%) instead of Comparative Example 1.

Next, the simulation results and the evaluation of outflow amount of LDIs for Example 8 to 12 and Comparative Example 2 will be described. FIG. 27 to FIG. 31 show simulation results for Examples 8 to 12, respectively, and FIG. 32 shows the simulation result for Comparative Example 2. Note that, in the temperature distribution charts on the left side in FIG. 27 to FIG. 31, two spots at which the temperature is high that are on the right end side of the supply lines 26, 26 indicate the aforementioned irradiation spots 27, 27.

In Example 8, as illustrated in FIG. 27, although the LDIs in the vicinity of the supply lines 26 could be prevented from crossing the irradiation lines 25 and flowing out closer to the central part in the width direction (X direction) of the hearth 30, some LDIs flowed in the longitudinal direction (Y direction) of the hearth 30 through the belt-shaped regions S3 between the supply lines 26 and the irradiation lines 25. However, it was found that because an electron beam was radiated in a concentrated manner onto the irradiation spot 27 at the end portion (right end in the drawing) on the lip portion 36 side of each belt-shaped region S3, as illustrated in the flow line diagram on the right side in FIG. 27, LDIs did not flow over the position of the irradiation spot 27 and flow toward the lip portion 36, and the LDIs could thus be prevented from flowing out from the lip portion 36 to the mold 40. As a result, in Example 8 also, the LDI outflow amount was a low value that was less than 0.1% of the LDI outflow amount in Comparative Example 2, and thus the LDI removal effect was evaluated as A grade.

Similarly, in Example 9 and Example 10 also, as illustrated in the flow line diagrams on the right side in FIG. 28 and FIG. 29, it was found that LDIs did not flow over the positions of the irradiation spots 27 at the right end of the belt-shaped regions S3 and flow toward the lip portion 36. As a result, in Example 9 and Example 10 also, the LDI outflow amount was a low value that was less than 0.1% of the LDI outflow amount in Comparative Example 2, and thus the LDI removal effect was evaluated as A grade.

It is considered that the reason is as follows. In Examples 8 to 10, because the temperature gradient ΔT/L was in a range of −2.70 K/mm to less than 0.00 K/mm, the molten metal flows 61 from the irradiation lines 25 toward the supply lines 26 that are illustrated in FIG. 8 could not suppress the molten metal flows 62 from the supply lines 26 toward the irradiation lines 25, and the molten metal flows 66 in the Y direction were formed in the belt-shaped regions S3 between the supply lines 26 and the irradiation lines 25. In this respect, it is considered that in a case where spot-radiation is not performed as in the aforementioned Examples 4 and 5, some LDIs ride on the molten metal flows 61 illustrated in FIG. 8 and flow toward the lip portion 36. However, in Examples 8 to 10, as illustrated in FIG. 12, an electron beam was radiated onto the irradiation spots 27 positioned at the end portion on the lip portion 36 side of the molten metal flow 66 of each belt-shaped region S3, and a high temperature region was formed in which the temperature was the spot irradiation temperature T3 that was higher than T1. Therefore, it is considered that, at the positions of the irradiation spots 27, the titanium nitride of the LDIs contained in the molten metal flows 66 was dissolved into the molten metal 5*c* by heat, thereby removing the LDIs.

Next, in Example 11, as illustrated in FIG. 30, it was found that all of the LDIs in the vicinity of the supply lines 26 were caused to flow toward the side walls 37A and 37B by the molten metal flows 61 from the irradiation lines 25 to the side walls 37A and 37B and were trapped by the skull 7, and the LDIs were thus prevented from flowing out from the lip portion 36 to the mold 40. As a result, in Example 11, the LDI outflow amount was a low value of less than 0.1% of the LDI outflow amount in Comparative Example 2, and thus the LDI removal effect was evaluated as A grade.

It is considered that the reason is as follows. In the aforementioned Example 11, the line irradiation temperature T2 was higher than the raw material supplying temperature T1, and the temperature gradient ΔT/L between the supply lines 26 and the irradiation lines 25 was +0.70 K/mm, which was sufficiently larger than 0.00 K/mm that is the aforementioned threshold value. Therefore, it is considered that because strong molten metal flows 61 could be formed from the irradiation lines 25 that crossed over the supply lines 26 and flowed toward the side walls 37A and 37B, the LDIs were appropriately controlled so as not to flow toward the lip portion 36, and thus the LDIs could be reliably prevented from flowing out into the mold 40. Accordingly, it is considered that with respect to Example 11, even if spot radiation were not performed, an outflow of LDIs could be adequately prevented.

Next, in Example 12, as illustrated in FIG. 31, flowing of LDIs in the vicinity of the supply lines 26 toward the central part in the width direction (X direction) of the hearth 30 could be inhibited to a certain extent by high temperature regions in the vicinity of the irradiation lines 25. However, some LDIs flowed from the supply lines 26 and crossed the irradiation lines 25 and flowed toward the central part in the width direction (X direction) of the hearth 30, and then flowed in the Y direction toward the lip portion 36 from the central part, and a certain amount of LDIs flowed out from the lip portion 36. As a result, in Example 12, the LDI outflow amount was in the range of 1% to less than 5% of the LDI outflow amount in Comparative Example 2, and thus the LDI removal effect was evaluated as C grade.

It is considered that the reason is as follows. In Example 12, the line irradiation temperature T2 was lower than the raw material supplying temperature T1, and the temperature gradient ΔT/L was −3.60 K/mm, which was lower than −2.70 K/mm that is the aforementioned threshold value. Therefore, in Example 12, in a part of the region illustrated in FIG. 9, the molten metal flows 62 from the supply lines 26 toward the irradiation lines 25 were dominant over the molten metal flows 61 from the irradiation lines 25 toward the supply lines 26. Therefore, it is considered that molten metal flows 67 were formed from the supply lines 26 that crossed over the irradiation lines 25, and some LDIs leaked out to the central part of the hearth 30.

In contrast, in Comparative Example 2, as illustrated in FIG. 17, an electron beam was not radiated along the irradiation lines 25. Therefore, as illustrated in FIG. 32, LDIs freely flowed from the high temperature regions at the supply lines 26 toward the central part of the hearth 30 and rode on the molten metal flow 60 at the central part of the hearth 30, and a large amount of LDIs flowed out from the lip portion 36 to the mold 40. The result of Comparative Example 2 in which the LDI removal effect according to the present invention was not obtained was taken as D grade, and was adopted as a reference for other examples.

The simulation results for Examples 8 to 12 and Comparative Example 2 have been described above. According to these results it can be said that is was verified that by performing spot radiation of an electron beam in a concentrated manner on the irradiation spots 27 as described in Examples 8 to 12, LDIs contained in the molten metal flow 66 that flow in the Y direction in the belt-shaped regions S3 are dissolved and the LDIs can be inhibited from flowing toward the lip portion 36, and thus an outflow amount of the LDIs from the lip portion 36 can be reduced to less than 5% of the outflow amount of the LDIs in Comparative Example 2. In particular, it can be said that it was verified that, as in Examples 8 to 10, because ΔT/L is in the range of −2.70 K/mm to less than 0.00 K/mm, in a case where the molten metal flow 66 that flows in the Y direction toward the lip portion 36 is formed in the belt-shaped region S3 (see FIG. 9), it is effective to perform spot radiation of an electron beam in a concentrated manner onto the irradiation spot 27.

Whilst preferred embodiments of the present invention have been described in detail above with reference to the accompanying drawings, the present invention is not limited to the above examples. It is clear that a person having common knowledge in the field of the art to which the present invention pertains will be able to contrive various examples of changes and modifications within the category of the technical idea described in the appended claims, and it should be understood that they also naturally belong to the technical scope of the present invention.

In the foregoing, examples of producing an ingot 50 of titanium using the hearth 30 and the mold 40 in which the metal raw material 5 that is the object of melting by the method for producing a metal ingot according to the present embodiments is, for example, a raw material of titanium or a titanium alloy have been mainly described. However, the method for producing a metal ingot of the present invention is also applicable to cases where various metal raw materials other than a titanium raw material are melted and an ingot of the relevant metal raw material is produced. In particular, the method for producing a metal ingot of the present invention is also applicable to a case of producing an ingot of a high-melting-point active metal with which it is possible to produce an ingot using an electron gun capable of controlling a radiation position of an electron beam and an electron-beam melting furnace having a hearth that accumulates a molten metal of a metal raw material, specifically, a case of producing an ingot of a metal raw material such as, apart from titanium, tantalum, niobium, vanadium, molybdenum or zirconium. In other words, the present invention can be applied particularly effectively to a case of producing an ingot containing the respective elements mentioned here in a total amount of 50% by mass or more.

REFERENCE SIGNS LIST

1 Electron-beam melting furnace (EB furnace)
5 Metal raw material
5*c* Molten metal
7 Skull
8 LDI
10A, 10B Raw material supplying portion
20A, 20B Electron gun for melting raw material
20C, 20D Electron gun for maintaining temperature of molten metal
20E Electron gun for line radiation
23 Heat-retention radiation region
25 First irradiation line
26 Supply line
27 Irradiation spot
28 Second irradiation line
30 Refining hearth
36 Lip portion
37A, 37B, 37C Second side wall
37D First side wall
40 Mold
50 Ingot
61, 62, 63, 64, 65, 66, 67, 68 Molten metal flow
S3 Belt-shaped region

The invention claimed is:

1. A method for producing a metal ingot by using an electron-beam melting furnace having an electron gun capable of controlling a radiation position of an electron beam and a hearth that accumulates a molten metal of a metal raw material, said hearth having four side walls, the metal ingot containing 50% by mass or more in total of at least one of titanium, tantalum, niobium, vanadium, molybdenum and zirconium, said method comprising:

supplying the metal raw material into the molten metal, which is inside the hearth, at positions along supply lines adjacent to side walls on long sides of the hearth, along inside faces of said side walls on long sides of the hearth, wherein said side walls on long sides of the hearth are side walls that face each other in an X direction of the hearth and are parallel to the longitudinal direction Y of the hearth; and radiating a first electron beam in a concentrated manner along a first irradiation line, wherein said first irradiation line is adjacent to a corresponding supply line on the surface of the molten metal, wherein said first irradiation line is in a linear shape extended along said corresponding supply line, disposed along said corresponding supply line, and closer to a central part of the hearth than said corresponding supply line;

wherein:

among the four side walls of the hearth, which accumulate the molten metal of the metal raw material, one side wall is provided with a lip portion for causing the molten metal in the hearth to flow out into a mold and is identified as a primary side wall, and remaining side walls other than the primary side wall are identified as secondary side walls;

the radiation of the first electron beam along the first irradiation line increases a surface temperature (T2) of the molten metal at the first irradiation line above an average surface temperature (T0) of the entire surface of the molten metal in the hearth, and forms, in an outer layer of the molten metal, a first molten metal flow from the first irradiation line toward the corresponding supply line;

the supply lines are set in a straight-line shape that is substantially parallel to inside faces of the side walls on the long side of the hearth, the first irradiation line is set in a straight-line shape that is substantially parallel to the corresponding supply line, a distance between an inside face of each of the side walls on the long side of the hearth and the corresponding supply line is constant, and a distance between each irradiation line and the corresponding supply line is constant.

2. The method for producing a metal ingot according to claim 1, wherein a temperature gradient ΔT/L represented by Formula (A) below is −2.70 [K/mm] or more:

$$\Delta T/L=(T2-T1)/L \quad \text{(A)}$$

T2: surface temperature [K] of the molten metal at the first irradiation line, T1: surface temperature [K] of the molten metal at the corresponding supply line, L: distance [mm] between the first irradiation line and the corresponding supply line on the surface of the molten metal.

3. The method for producing a metal ingot according to claim 2, wherein:

the ΔT/L is 0.00 [K/mm] or more, and the first molten metal flow that flows from the first irradiation line across the corresponding supply line toward an inside face of a secondary side wall is formed in the outer layer of the molten metal.

4. The method for producing a metal ingot according to claim 1, wherein:

the metal raw material is melted at a raw material supplying portion, and the melted metal raw material is caused to drip from the raw material supplying portion onto a position on the corresponding supply line of the molten metal in the hearth.

5. The method for producing a metal ingot according to claim 1, wherein:

on the surface of the molten metal, both ends of the first irradiation line are positioned on an outer side in an extending direction of the corresponding supply line relative to both ends of the corresponding supply line.

6. The method for producing a metal ingot according to claim 1, wherein:

a second molten metal flow toward the lip portion is formed in a belt-shaped region between the first irradiation line and the corresponding supply line, and a second electron beam is spot-radiated onto the second molten metal flow.

7. The method for producing a metal ingot according to claim 6, wherein:

the second electron beam is spot-radiated onto the second molten metal flow at a position of an irradiation spot that is disposed at an end portion on the lip portion side of the belt-shaped region.

8. The method for producing a metal ingot according to claim 1, wherein:

an additional electron beam is radiated along a second irradiation line, the second irradiation line being disposed such that the second irradiation line blocks the lip portion on the surface of the molten metal and both ends of the second irradiation line are positioned in a vicinity of the primary side wall.

9. The method for producing a metal ingot according to claim 1, wherein the metal raw material contains 50% by mass or more of a titanium element.

* * * * *